US006168263B1

(12) United States Patent
Nojima et al.

(10) Patent No.: US 6,168,263 B1
(45) **Date of Patent: *Jan. 2, 2001**

(54) INK JET RECORDING APPARATUS

(75) Inventors: Shigeo Nojima, Suwa; Masahiro Fujii, Shiojiri; Taro Takekoshi, Shiojiri; Hiroyuki Ishikawa, Shiojiri, all of (JP)

(73) Assignee: Seiko Epson Corporation, Tokyo (JP)

( * ) Notice: Under 35 U.S.C. 154(b), the term of this patent shall be extended for 0 days.

This patent is subject to a terminal disclaimer.

(21) Appl. No.: 09/181,223

(22) Filed: Oct. 27, 1998

Related U.S. Application Data

(63) Continuation-in-part of application No. 08/795,413, filed on Feb. 3, 1997, now Pat. No. 5,912,684, which is a continuation-in-part of application No. 08/400,642, filed on Mar. 8, 1995, now abandoned, which is a continuation-in-part of application No. 08/069,198, filed on May 28, 1993, now abandoned, which is a continuation-in-part of application No. 08/477,681, filed on Jun. 7, 1995, which is a continuation-in-part of application No. 07/757,691, filed on Sep. 11, 1991, now Pat. No. 5,534,900.

(30) Foreign Application Priority Data

| | | |
|---|---|---|
| Sep. 21, 1990 | (JP) | 2-252252 |
| Nov. 14, 1990 | (JP) | 2-307855 |
| Nov. 15, 1990 | (JP) | 2-309335 |
| Jun. 12, 1991 | (JP) | 3-140009 |
| Jun. 5, 1992 | (JP) | 4-145764 |
| Jun. 12, 1992 | (JP) | 4-153808 |
| Jul. 8, 1992 | (JP) | 4-181233 |
| Jul. 8, 1992 | (JP) | 4-181240 |
| Mar. 9, 1994 | (JP) | 6-38733 |
| Oct. 28, 1997 | (JP) | 9-295494 |

(51) Int. Cl.[7] ..... B41J 2/04
(52) U.S. Cl. ..... 347/54
(58) Field of Search ..... 347/54, 15, 57, 347/68, 72

(56) References Cited

U.S. PATENT DOCUMENTS

| | | |
|---|---|---|
| 4,153,836 | 5/1979 | Simm . |
| 4,203,128 | 5/1980 | Guckel et al. . |
| 4,234,361 | 11/1980 | Guckel et al. . |
| 4,312,008 | 1/1982 | Taub et al. . |
| 4,384,899 | 5/1983 | Myers . |
| 4,429,321 | 1/1984 | Matsumoto . |
| 4,459,601 | 7/1984 | Howkins . |
| 4,471,363 | 9/1984 | Hanaoka . |
| 4,520,375 | 5/1985 | Kroll . |
| 4,588,998 | 5/1986 | Yamamuro et al. . |

(List continued on next page.)

FOREIGN PATENT DOCUMENTS

| | | |
|---|---|---|
| 0 479 441 | 4/1992 | (EP) . |
| 488 113 A1 | 6/1992 | (EP) . |
| 2 146 566 | 4/1985 | (GB) . |
| 55-79171 | 6/1980 | (JP) . |
| 56-142071 | 11/1981 | (JP) . |

(List continued on next page.)

*Primary Examiner*—Thinh Nguyen

(57) ABSTRACT

An ink jet recording apparatus that achieves sufficient attraction force even when the actuator is sealed. In the ink jet recording apparatus, an electric pulse is applied between a diaphragm and electrode by a drive circuit to deform a diaphragm by electrostatic force to eject an ink droplet from a nozzle comprises a vibration chamber containing a wall surface formed by the diaphragm and a wall surface on which the electrode is formed, and a first cavity communicating with the vibration chamber and containing a wall surface on which is provided a lead for connecting the drive circuit and electrode. The vibration chamber is sealed airtight, and comprises a second cavity communicating with the vibration chamber or first cavity for increasing the volume of the airtight sealed part of the actuator.

12 Claims, 41 Drawing Sheets

U.S. PATENT DOCUMENTS

| | | |
|---|---|---|
| 4,611,219 | 9/1986 | Sugitani et al. . |
| 4,719,477 | 1/1988 | Hess . |
| 4,725,851 | 2/1988 | Sutera et al. . |
| 4,733,447 | 3/1988 | Ageishi . |
| 4,766,666 | 8/1988 | Sugiyama et al. . |
| 4,777,497 | 10/1988 | Nozu et al. . |
| 4,879,568 | 11/1989 | Bartky et al. . |
| 5,116,457 | 5/1992 | Jerman . |
| 5,144,342 | 9/1992 | Kubota . |
| 5,163,177 | 11/1992 | Komura . |
| 5,371,529 | 12/1994 | Eguchi et al. . |
| 5,376,231 | 12/1994 | Matsumoto et al. . |
| 5,446,485 | 8/1995 | Usui et al. . |
| 5,513,431 | 5/1996 | Ohno et al. . |
| 5,534,900 | 7/1996 | Ohno et al. . |
| 5,563,634 | 10/1996 | Fujii et al. . |
| 5,644,341 | 7/1997 | Fujii et al. . |

FOREIGN PATENT DOCUMENTS

| | | |
|---|---|---|
| 58-224760 | 12/1983 | (JP) . |
| 59-115860 | 4/1984 | (JP) . |
| 60-97860 | 5/1985 | (JP) . |
| 61-59911 | 12/1986 | (JP) . |
| 1-246850 | 2/1989 | (JP) . |
| 2-012218 | 1/1990 | (JP) . |
| 2-080252 | 3/1990 | (JP) . |
| 2-274552 | 8/1990 | (JP) . |
| 2-266943 | 10/1990 | (JP) . |
| 2-289351 | 11/1990 | (JP) . |
| 2-51734 | 11/1990 | (JP) . |
| 2-89351 | 11/1990 | (JP) . |
| 3-67659 | 3/1991 | (JP) . |
| 3-253346 | 12/1991 | (JP) . |
| 3-288649 | 12/1991 | (JP) . |
| 3-295654 | 12/1991 | (JP) . |
| 3-297653 | 12/1991 | (JP) . |

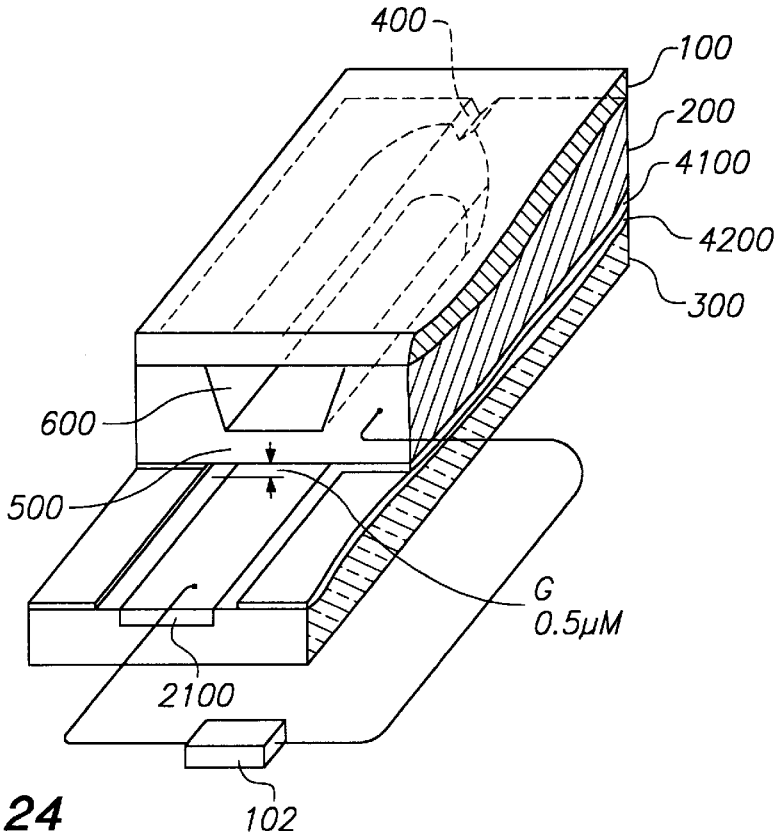
FIG. 24
FIG. 25A
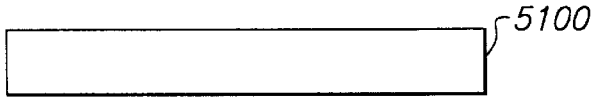
FIG. 25B
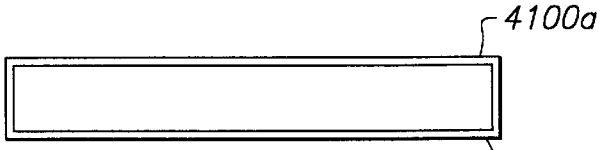
FIG. 25C
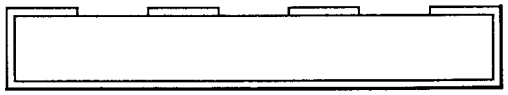
FIG. 25D
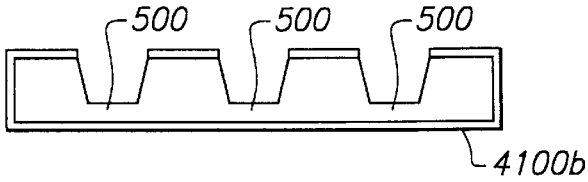
FIG. 25E
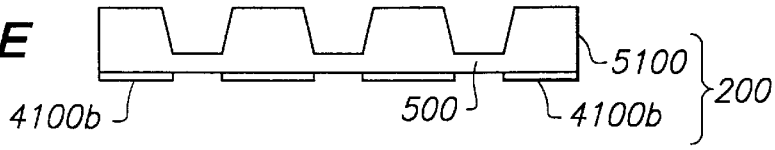

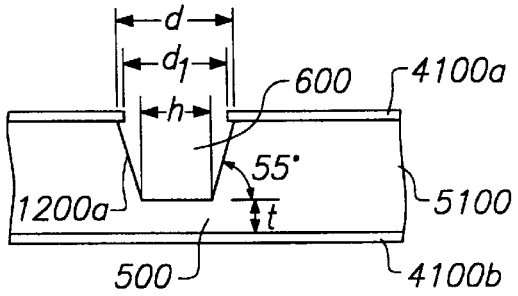
FIG. 26
FIG. 27A
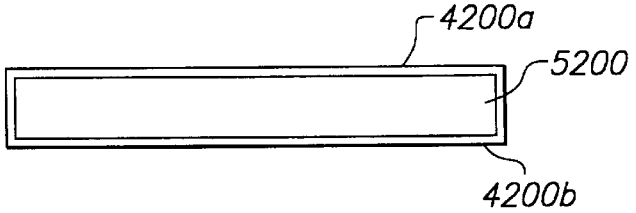
FIG. 27B
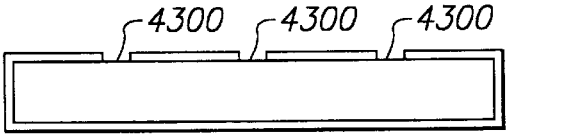
FIG. 27C
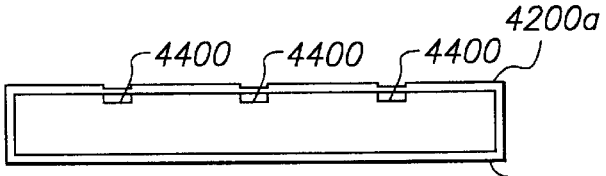
FIG. 27D
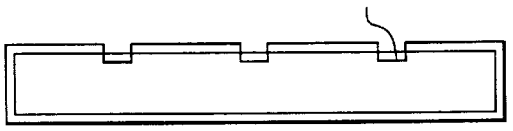
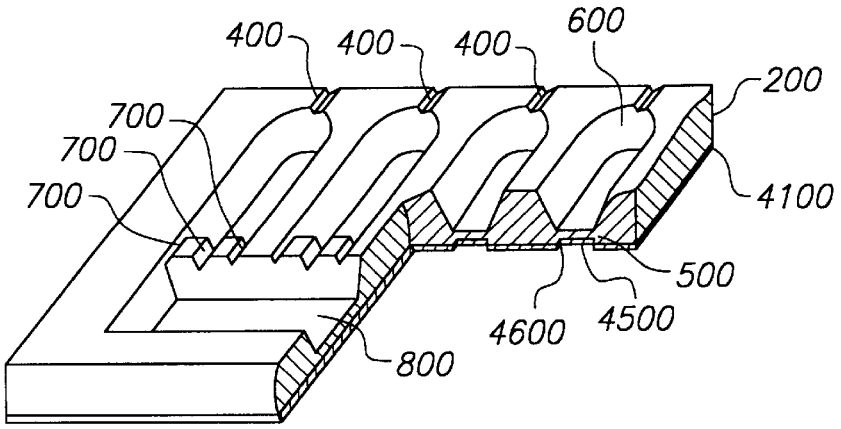
FIG. 28

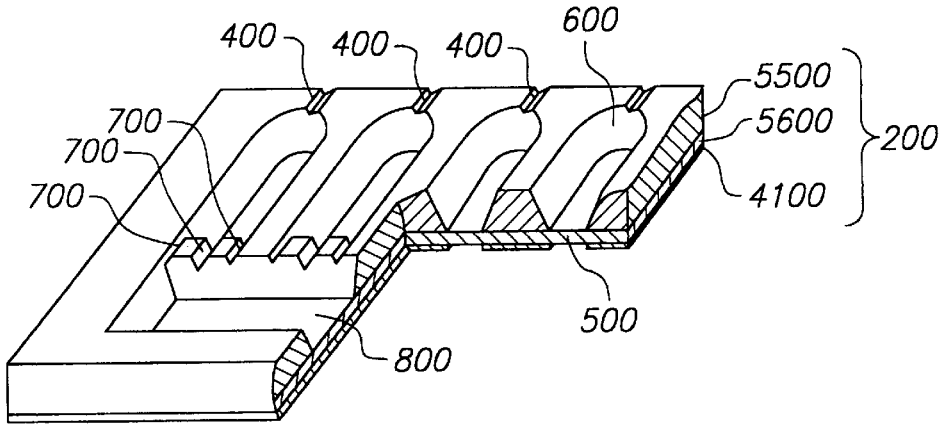
FIG. 32
FIG. 33A
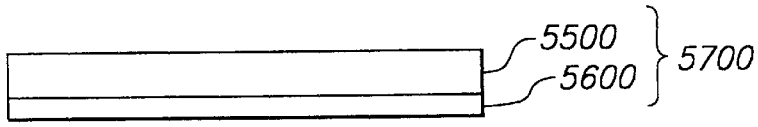
FIG. 33B
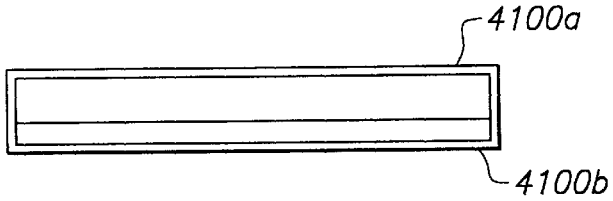
FIG. 33C
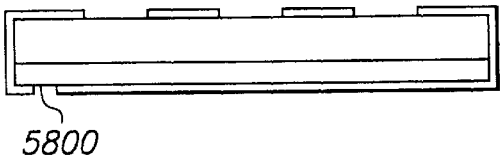
FIG. 33D
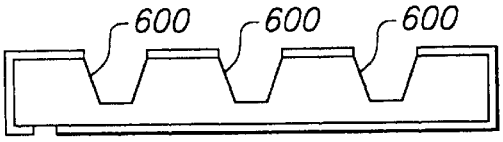
FIG. 33E
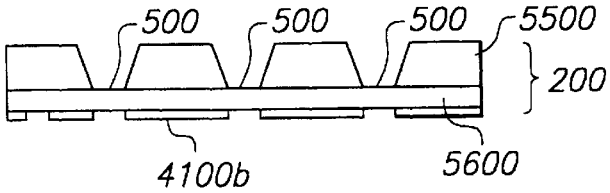

FIG. 36A
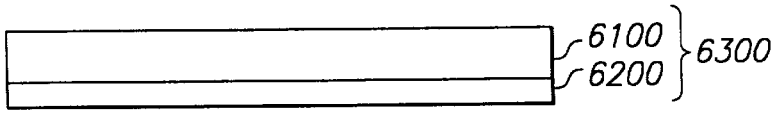
FIG. 36B
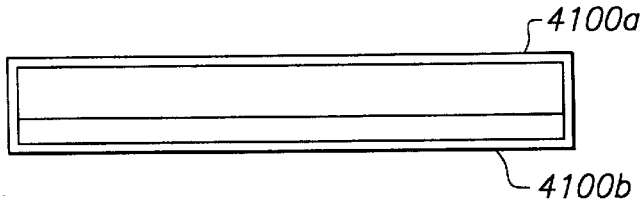
FIG. 36C
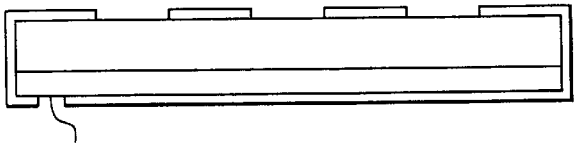
FIG. 36D
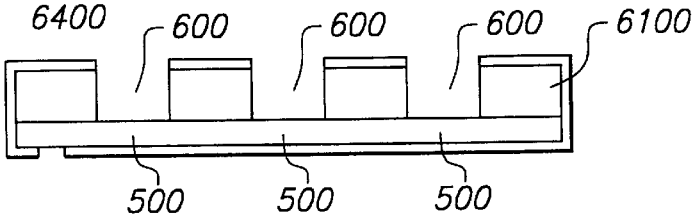
FIG. 36E
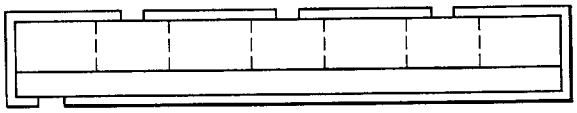
FIG. 36F
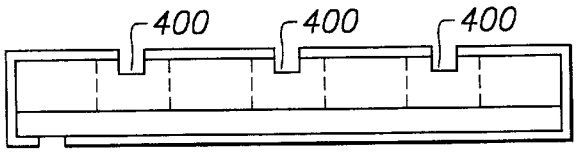
FIG. 36G
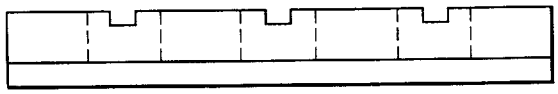
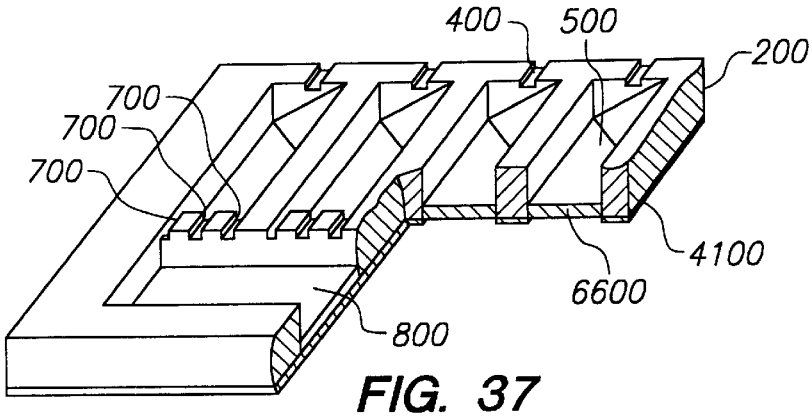
FIG. 37

FIG. 38A
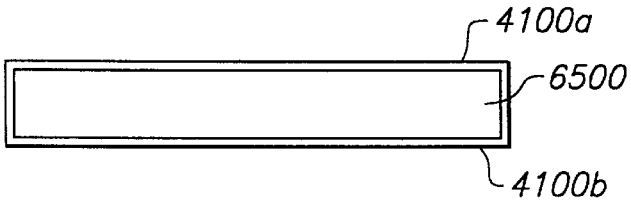
FIG. 38B
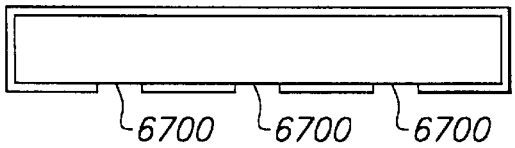
FIG. 38C
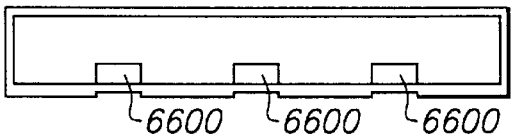
FIG. 38D
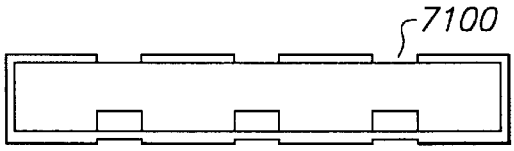
FIG. 38E
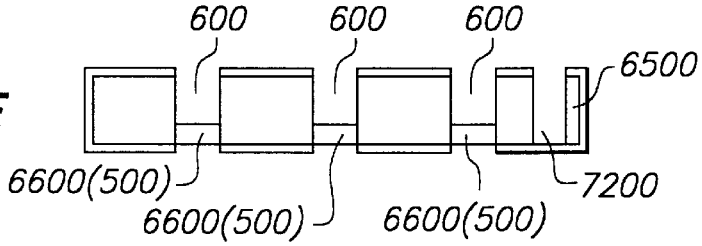
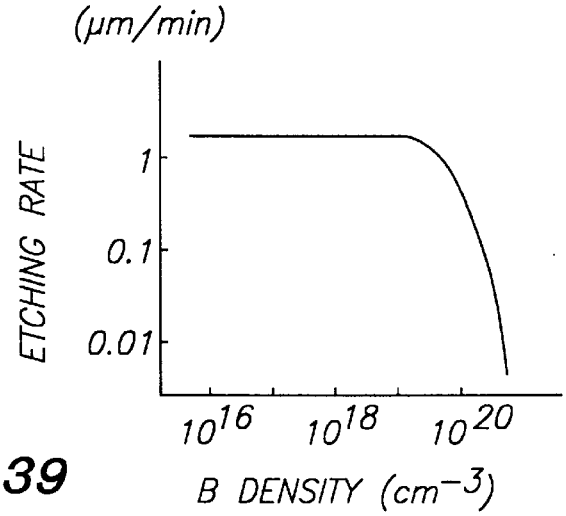
FIG. 39

INK JET RECORDING APPARATUS

This is a Continuation-in-part of prior application Ser. No. 08/795,413 filed on Feb. 3, 1997 now U.S. Pat. No. 5,912,684, which is a continuation-in-part of Ser. No. 08/400,642, filed Mar. 8, 1995, now abandoned, which is a continuation-part of Ser. No. 08/069,198, filed May 28, 1993, now abandoned, which is a continuation-in-part of Ser. No. 08/477,681, filed Jun. 7, 1995, which is a continuation-in-part of Ser. No. 07/757,691, filed Sep. 11, 1991 issued as U.S. Pat. No. 5,534,900 each of which is incorporated herein in its entirety by reference.

BACKGROUND OF THE INVENTION

1. Field of the Invention

The present invention relates to an ink jet head in which an electrostatic actuator is used as a means for generating pressure to eject an ink droplet, and relates more particularly to sealing the electrostatic actuator.

2. Description of the Related Art

One common type of ink jet head uses the electrostatically induced attraction force generated by an electrostatic actuator as described, for example, in Japanese Unexamined Patent Publication (kokai) Hei2-289351. This type of ink jet head has a nozzle, an ink path communicating with a nozzle, a diaphragm formed in part of the ink path, and an electrode formed in opposition to the diaphragm with an air gap therebetween. When an electrical pulse is applied between a diaphragm and electrode, the resulting electrostatic force deforms the diaphragm, causing an ink droplet to be ejected from the nozzle.

In the aforementioned ink jet head, however, the actuator contains a vibration chamber, which comprises a diaphragm and electrode as taught in the above-noted publication, and is exposed to the open air. As a result, dust and other airborne particulate can be pulled in when the actuator is driven. An apparent solution to this problem is sealing the actuator. However, when this is done, the air sealed inside the ejection chamber works as a resistance to the electrostatic attraction of the diaphragm, thus inhibiting normal operation by preventing sufficient electrostatic attraction. When the electrostatic attraction of the vibration chamber drops, pressure sufficient for ink droplet ejection cannot be generated, resulting in a severe drop in print quality and reliability. This problem can be addressed by, for example, increasing the drive voltage applied to the actuator, but it is difficult to generate sufficient electrostatic attraction within the common power supply voltage range generally used with such printers.

OBJECTS OF THE INVENTION

It is therefore an object of the present invention to provide an ink jet head which overcomes the aforementioned problems.

It is another object of the present invention to provide an ink jet recording apparatus whereby sufficient electrostatic attraction can be obtained even with a sealed actuator.

SUMMARY OF THE INVENTION

To meet the above described need, an ink jet recording apparatus for printing to a recording medium by ejecting ink droplets from a nozzle comprises, according to the present invention: a diaphragm for applying pressure to a nozzle for ejecting an ink droplet; a capacitor formed by the diaphragm and an electrode opposing the diaphragm with a specific gap therebetween; a drive circuit for charging and discharging the capacitor to deform a diaphragm by means of electrostatic force and thereby eject an ink droplet from a nozzle; a lead for connecting the drive circuit and electrode; a vibration chamber containing a wall surface formed by the diaphragm and a wall surface to which the electrode is disposed; and a first cavity for communicating with the vibration chamber, and containing the wall surface to which the electrode is disposed; wherein the vibration chamber comprises a second cavity which is sealed airtight, and communicates with the vibration chamber or the first cavity.

The actuator in an ink jet recording apparatus according to the present invention thus has an airtight structure, thereby solving the problem of dust and other airborne particulate being sucked into the ink jet head when the diaphragm is driven.

Furthermore, by providing a second cavity communicating with the vibration chamber or the first cavity, the volume of the airtight sealed part of the actuator is made sufficiently large relative to the volume displaced by the diaphragm when the diaphragm is driven. The pressure rise inside the actuator is therefore small when the actuator is driven, the ejection force required for ink ejection can be sufficiently assured, and an ink jet head achieving outstanding print quality and reliability can be provided.

In an ink jet recording apparatus according to another version of the present invention in which the diaphragm is formed in a first substrate, the electrode is formed in a second substrate which is bonded to the first substrate, and a vibration chamber is formed between the first and second substrates when the second substrate is bonded to the first substrate, a cavity communicating with the vibration chamber and increasing the volume of the airtight sealed part is preferably formed in the first substrate. Because a relatively large volume cavity can be formed with this configuration, the actuator volume can be increased effectively without increasing the size of the ink jet head.

The first substrate is also preferably made of silicon. In this case, the cavity for increasing the volume of the airtight sealed part can be formed simultaneously to diaphragm formation by means of anisotropic etching of silicon. It is therefore also possible to suppress an increase in manufacturing steps and cost.

Yet further preferably, the wall surfaces forming the cavity for increasing the volume of the airtight sealed part are the (111) face of silicon. Using the (111) face where the etching rate is extremely slow enables yet higher precision processing of the cavity, and has the further benefit of enabling yet higher density pattern formation.

Other objects and attainments together with a fuller understanding of the invention will become apparent and appreciated, by referring to the following description and claims taken in conjunction with the accompanying drawings.

BRIEF DESCRIPTION OF THE DRAWINGS

In the drawings, wherein like reference symbols refer to like parts:

These and other objects and features of the present invention will be readily understood from the following detailed description taken in conjunction with preferred embodiments thereof with reference to the accompanying drawings, in which like parts are designated by like reference numerals and in which:

FIG. 24 is an enlarged perspective view of a part of the thirteenth embodiment of the present invention.

FIGS. 25A to 25E show a manufacturing step diagram of the middle substrate according to the thirteenth embodiment.

FIG. 26 illustrates diaphragm measurements according to the thirteenth embodiment of the present invention.

FIGS. 27A to 27D show a manufacturing step diagram of the lower substrate of the thirteenth embodiment.

FIG. 28 is a perspective view of the middle substrate of the thirteenth embodiment of the ink-jet head according to the present invention.

FIG. 32 is a perspective view of the middle substrate of the ink-jet head according to the sixteenth embodiment of the present invention.

FIGS. 33A to 33E show a manufacturing step diagram of the middle substrate according to the sixteenth embodiment of the present invention.

FIGS. 36A to 36G show a manufacturing step diagram of the middle substrate of the seventeenth embodiment.

FIG. 37 is a perspective view of the middle substrate of the ink-jet head according to the eighteenth embodiment of the present invention.

FIGS. 38A to 38E show a manufacturing step diagram of the middle substrate according to the eighteenth embodiment of the present invention.

FIG. 39 is a relationship view of boron density and etching rate at an alkali anisotropic etching process according to the present invention.

KEY TO THE FIGURES (FIGS. 59–66)

10000 middle substrate
20000 lower substrate
50000 diaphragm
60000 ejection chamber
90000 vibration chamber
300000 dielectric sealing agent
400000 air chamber

DESCRIPTION OF THE PREFERRED EMBODIMENTS

Embodiment 1

Figure 1:
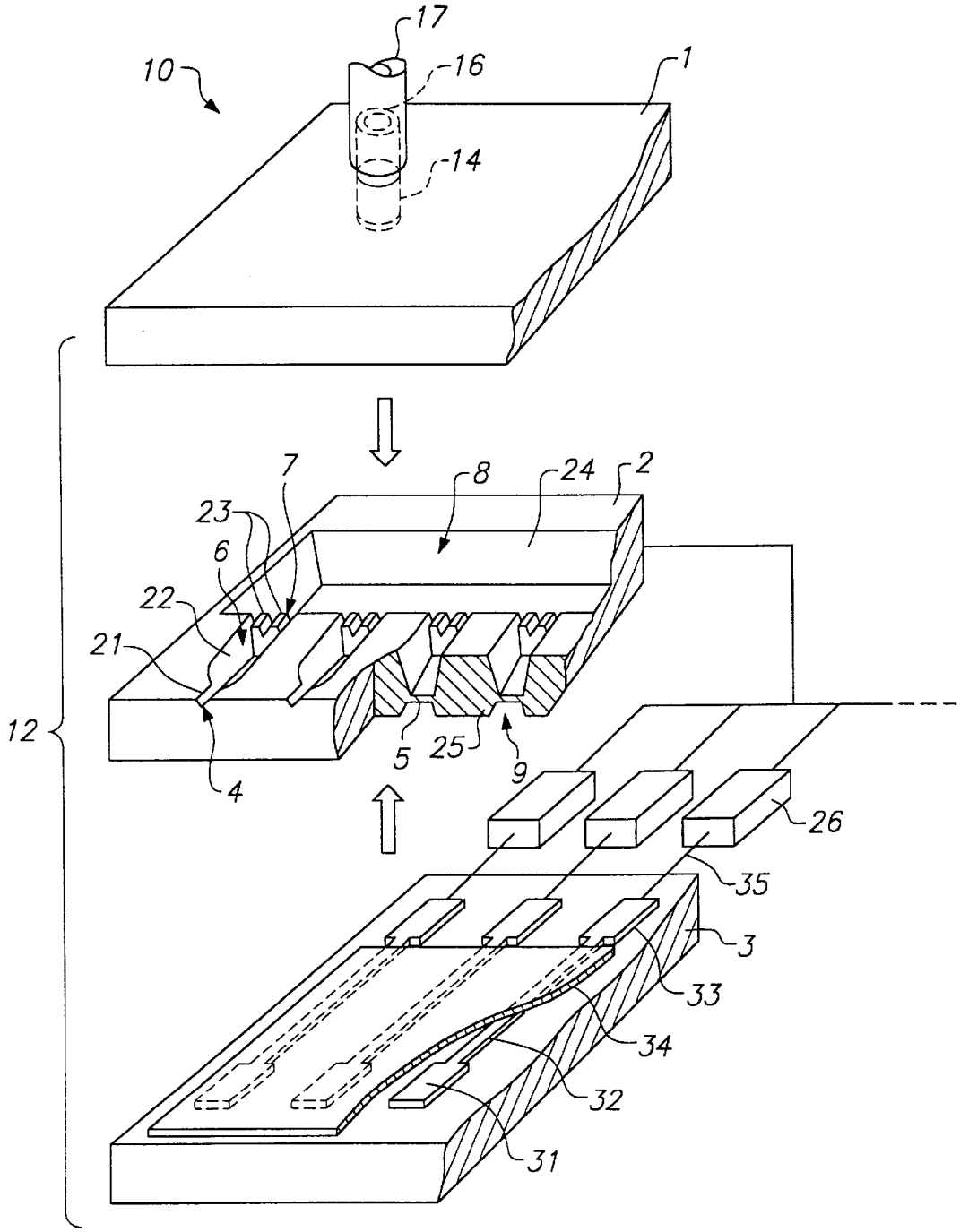
FIG. 1 is an exploded perspective view partly in section, showing main parts of a first embodiment of the present invention.
Figure 3:
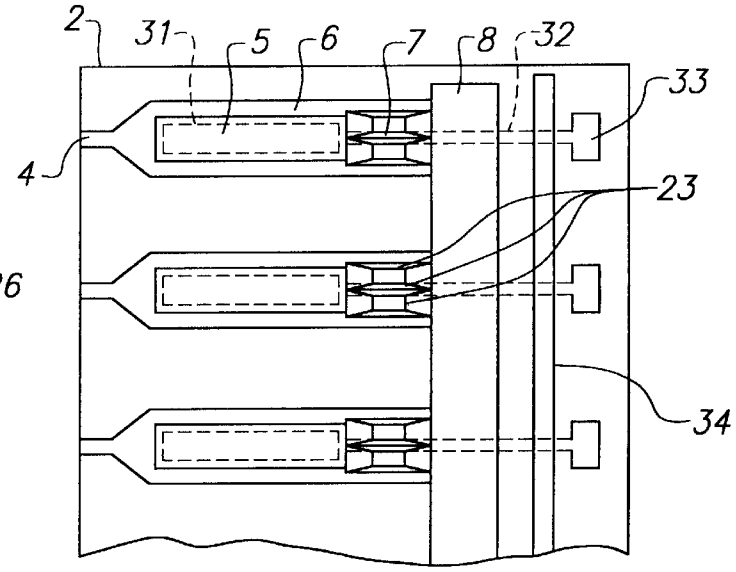
FIG. 3 is a view taken on line A—A of FIG. 2.
Figure 2:
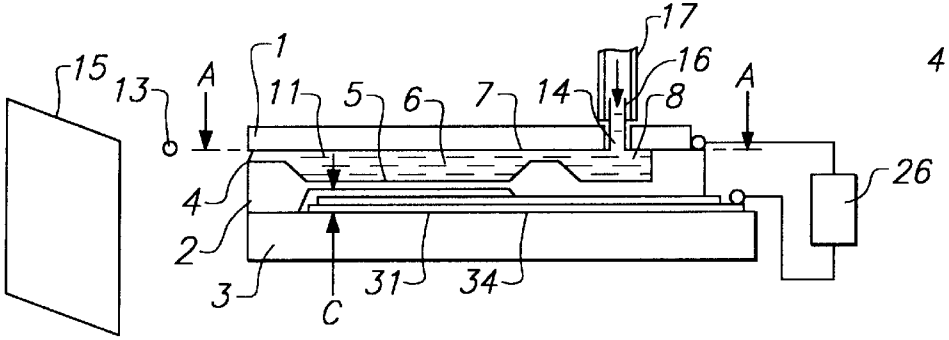
FIG. 2 is a sectional side view of the first embodiment of FIG. 1 after assembly.
Figure 4A:
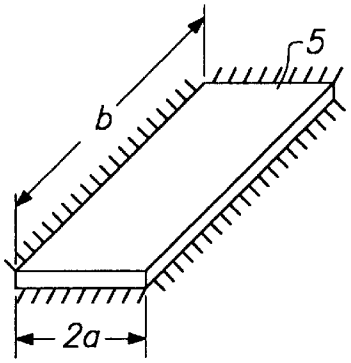

FIG. 1 is a partly exploded perspective view partly in section, of an ink-jet recording apparatus according to a first embodiment of the present invention. The illustrated embodiment relates to an edge ink-jet type apparatus in which ink drops are ejected from nozzle openings formed in an end portion of a substrate. FIG. 2 is a sectional side view of the whole apparatus after assembly. FIG. 3 is a view taken on line A—A of FIG. 2.

As shown in the drawings an ink-jet head 12 as a main portion of an ink-jet recording apparatus 10 has a lamination structure in which three substrates 1, 2 and 3 are stuck to one another as will be described hereunder.

An intermediate or middle substrate 2 such as a silicon substrate has: a plurality of nozzle grooves 21 arranged at equal intervals on a surface of the substrate and extending in parallel to each other from an end thereof to form nozzle openings; concave portions 22 respectively communicated with the nozzle grooves 21 to form ejection chambers 6 respectively having bottom walls serving as diaphragms 5; fine grooves 23 respectively provided in the rear of the concave portions 22 and serving as ink inlets to form orifices 7; and a concave portion 24 to form a common ink cavity 8 for supplying in to the respective ejection chambers 6. Further, concave portions 25 are respectively provided under the diaphragms 5 to form vibration chambers 9 so as to mount electrodes as will be described later. The nozzle grooves 21 are arranged at intervals of the pitch of about 2 mm. The width of each nozzle groove 21 is selected to be about 40 μm. For example, the upper substrate 200 stuck onto the upper surface the intermediate substrate 2 is made by glass or resin. The nozzle openings 4, the ejection chambers 6, the orifices 7 and the ink cavity 8 are formed by bonding the upper substrate 200 on the intermediate substrate 2. An ink supply port 14 communicated with the ink cavity 8 is formed in the upper substrate 200. The ink supply port 14 is connected to an ink tank (not shown), through a connection pipe 14 and a tube 17.

For example, the lower substrate 3 to be bonded on the lower surface of the intermediate substrate 2 is made by glass or resin. The vibration chambers 9 are formed by bonding the lower substrate 3 on the intermediate substrate 2. At the same time, electrodes are formed on a surface of the lower substrate 3 and in positions corresponding to the respective diaphragms 5. Each of the electrodes 31 has a lead portion 32 and a terminal portion 33. The electrodes 31 and the lead portions 32 except the terminal portions 33 are covered with an insulating film 34. The terminal portions 33 are respectively correspondingly bonded to lead wires 35.

The substrates 1, 2 and 3 are assembled to constitute an ink-jet head 12 as shown in FIG. 2. Further, oscillation circuits 26 are respectively correspondingly connected between the terminal portions 33 of the electrodes 31 and the intermediate substrate 2 to thereby constitute the ink-jet recording apparatus 10 having a lamination structure according to the present invention. Ink 11 is supplied from the ink tank (not shown) to the inside of the intermediate substrate 2 through the ink supply port 14, so that the ink cavity 8, the ejection chambers 6 and the like are filled with the ink. The distance c between the electrode 31 and the corresponding diaphragm 5 is kept to be about 1 μm. In FIG. 2, the reference numeral 13 designates an ink drop ejected designates from the nozzle opening 4, and 15 designates recording paper. The ink used is prepared by dissolving/dispersing a surface active agent such as ethylene glycol and a dye (or a pigment) into a main solvent such as water, alcohol, toluene, etc. Alternatively, hot-melt ink may be used if a heater or the like is provided in this apparatus.

In the following, the operation of this embodiment 15 is described. For example, a positive pulse voltage generated by one of the oscillation circuits 26 is applied to the corresponding electrode 31. When the surface of the electrode 31 is charged with electricity to a positive potential, the lower surface of the corresponding diaphragm 5 is charged with electricity to a negative potential. Accordingly, the diaphragm 5 is distorted downward by the action of the electrostatic attraction. When the electrode 31 is then made off, the diaphragm 5 is restored. Accordingly, the pressure in the ejection chamber 6 increases rapidly, so that the ink drop 13 is ejected from the nozzle opening 4 onto the recording paper 15. Further, the ink 11 is supplied from the ink cavity 8 to the ejection chamber 6 through the orifice 7 by the downward distortion of the diaphragm 5. As the oscillation circuit 26, a circuit for alternately generating a zero voltage and a positive voltage, an AC electric source, or the like, may be used. Recording can be made by controlling the electric pulses to be applied to the electrodes 31 of the respective nozzle openings 4.

Here, the quantity of displacement, the driving voltage and the quantity of ejection of the diaphragm 5 are calculated in the case where the diaphragm 5 is driven as described above.

The diaphragm 5 is shaped like a rectangle with short side length 2*a* and long side length b. The four sides of the rectangle are supported by surrounding walls. When the aspect ratio (b/2a) is large, the coefficient approaches to 0.5, and the quantity of displacement of the thin plate (diaphragm) subjected to pressure P can be expressed by the following formula because the quantity of displacement depends on a.

$$w=0.5\times Pa^4/Eh^3 \quad (1)$$

In the formula, w: the quantity of displacement (m)

p: pressure ($N/m^2$)

a: a half length(m) of the short side h: the thickness k(m) of the plate (diaphragm)

E: Young's modulus ($N/m^2$, silicon $11\times10^{10}$ $N/m^2$)

The pressure of attraction by electrostatic force can be expressed by the following formula.

$$P=\tfrac{1}{2}\times\epsilon\times(V/t)^2$$

In the formula, $\epsilon$: the dielectric constant (F/m, the dielectric constant in vacuum: $8.8\times10^{-12}$ F/m)

V: the voltage (V)

t: the distance (m) between the diaphragm and the electrode

Accordingly, the driving voltage V required for acquiring necessary ejection pressure can be expressed by the following formula.

$$V=t(2P/c)^{1/2} \quad (2)$$

Figure 4B:
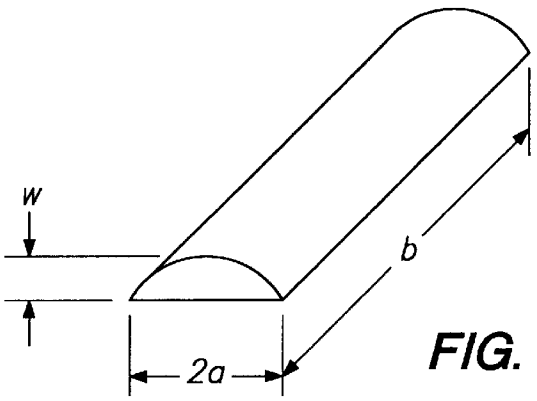
FIGS. 4A and 4B show explanatory views concerning the design of a diaphragm, FIG. 4A being an explanatory view showing the size of a rectangular diaphragm, FIG. 4B being an explanatory view for calculating ejection pressure and ejection quantity.

In the following, the volume of a semi-cylindrical shape as shown in FIG. 4B is calculated to thereby calculate the quantity of ejection.

The following formula can be obtained because the equation $\Delta w=\tfrac{4}{3}\times abw$ is valid.

$$w=\tfrac{3}{4}\times\Delta w/ab \quad (3)$$

When the formula (3) is substituted into the equation $P=2w\times Eh^3/a^4$ obtained by rearranging the formula (1), the following formula (4) can be obtained.

$$P=\tfrac{3}{2}\times\Delta Eh^3/a^5b \quad (4)$$

When the formula (4) is substituted into the formula (2), the following formula can be obtained.

$$V=t\times(3Eh^3\ \Delta w/\epsilon b)^{1/2}\times(1/a^5)^{1/2} \quad (5)$$

That is, the driving voltage required for acquiring the quantity of ejection of ink is expressed by the formula (5).

Figure 5A:
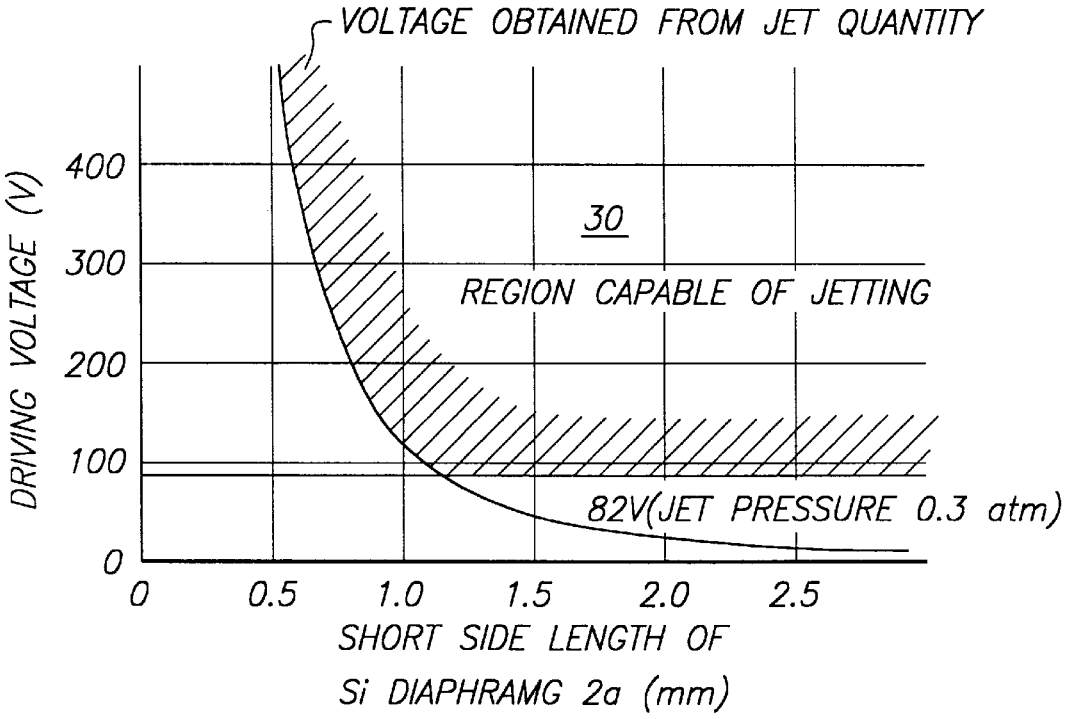
FIG. 5A is a graph showing the relationship between the length of the short side of the diaphragm and the driving voltage.
Figure 5B:
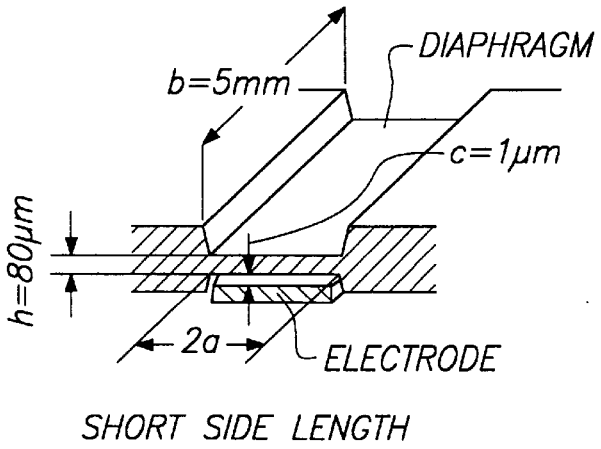
FIG. 5B illustrates, in detail, the diaphragm structure of the first embodiment.

The allowable region of ink ejection as shown in FIG. 5A can be calculated on the basis of the formulae (2) and (5). FIG. 5A shows the relationship between the short side length 2a(mm) and the driving voltage (V) in the case where the long side length b of the silicon diaphragm, the thickness h thereof and the distance c between the diaphragm and the electrode are selected to be 5 mm, 80 $\mu$m and 1 $\mu$m respectively. The ejection allowable region 30 is shown by the oblique lines in FIG. 5A when the jet (ejection) pressure P is 0.3 atm.

Although it is more advantageous for the diaphragm to make the size of the diaphragm larger, the appropriate width of the nozzle in the direction of the pitch is within a range of from about 0.5 mm to about 4.0 mm in order to make the nozzle small in size and high in density.

The length of the diaphragm is determined according to the formula (4) on the basis of the quantity of ejection of ink as a target, the Young's modulus of the silicon substrate, the ejection pressure thereof and the thickness thereof.

When the width is selected to be about 2 mm, it is necessary to select the thickness of the diaphragm to be about 50 $\mu$m or more on the consideration of the ejection rate. If the diaphragm is drastically thicker than the above value, the driving voltage increases abnormally as obvious from the formula (5). If the diaphragm is too thin, the ink-jet ejection frequency cannot be obtained. That is, a large lag occurs in the frequency of the diaphragm relative to the applied pulses for ink jetting.

After the ink-jet head 12 in this embodiment was assembled into a printer, ink drops were flown in the rate of 7 m/sec by applying a voltage of 150 V with 5 kHz. When printing was tried at a rate of 300 dpi, a good result of printing was obtained.

Though not shown, the rear wall of the ejection chamber may be used as a diaphragm. The head itself, however, can be more thinned by using the bottom wall of the ejection chamber 6 as a diaphragm as shown in this embodiment.

Embodiment 2

Figure 6:
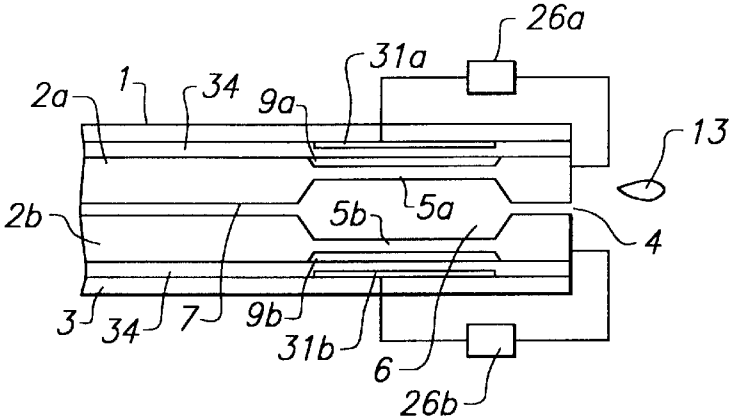
FIG. 6 is a sectional view of a second embodiment of the present invention.

FIG. 6 is a sectional view of a second embodiment of the present invention showing an edge ink-jet type apparatus similarly to the first embodiment.

In this embodiment, the upper and lower walls of the ejection chamber 6 are used as diaphragms 5*a* and 5*b*. Therefore, two intermediate substrates 2*a* and 2*b* are used and stuck to each other through the ejection chamber 6. The diaphragms 5*a* and 5*b* and vibration chambers 9*a* and 9*b* are respectively formed in the substrates 2*a* and 2*b*. The substrates 2*a* and 2*b* are arranged symmetrically with respect to a horizontal plane so that the diaphragms 5*a* and 5*b* form the upper and lower walls of the ejection chamber 6. The nozzle opening 4 is formed in an edge junction surface between the two substrates 2*a* and 2*b*. Further, electrodes 31*a* and 31*b* are respectively provided on the lower surface of the upper substrate 200 and on the upper surface of the lower substrate 3 and respectively mounted into the vibration chambers 9*a* and 9*b*. Oscillation circuits 26*a* and 26*b* connected respectively between the electrode 31*a* and the intermediate substrate 2*a* and between the electrode 31*b* and the intermediate substrate 2*b*.

In this embodiment, the diaphragms 5*a* and 5*b* can be driven by a lower voltage because an ink drop 13 can be ejected from the nozzle opening 4 by symmetrically vibrating the upper and lower diaphragms 5*a* and 5*b* of 5 the ejection chamber 6 through the electrodes 31*a* and 31*b*. The pressure in the ejection chamber 6 is increased by the diaphragms 5*a* and 5*b* vibrating symmetrically with respect to a horizontal plane, so that the printing speed is improved.

Embodiment 3

The following embodiments describe an ink-jet type apparatus in which ink drops are ejected from nozzle openings provided in a surface of a substrate. The object of the embodiments is to drive diaphragms by a lower voltage. The embodiments can be applied to the aforementioned edge ink jet type apparatus.

Figure 7:
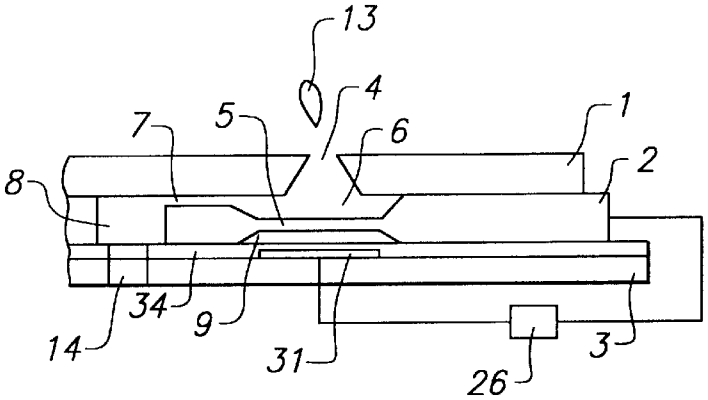
FIG. 7 is a sectional view of a third embodiment of the present invention.

FIG. 7 shows a third embodiment of the present invention in which each circular nozzle opening 4 is formed in an upper substrate 200 just above an ejection chamber 6. The bottom wall of the ejection chamber 6 is used as a diaphragm 5. The diaphragm 5 is formed on an intermediate substrate 2. Further, an electrode 31 is formed on a lower substrate 3 and in a vibration chamber 9 under the diaphragm 5. An ink supply port 14 is provided in the lower substrate 3.

In this embodiment, an ink drop 13 is ejected from the nozzle opening 4 provided in the upper substrate, through the vibration of the diaphragm 5. Accordingly, a large number of nozzle openings 4 can be provided in one head, so that high-density recording can be made.

Embodiment 4

Figure 9B:
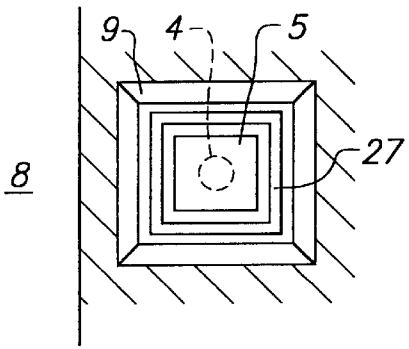
FIGS. 9A and 9B are views taken on line B—B of FIG. 8 and illustrate the case where bellows grooves are formed on the two opposite sides of the diaphragm and the case where bellows grooves are formed on all the four sides of the diaphragm.
Figure 9A:
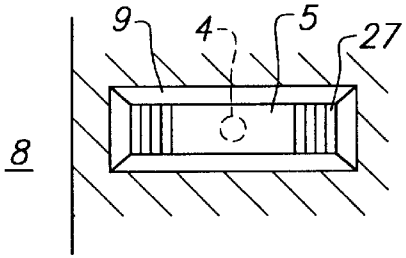
Figure 8:
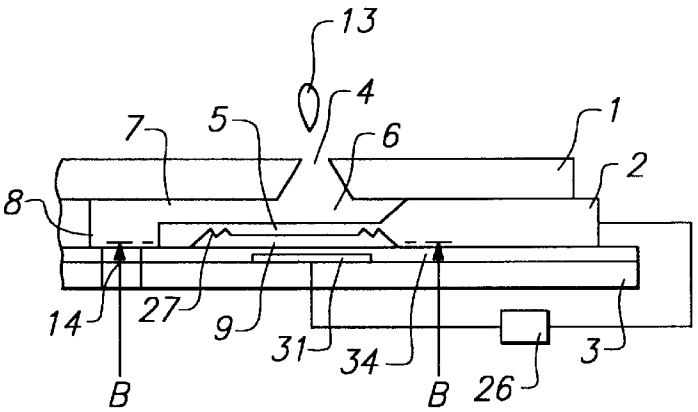
FIG. 8 is a sectional view of a fourth embodiment of the present invention.

In this embodiment, as shown in FIGS. 8, 9A and 9B, each diaphragm 5 is supported by at least one bellows-shaped groove 27 provided on the two opposite sides (see FIG. 9A) or four sides (see FIG. 9B) of a rectangular diaphragm 5 to thereby make it possible to increase the quantity of displacement of the diaphragm 5. Ink in the ejection chamber 6 can be pressed by a surface of the diaphragm 5 perpendicular to the direction of ejection of ink, so that the ink drop 13 can be flown straight.

Embodiment 5

Figure 10:
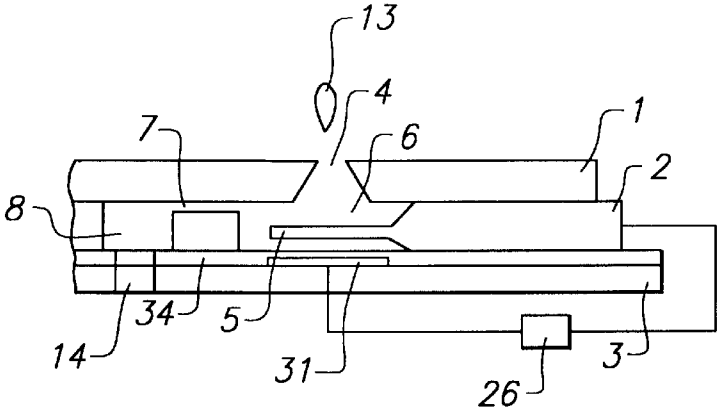
FIG. 10 is a sectional view of a fifth embodiment of the present invention.

In this embodiment, shown in FIG. 10, the rectangular diaphragm 5 is formed as a cantilever type diaphragm supported by one short side thereof. By making the diaphragm 5 be of the cantilever type, the quantity of displacement of the diaphragm 5 can be increased without making the driving voltage high. Because the ejection chamber 6 becomes communicated with the vibration chamber, however, it is necessary that insulating ink is used as the ink 11 to secure electrical insulation of the ink from the electrode 31.

Embodiment 6

Figure 11:
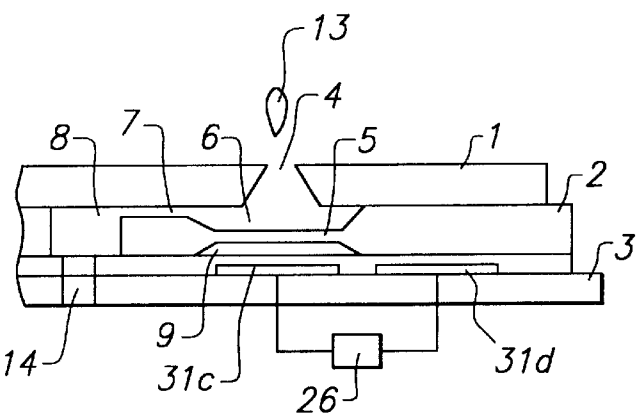
FIG. 11 is a sectional view of a sixth embodiment of the present invention.

In this embodiment, two electrodes 31*c* and 31*d* are 5 provided for each diaphragm 5 as shown in FIG. 11 so that the two electrodes 31*c* and 31*d* drive the diaphragm 5.

In this embodiment, the first electrode 31*c* is arranged inside a vibration chamber 9, and, on the other hand, the second electrode 31*d* is arranged outside the vibration chamber 9 and under an intermediate substrate 2. An oscillation circuit 26 is connected between the two electrodes 31*c* and 31*d*, and an alternating pulse signal to the electrodes 31*c* and 31*d* is repeated to 15 to thereby drive the diaphragm 5.

According to this structure, the driving portion is electrically independent because the silicon substrate 2 is not used as a common electrode unlike the previous embodiment. Accordingly, ejection of ink from an unexpected nozzle opening can be prevented when a nozzle head adjacent thereto is driven. Further, in the case of using a high resistance silicon substrate, or in the case where a high resistance layer is formed, though not shown in FIG. 11, on the surface of the silicon substrate 2, pulse voltages opposite to each other in polarity may be alternately applied to the two electrodes 31*c* and 31*d* to thereby drive the diaphragm 5. In this case, not only electrostatic attraction as described above but repulsion act on the diaphragm 5. Accordingly, ejection pressure can be increased by a lower voltage.

Embodiment 7

Figure 12:
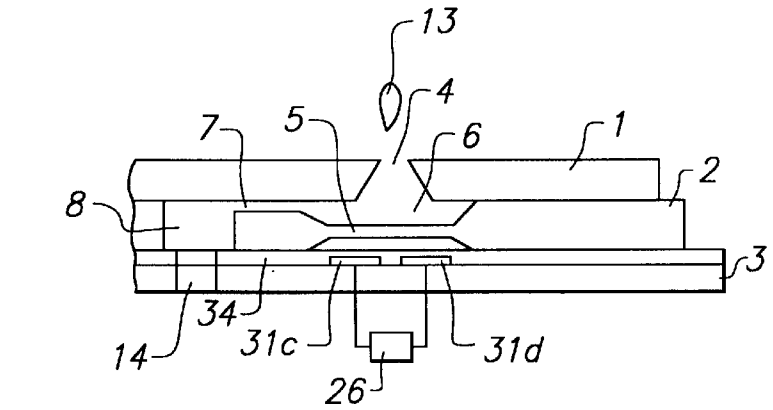
FIG. 12 is a sectional view of a seventh embodiment of the present invention.

In this embodiment, as shown in FIG. 12, both of the electrode 31*c* and 31*d* are arranged inside the vibration chamber 9 so that the diaphragm 5 is driven by surface polarization of silicon. That is, in the same manner as in the embodiment of FIG. 11, an alternating pulse signals is applied to the electrodes 31*c* and 31*d* repeatedly to thereby drive the diaphragm 5. Further, in the same manner as in the Embodiment 6, in the case of using a high resistance silicon substrate, or in the case where a high resistance layer is formed, though not shown in FIG. 12, on the surface of the silicon substrate 2, pulse voltages opposite to each other in polarity may be alternately applied to the two electrodes 31*c* and 31*d* to thereby drive the diaphragm 5. This embodiment is however different from the embodiment of FIG. 11 in that there is no projection of the electrodes between the intermediate substrate 2 and the lower substrate 3. Accordingly, in this embodiment, the two substrates can be bonded with each other easily.

Embodiment 8

Figure 13:
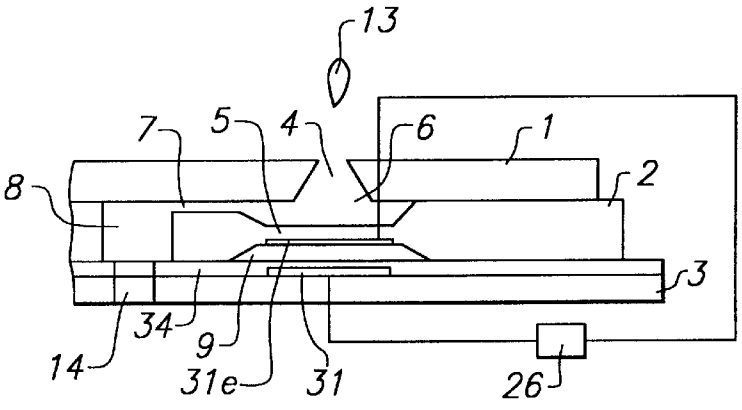
FIG. 13 is a sectional view of an eighth embodiment of the present invention.

In this embodiment, as shown in FIG. 13, a metal electrode 31*e* is provided on the lower surface of the diaphragm 5 so as to be opposite to the electrode 31. Because electric charge is not supplied to the diaphragm 5 through the silicon substrate 2 but supplied to the metal electrode 31*e* formed on the diaphragm 5 through metal patterned lines, the charge supply rate can be increased to thereby make high-frequency driving possible.

Embodiment 9

Figure 14:
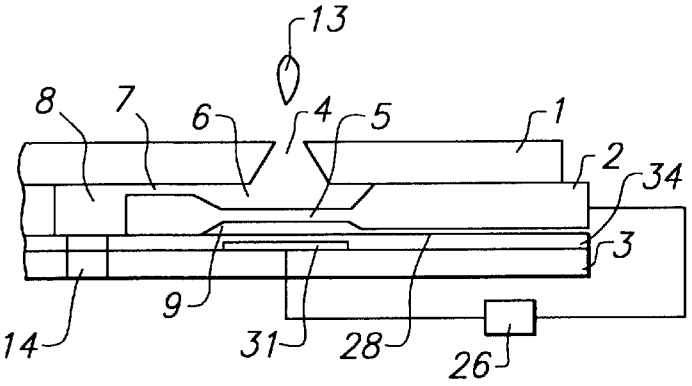
FIG. 14 is a sectional view of a ninth embodiment of the present invention.

In this embodiment, as shown in FIG. 14, an air vent or passage 28 is provided to well vent air in the vibration chamber 9. Because the diaphragm 5 cannot be vibrated easily when the vibration chamber 9 just under the diaphragm 5 is high in air tightness, the air vent 28 is provided between the intermediate substrate 2 and the lower substrate 3 in order to release the pressure in the vibration chamber 9.

Embodiment 10

Figure 15:
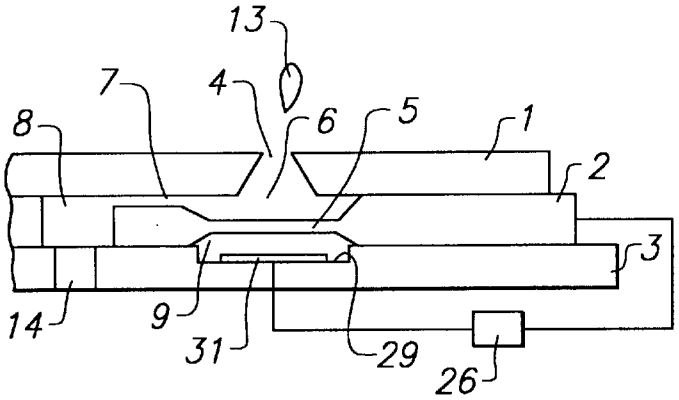
FIG. 15 is a sectional view of a tenth embodiment of the present invention.

In this embodiment, as shown in FIG. 15, the electrode 31 for driving the diaphragm 5 is formed in a concave portion 29 provided in the lower substrate 3. The short circuit of electrodes caused by the vibration of the diaphragm 5 can be prevented without providing any insulating film for the electrode 31.

In the following, an embodiment of a method for producing the aforementioned ink-jet head 12 is 5 described. Description will be made with respect to the structure of FIG. 1 as the central subject. The nozzle grooves 4, the diaphragm 5, the ejection chambers 6, the orifices 7, the ink cavity 8, the vibration chambers 9, etc., are formed in the 10 intermediate substrate (which is also called the "nozzle or middle substrate") 2 through the following steps.

Figure 16A:
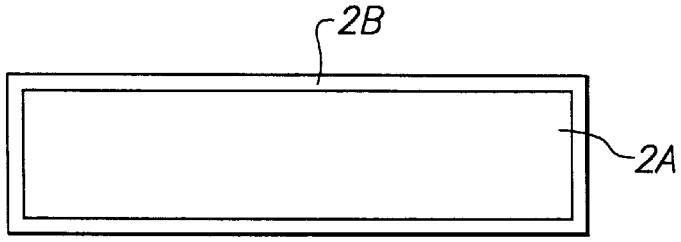
FIGS. 16A through F illustrate the steps of producing the nozzle substrate according to embodiments one through ten of the present invention.

(1) Silicon Thermally Oxidizing Step (Diagram of FIG. 16A)

A silicon monocrystal substrate 2A of face orientation (100) was used. Both the opposite surfaces of the substrate 2A were polished to a thickness of 280 $\mu$m. Silicon was thermally oxidized by heating the Si substrate 2A in the air at 1100° C. for an hour to thereby form a 1 $\mu$m-thick oxide film 2B of $SiO_2$ on the whole surface thereof.

Figure 16B:
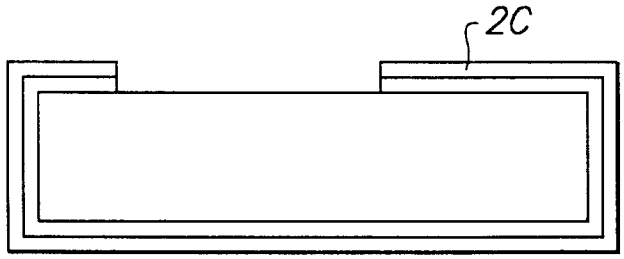
Figure 16C:
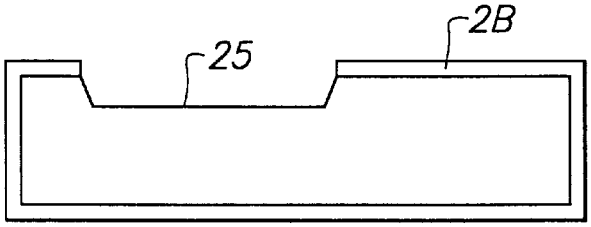

(2) Patterning Step (Diagram of FIG. 16B)

A resist pattern 2C was formed through the steps of: successively coating the two surfaces of the Si substrate 2A with a resist (OMR-83 made by TOKYO OHKA) by a spin coating method to form a resist film having a thickness of about 1 $\mu$m; and making the resist film subject to exposure and development to form a predetermined pattern. The pattern determining the form of the diaphragm 5 was a rectangle with a width of 1 mm and with a length of 5 mm. In the embodiment of FIG. 7, the form of the diaphragm was a square having an each side length of 5 mm.

Then, the $SiO_2$ film 2B was etched under the following etching condition as shown in the drawing. While a mixture solution containing six parts by volume of 40 wt % ammonium fluoride solution to one of 50 wt % hydrofluoric acid was kept at 20° C., the aforementioned substrate was immersed in the mixture solution for 10 minutes.

(3) Etching Step (Diagram of FIG. 16)

The resist 2C was separated under the following etching condition. While a mixture solution containing four parts by volume of 98 wt % sulfuric acid to one of 30 wt % hydrogen peroxide was heated to 900c or higher, the substrate was immersed in the mixture solution for 20 minutes to separate the resist 2C. Then, the Si substrate 2A was immersed in a solution of 20 wt $\%_0$, KOH at 80° C. for a minute to perform etching by a depth of 1 $\mu$m. A concave portion 25 constituting a vibration chamber 9 was formed by the etching.

Figure 16D:
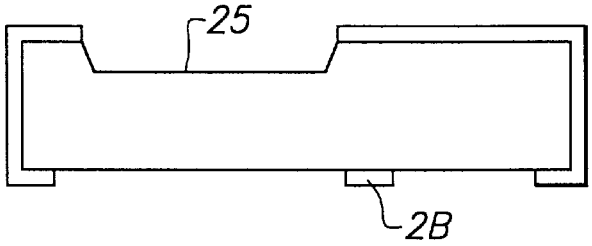

(4) Opposite Surface Patterning Step (Diagram of FIG. 16D)

The SiO2 film remaining in the Si substrate 2A was completely etched in the same condition as in the step (2). Then, a 1 $\mu$m-thick $SiO_2$ film was formed over the whole surface of the Si substrate 2A by thermal oxidization through the same process as shown in the steps (1) and (2). Then, the $SiO_2$ film 2B on the opposite surface (the lower surface in the drawing) of the Si substrate 2A was etched into a predetermined pattern through a photo-lithography process. The pattern determined the form of the ejection chamber 6 and the form of the ink cavity 8.

Figure 16E:
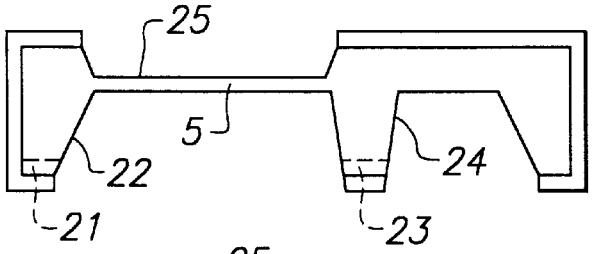

(5) Etching Step (Diagram of FIG. 16E)

The Si substrate 2A was etched by using the $SiO_2$ film as a resist through the same process in the step (3) to thereby form concave portions 22 and 24 for the ejection chamber 6 and the ink cavity 8. At the same time, a groove 21 for the nozzle opening 4 and the groove 23 of an orifice 7 were formed. The thickness of the diaphragm 5 was 100 $\mu$m.

In respect to the nozzle groove and the orifice groove, the etching rate in the KOH solution became very slow when the (111) face of the Si substrate appeared in the direction of etching. Accordingly, the etching progressed no more, so that the etching was stopped with the shallow depth. When, for example, the width of the nozzle groove is 40 $\mu$m, the etching is stopped with the depth of about 28 $\mu$m. In the case of 5 the ejection chamber or the ink cavity, it can be formed sufficiently deeply because the width is sufficiently larger than the etching depth. That is, portions different in depth can be formed at once by an etching process.

Figure 16F:
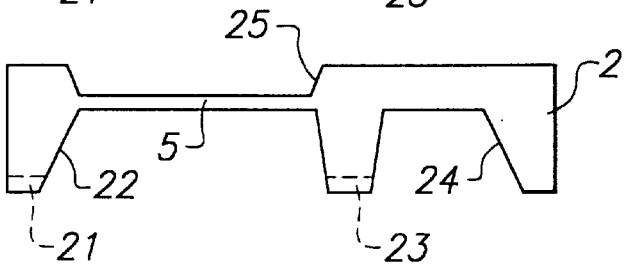

(6) $SiO_2$ Film Removing Step (Diagram of FIG. 16F)

Finally, a nozzle substrate having parts 21, 22, 23, 24, 25 and 5, or in other words, an intermediate substrate 2, was prepared by removing the remaining $SiO_2$ film by etching.

In the embodiment of FIG. 7, an intermediate substrate having the aforementioned parts 22, 23, 24, 25 and 5 except the nozzle grooves 21 and a nozzle substrate (upper substrate 200) having nozzle openings 4 with the diameter 50 $\mu$m on a 280 $\mu$m-thick Si substrate were prepared in the same process as described above.

In the following, a method for forming an electrode substrate (lower substrate 3) is described with reference to FIG. 17

Figure 17A:
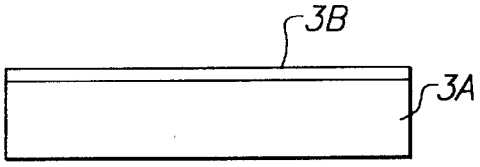
FIGS. 17A through C illustrate the steps of producing the electrode substrate according to embodiments one through ten of the present invention.

(1) Metal Film Forming Step (Diagram of FIG. 17A)

A 1000 Å thick Ni film 3B was formed on a surface of a 0.7 mm-thick Pyrex glass substrate 3 Å by a spattering method.

Figure 17B:
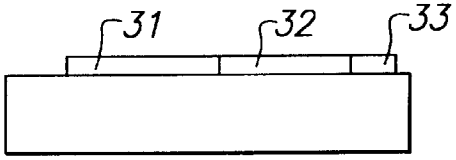

(2) Electrode Forming Step (Diagram of FIG. 17B)

The Ni film 3B was formed into a predetermined pattern by a photo-lithographic etching technique. Thus, the electrodes 31, the lead portions 32 and the terminal portions 33 were formed.

Figure 17C:
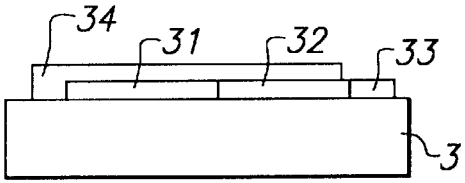

(3) Insulating Film Forming Step (Diagram of FIG. 17C)

Finally, the electrodes 31 and the lead portions 32 (see FIG. 1) except the terminal portions 33 were completely coated with an $SiO_2$ film as an insulating film by a mask sputtering method to form a film thickness of about 1 urn to thereby prepare the electrode substrate 3.

The nozzle substrate 2 and the electrode substrate 3 prepared as described above were stuck to each other through anodic bonding. That is after the Si substrate 2 and the glass substrate 3 were put on each other, the substrates were put on a hot plate. While the substrates were heated at 300° C., a DC voltage of 500V was applied to the substrates for 5 minutes with the Si substrate side used as an anode and with the glass substrate side used as a cathode to thereby stick the substrates to each other. Then, the glass substrate (upper substrate 200) having the ink supply port 14 formed therein was stuck onto the Si substrate 2 through the same anodic treatment.

In the embodiment of FIG. 7, the nozzle substrate 200 and the Si substrate 2 were bonded to each other through thermal compression.

The ink-jet heads 12 respectively shown in FIGS. 2 and 7 were produced through the aforementioned process.

Embodiment 11

Figure 18A:
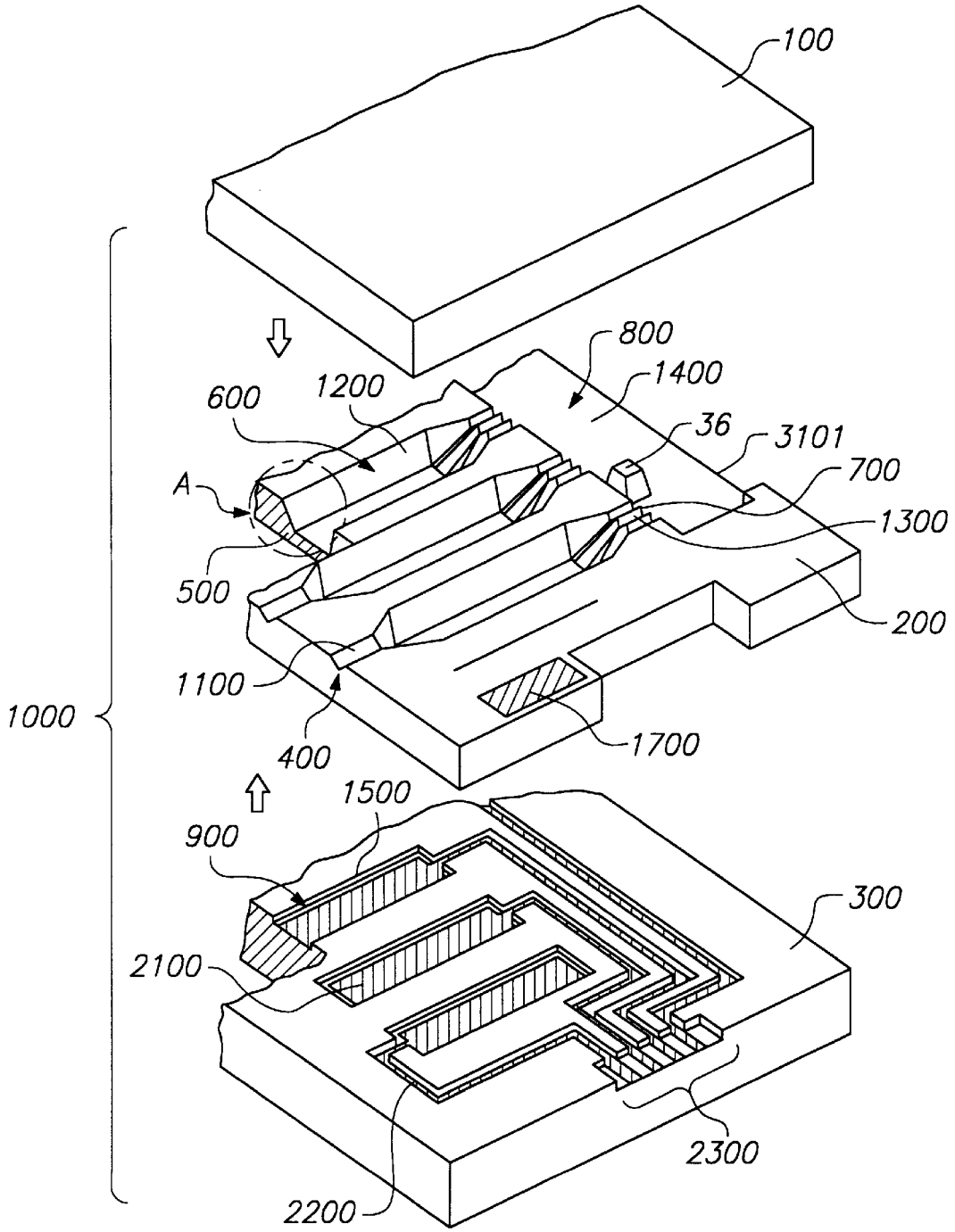
FIGS. 18A–18D illustrate the eleventh embodiment of the present invention.

FIG. 18A is an exploded perspective view of the eleventh embodiment, illustrating the presently preferred ink jet head of the present invention.

Figure 18B:
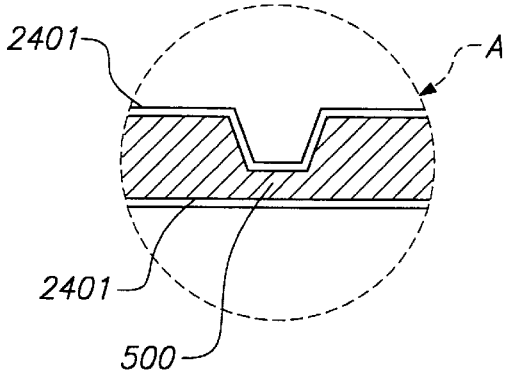
Figure 18C:
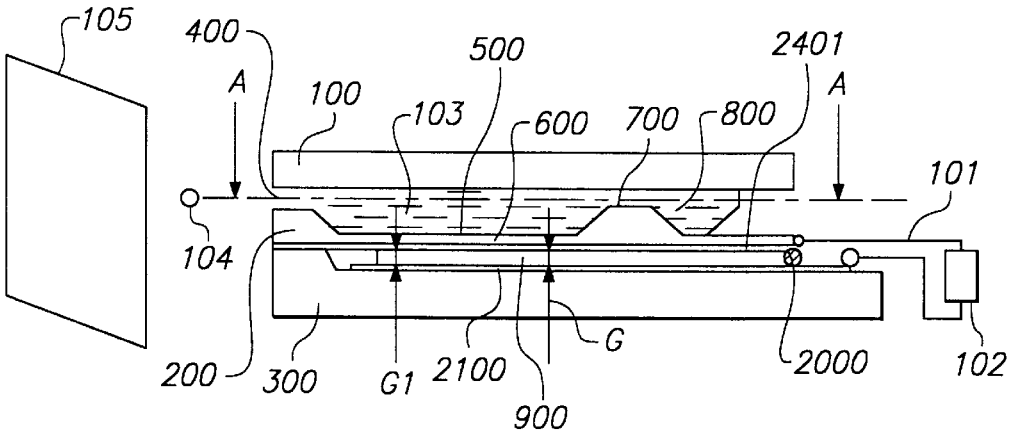
Figure 18D:
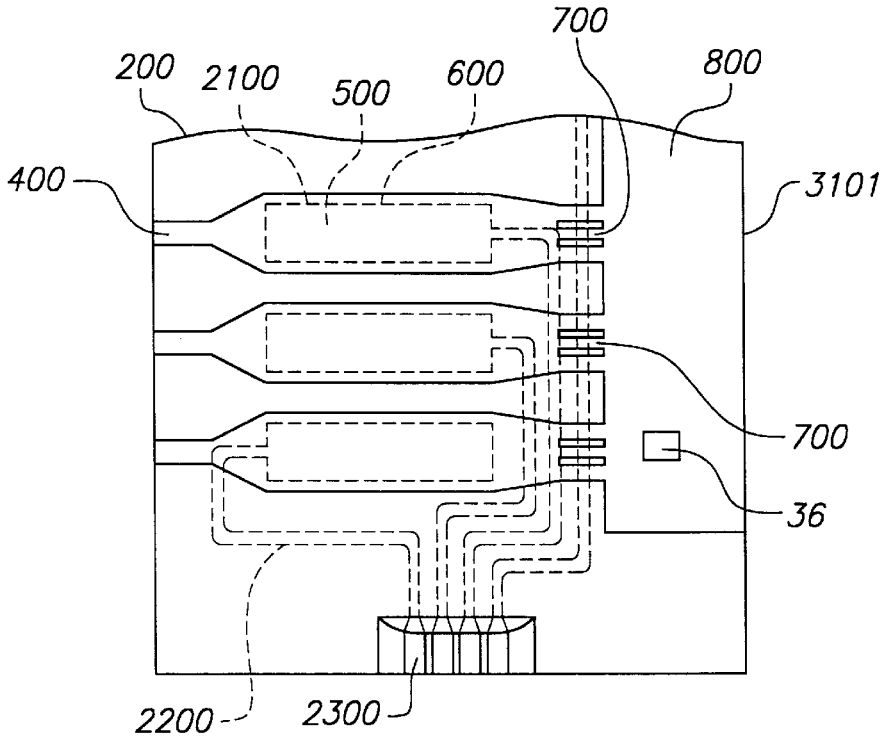
Figure 19:
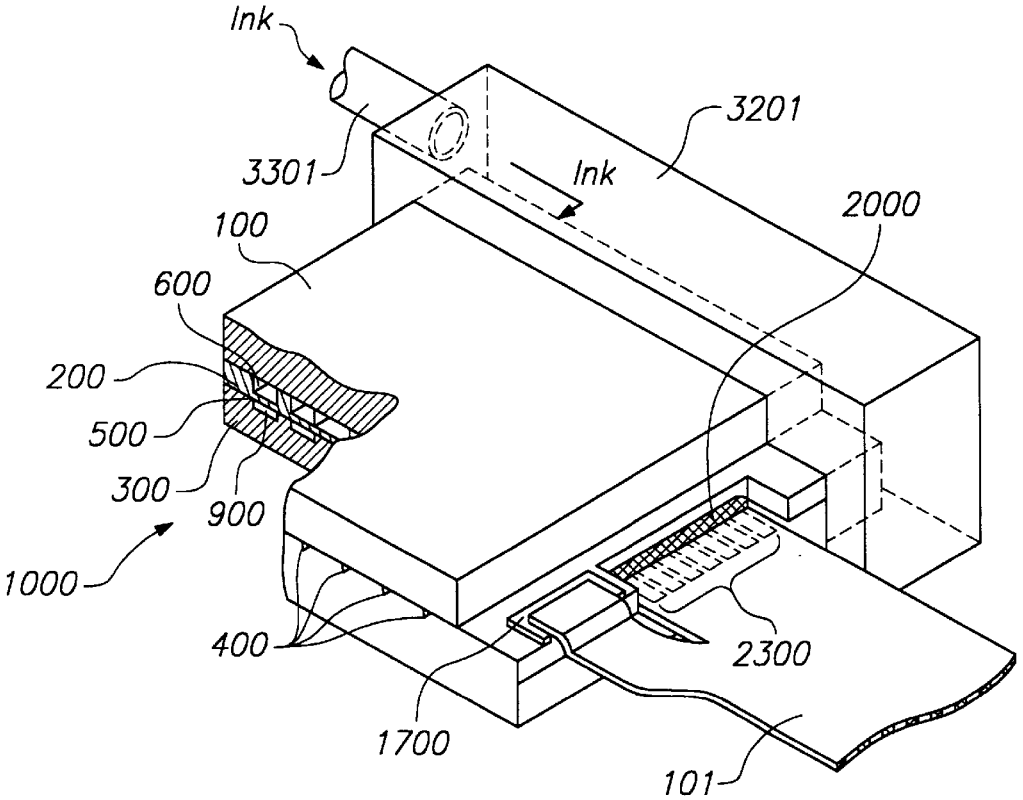
FIG. 19 is a partial plan view taken along line A—A shown in FIG. 18B.

FIG. 18B is an enlarged sectional view of portion A as shown in FIG. 18A, FIG. 18C is a sectional elevation of the whole structure of the assembled ink-jet head, FIG. 18D depicts a partial plan view of FIG. 18C made along line A—A, and FIG. 19 is a perspective view of the assembled ink jet head.

The ink-jet head 1000 of this embodiment involves a laminated structure of three substrates, upper 100, middle 200 and lower 300, each respectively having a construction as will be described below.

The middle substrate 200 is composed of relatively pure Si and includes a plurality of nozzle grooves 1100 placed at one edge at regular intervals in parallel to each other which end with a plurality of nozzle holes 400. A plurality of dents or concave portions 1200 constituting emitting chambers 600 are respectively led to each nozzle groove 1100, and further include an individual diaphragm 500 forming the bottom wall of each chamber. A plurality of grooves 1300 of ink flowing inlets constituting orifices 700 are positioned at the rear of the concave portions 1200, and a dent or concave portion 1400 of a common ink cavity 800 supplies ink to the respective emitting chambers 600. Ink inlet 3101 is also disposed at the back of recess 1400.

The relationship between the work functions of the semiconductor and metallic material used for the electrodes is an important factor affecting the formation of common electrode 1700 to middle substrate 200. In the present embodiment the common electrode is made from platinum over a titanium base, or gold over a chrome base, but the invention shall not be so limited and other combinations may be used according to the characteristics of the semiconductor and electrode materials.

As shown in FIG. 18B, an oxide thin film 2401 approximately 0.11 $\mu$m thick is formed on the entire surface of middle substrate 200 except for the common electrode 1700. Oxide thin film 2401 acts as an insulation layer for preventing dielectric breakdown and shorting when the ink jet head is driven.

The lower substrate 300, attached to the bottom face of the middle substrate 200, is made of boro-silicated glass. When bonded together, these attached substrates 200 and 300 constitute a plurality of vibrating chambers 900. At respective positions of the lower substrate 300, corresponding to respective diaphragms 500, ITO of a pattern similar to the shape of the diaphragm is spattered with a thickness of 0.1 $\mu$m. Electrode 2100 includes lead 2200 and terminal 2300.

In this preferred embodiment, a distance holding means is constituted by indentations or dents 1500 hollowed or etched out of the top or connecting face of lower substrate 300. When the substrates 200 and 300 are aligned and bonded, those dents form the lower portions of enclosed vibrating chamber 900 (the tope being formed by diaphragm 500 located on the bottom face of substrate 200). Also, diaphragm 500 will be positioned such that it is disposed opposite tot he corresponding electrode 2100 forming the bottom surface of the vibrating chamber 900.

The length of the electrical gap "G" (see FIG. 18C) is identical with the thickness of oxide thin film 2401 plus the difference between the depth of the dent 1500 and a thickness of the electrode 2100. According to this embodiment, the dent 1500 is etched to have a depth of 0.275 μm. The pitch of the nozzle grooves 1100 is 0.508 mm and the width of the nozzle groove 1100 is 60 μm.

The upper substrate 100, attached to the upper face of the middle substrate 200, is made of boro-silicated glass identical with that of the lower substrate 300. Combining the upper substrate 100 with the middle substrate 200 completes the nozzle holes 400, the emitting chambers 600, the orifices 700, the ink cavities 800, and ink inlet 3100. Support member 36 providing reinforcement is also provided in ink cavity 800 to prevent collapsing recess 1400 when middle substrate 200 and upper substrate 100 are bonded together.

The ink-jet head of the preferred embodiment is constructed as follows. First, the middle substrate 200 and the lower substrate 300 are anode bonded by applying an 800V source at 340° C. between them. Then, the middle substrate 200 and the upper substrate 100 are connected, resulting in the assembled ink-jet head shown in FIGS. 18A and 18C. After anode bonding, the thickness of oxide thin film 2401 and difference between the depth of the dent 1500 and the thickness of the electrode 2100 constitutes the electrical gap length (here, approximately 0.285 μm). Distance G1 (air gap) between the diaphragm 500 and the electrode 2100 is approximately 0.175 μm.

After thus assembling the ink jet head, drive circuit 102 is connected by connecting flexible printed circuit (FPC) 101 between common electrode 1700 and terminal members 2300 of individual electrodes 2100 as shown in FIGS. 18C and 19. An anisotropic conductive film is preferably used in this embodiment for bonding leads 101 with electrodes 1700 and 2300.

Nitrogen gas is also injected to vibration chambers 900, which are sealed airtight using an insulated sealing agent 2000. Vibration chambers 900 are sealed near terminal members 2300 in this embodiment, thus enclosing vibration chamber 900 and a volume of lead member 2200.

Ink 103 is supplied from the ink tank (not shown in the figures) through ink supply tube 3301 and ink supply vessel 3201, which is secured externally to the back of the ink jet head to fill ink cavity 800 and ejection chambers 600 through ink inlet 3101. The ink in ejection chamber 600 becomes ink droplet 104 ejected from nozzles 400 and printed to recording paper 105 when ink jet head 100 is driven, as shown in FIG. 18C.

Figure 51:
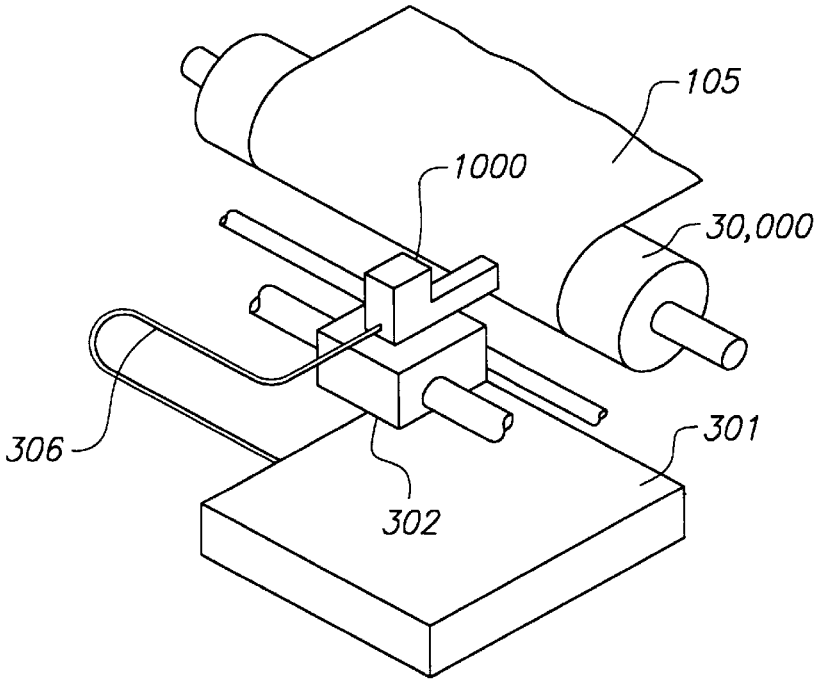
FIG. 51 is a schematic diagram of a printer incorporating the ink-jet head of the eleventh embodiment of the present invention.

In FIG. 51, numeral 305 is a platen, 301 is an ink tank, and 302 is a carriage of the ink head 10. When the electrical gap length between the diaphragm 500 and the electrode 2100 exceeds 2.5 μm, the required drive voltage impractically exceeds 250V. However, a very good image is obtained when driving the ink jet head of the presently preferred embodiment with 38 volt pulses at approximately 3.3 Khz. If so, the observed ink droplet ejection speed approaches 12 m/sec without underprinting, overprinting, smearing or other deleterious effects.

Embodiment 12

Figure 20:
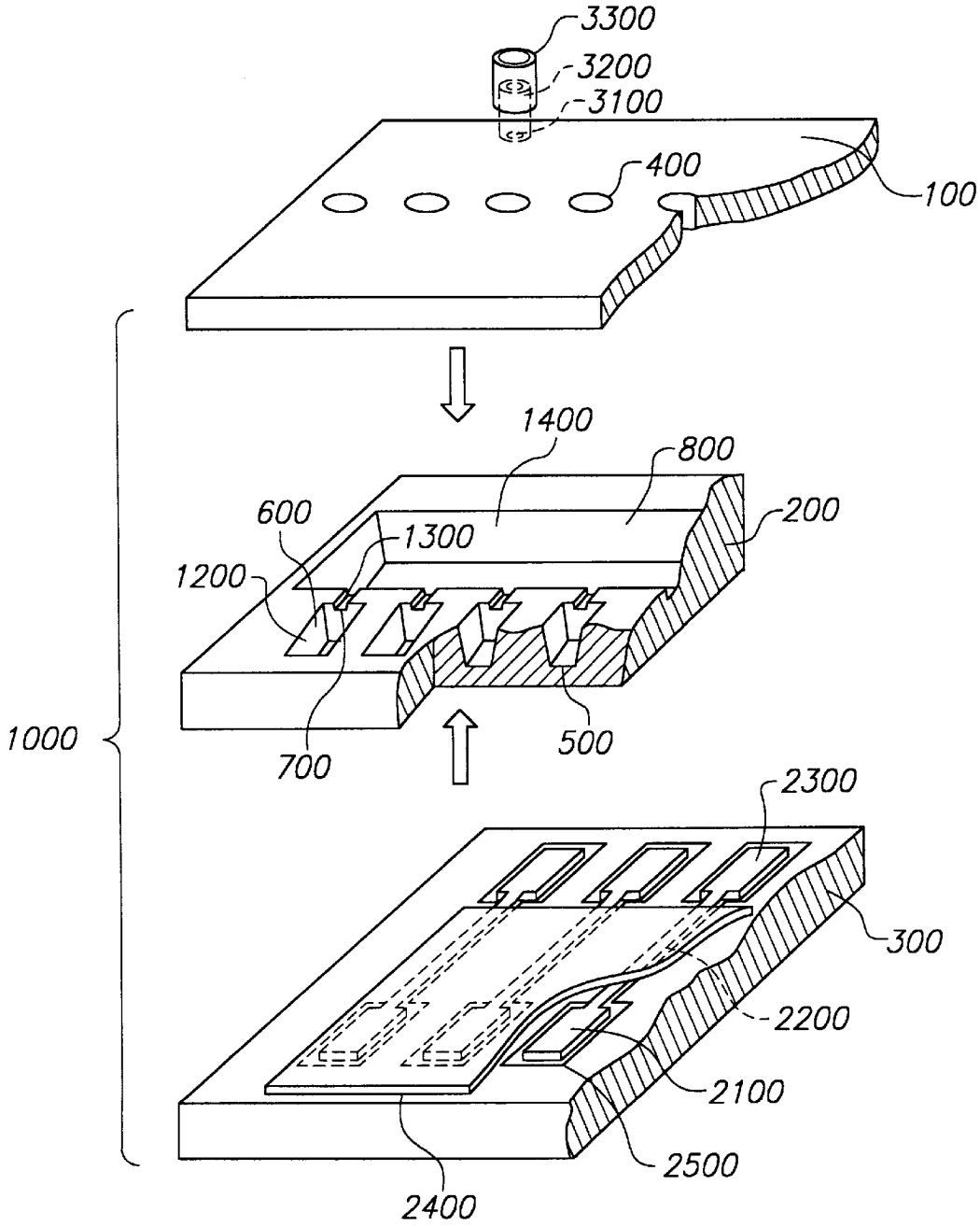
FIG. 20 is an exploded perspective view of the twelfth embodiment of the ink-jet head according to the present invention.
Figure 21:
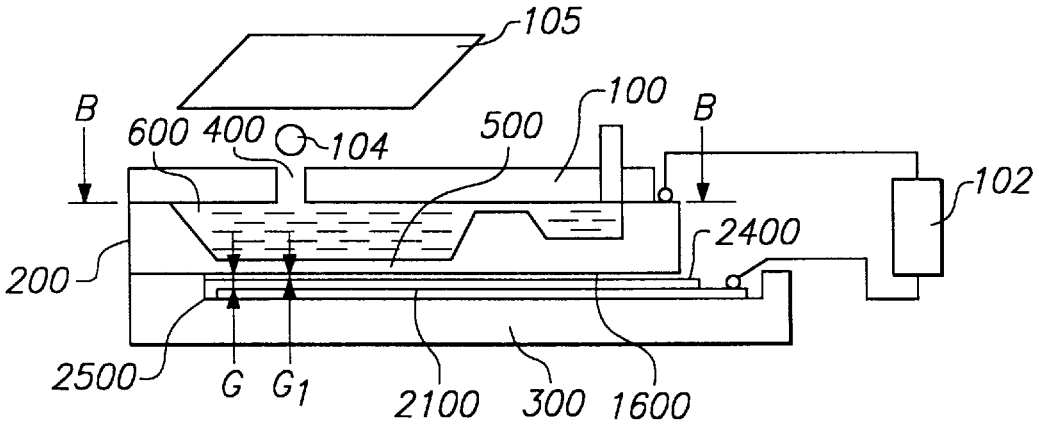
FIG. 21 is a sectional side elevation of the twelfth embodiment.
Figure 22:
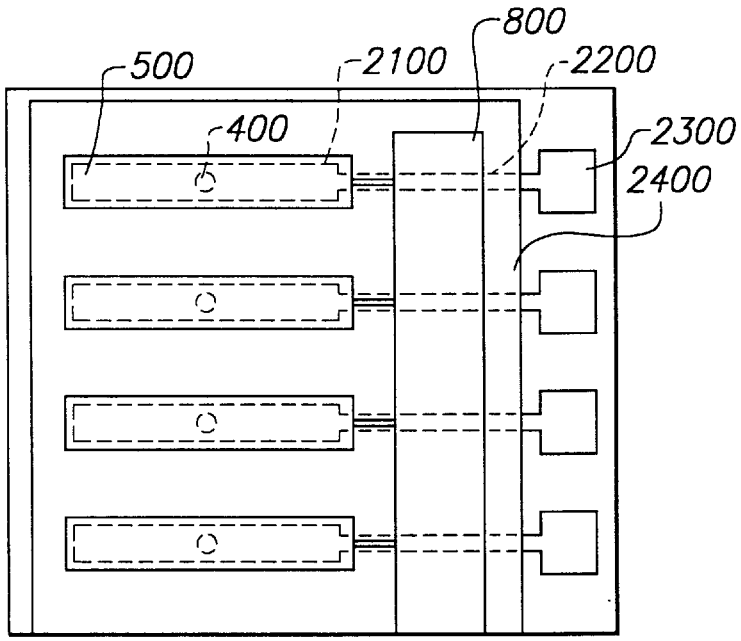
FIG. 22 is a B—B view of FIG. 21.

FIG. 20 is an exploded perspective view of the ink jet head according to the twelfth embodiment of the present invention partly shown in section. The ink jet head illustrated is of a face ink jet type having nozzle holes formed on the outside face of the upper substrate 100, through which holes ink drops emit. FIG. 21 shows a sectional side elevation of the whole construction of an assembled ink jet head according to this embodiment, and FIG. 22 shows a partial plan view taken along line B—B shown in FIG. 21. Hereinafter, the part or members of the ink jet head identical with or similar to that of embodiment 11 will be explained with the identical reference numbers of embodiment 11.

The ink jet head 1000 of the twelfth embodiment is adapted to emit ink drops through the nozzle holes 400 formed in a face of the upper substrate 100.

The middle substrate 200 of this twelfth embodiment is made of a silicon of crystal face direction (110) with a thickness of 380 μm. The bottom wall of the dent 1200 constituting the emitting chamber 600 is a diaphragm 500 approximately 3 μm thick. By contrast, there is no dent of the vibrating chamber of the eleventh embodiment at the lower portion of the diaphragm 500. Instead, the lower face of the diaphragm 500 therein is flat and smooth-face polished, e.g., as in a mirror.

The lower substrate 300 attached to the bottom face of the middle substrate 200 is made of boro-silicated glass as in that of the eleventh embodiment. The gap length G is formed on the lower substrate by a dent 2500 formed by an etching away of 0.5 μm in order to mount the electrode 2100. The dent 2500 is made in a pattern larger than the shape of the electrode in order to mount the electrode 2100, lead 2200, and terminal 2300 in the dent 2500. The electrode 2100 itself is made by spattering ITO of 0.1 μm thickness in the dent 2500 to form the ITO pattern, and gold is spattered only on the terminal 2300. Except for the electrode terminal 2300, a 0.1 μm thick boro-silicated glass spatter film covers the whole surface to make the dielectric layer 2400. In FIG. 20, the dielectric layer 2400 is drawn as a uniformly flat shape. However, as in diaphragm 500 here, the dielectric layer 2400 has indentations formed therein.

Consequently, according to the twelfth embodiment, the gap length is 0.4 μm and the space distance G1 is 0.3 μm after anodic bonding.

The upper substrate 100, attached to the top face of the middle substrate 200, is made of a stainless steel (SUS) plate approximately 100 μm thick. On the face of the upper substrate 100, there are nozzle holes 400 respectively led to the dent 1200 of the emitting chambers. The ink supply port 3100 is formed so as to be led to the ink cavity 1400.

When the ink jet head 1000 of the twelfth embodiment is used and a plate voltage of 0V to 100V is applied from the oscillation circuit 102 to the electrode 2100, a good printing efficiency corresponding to that of the eleventh embodiment is obtained. When the ink jet head provided with a gap length G exceeding 2.3 μm is used, the required driving voltage is more than 250V, and is thus impractical.

Embodiment 13

Figure 23:
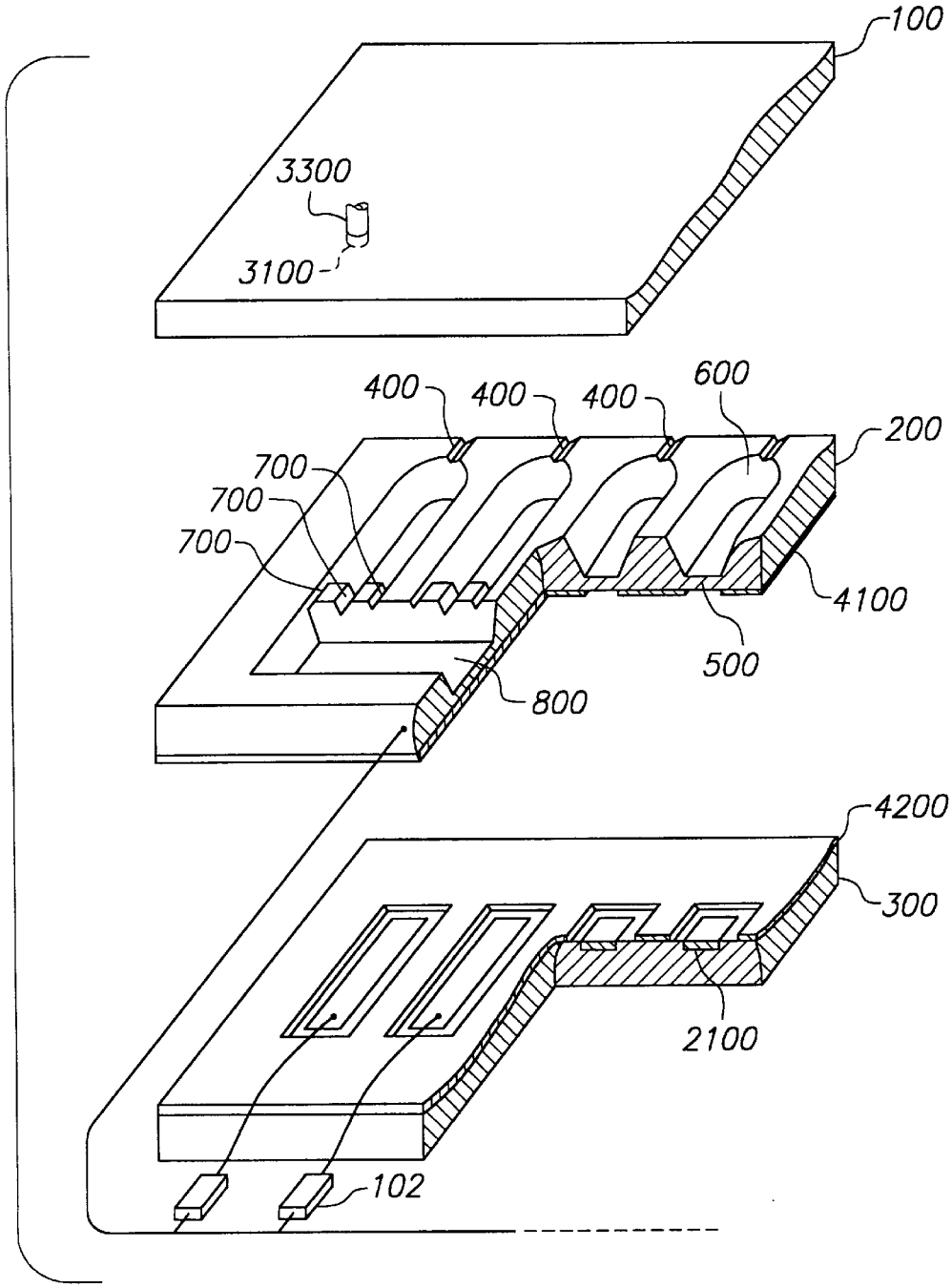
FIG. 23 is an exploded perspective view of the thirteenth embodiment of the ink-jet head according to the present invention.

FIG. 23 shows an exploded perspective view of the ink jet head according to the thirteenth embodiment of the present invention, with a part of the head detailed in section. FIG. 24 is an enlarged perspective view of a portion of this ink jet head.

According to the thirteenth embodiment of the ink jet head, the gap length holding means is formed by $SiO_2$ membranes 4100 and 4200 respectively, previously deposited at the space between the middle substrate 200 and the lower substrate 300. These $SiO_2$ membranes 4100 and 4200 function as gap spacers. The middle substrate 200 is preferably made of a single crystal silicon wafer having a crystal face direction of (100). On the bottom face of this wafer, except a part corresponding to the diaphragms 500, a preferably 0.3 μm thick $SiO_2$ membrane 4100 is deposited. Similarly, the lower substrate 300 is made of a single crystal silicon wafer having a (100) crystal face direction. A 0.2 μm thick $SiO_2$ membrane 4200 is formed on the upper face of the lower substrate 300, except the area immediately adjacent to electrodes 2100.

This results in a gap length between the middle and lower substrates of approximately 0.5 μm after bonding (see FIG. 24).

FIGS. 25A to 25E show the manufacturing steps of the middle substrate according to the thirteenth embodiment of the present invention.

First, both faces of the silicon wafer having a (100) crystal face direction are mirror-polished in order to make a silicon substrate 5100 of a thickness 200 μm (see FIG. 25A). The silicon substrate 5100 is treated with thermal oxidization treatment using an oxygen and steam atmosphere heated to 1100° C. for 4 hours in order to form $SiO_2$ membranes 4100*a* and 4100*b* of a thickness 1 μm on both the faces of the silicon substrate 5100 (see FIG. 25B). $SiO_2$ membranes 4100*a* and 4100*b* function as an anti-etching material.

Next, on the upper face of the $SiO_2$ membrane 4100*a*, a photo-resist pattern (not shown) having a pattern corresponding to nozzles 400, emitting chambers 600, orifices 700 and ink cavities 800 is deposited. The exposed portion of the $SiO_2$ membrane 4100*a* is then etched by a fluoric acid etching agent and the photo-resist pattern is removed (see FIG. 25C).

Then, the silicon substrate 5100 is anisotrophy-etched by an alkali agent (FIG. 25D). When single crystal silicon is etched by an alkali such as kalium hydroxide solution or hydradin, etc., as is well known, the difference between etching speeds on various crystal faces of the single crystal silicon can be great. This makes it possible to carry out anisotrophy etching on them and still yield good results. In practice, because the etching speed of a (111) crystal face is the least or the lowest, the crystal face (111) will remain after the etching process finishes.

According to the thirteenth embodiment, a caustic potash solution containing isopropyl alcohol is used in the etching treatment. Because mechanical deformation characteristics of the diaphragm is determined by the dimensions of the diaphragm, every size characteristic of the diaphragm is determined with reference to desired ink emitting characteristics. According to the thirteenth embodiment, a width h of the diaphragm 500 is preferably 500 μm and its thickness is preferably 30 μm (see FIG. 26).

In the silicon substrate 5100 having a (111) face direction, the (110) face crosses structurally with (100) face of the substrate at an angle of about 55°, so that when the sizes of the diaphragm to be formed in the silicon substrate of (100) face direction are determined, the mask pattern size of anti-etching material will be determined primarily with reference to the thickness of the middle substrate. As shown in FIG. 26, the width d of the top opening of the emitting chamber 600 in this embodiment is preferably 740 μm when an etching treatment of 170 Ξm width is done. This leaves a diaphragm 500 of a width h equal to 500 μm and a thickness t equal to 30 μm. In a typical batch, the (111) face undergoes little etching or undercutting, and the size d shown in FIG. 26 becomes a little larger than the mask pattern width d1. Consequently, it is necessary to limit the mask pattern width d1 to that portion of the (111) face which will be undercut, so that d approaches 730 μm as in the thirteenth embodiment and a predetermined length of approximately 170 μm can etched away with precision by using the aforementioned alkali etching solution (see FIG. 25C).

Next, $SiO_2$ membrane 4100*b* on the bottom face of the silicon substrate 5100 is patterned. The thickness of the $SiO_2$ membrane 4100*b* was 1 μm at the stage FIG. 25B. In an alkali anisotrophy etching process shown in FIG. 25D, the $SiO_2$ membrane 4100*b* is etched by alkali solution and its thickness decreased to 0.3 μm. According to the thirteenth embodiment, an etching rate of the $SiO_2$ membrane is very small, so reproducing the decrease in thickness of the $SiO_2$ membrane 4100*b* can be successfully accomplished.

Next, a photo-resist pattern (not shown) of a shape corresponding to the diaphragm 500 is formed on the $SiO_2$ membrane 4100*b*, and the exposed portion of the $SiO_2$ membrane 4100*b* is etched by fluoric acid etching solution so as to remove the photo-resist pattern. Simultaneously, all material of the $SiO_2$ membrane 4100*a* remaining on the user face of the substrate 5100 is removed (see FIG. 25E).

After such steps are finished, the middle substrate 200 shown in FIG. 23 is completed.

Next, the manufacturing steps of the lower substrate according to the thirteenth embodiment of the present invention will be explained with reference to FIGS. 27A to 27D.

First, both the faces of a n-type silicon substrate 5200 of (100) face direction are mirror-polished and heat oxidized at 1100° C. for a predetermined time in order to form the $SiO_2$ membranes 4200*a* and 4200*b* on both the faces of the silicon substrate 52 (see FIG. 27A).

Next, a photo-resist pattern (not shown) is applied on the upper $SiO_2$ membrane 4200*a* except those areas designated for the electrode members 2100. Then, the exposed portions of the $SiO_2$ membrane 4200*a* are etched by a fluoric acid etching solution to remove the photo-resist pattern (see FIG. 27B), leaving wells 4300 to hold the electrodes.

In the next step, the exposed Si portion 4300 of the silicon substrate 5200 is boron-doped. A suitable boron-doping process is described below. The silicon substrate 5200 is held in a quartz tube through a quartz holder. Steam with bubbled $BBr_3$ with $N_2$ carriers is led together with $O_2$ into the quartz tube. After the silicon substrate 5200 is treated at 1100° C. for a predetermined time, the substrate 5200 is lightly etched by fluoric acid etching agent, and the $O_2$ is driven in. The exposed part of Si 4300 becomes a p-type layer 4400 (see FIG. 27C). The p-type layer 4400 functions as the electrode 2100 as shown here, and in FIG. 23.

In the step of FIG. 27C, the thickness of the $SiO_2$ membranes 4200*a* and 4200*b* on the upper face of the silicon substrate 52 increases, so in the thirteenth embodiment, the thickness of the $SiO_2$ membrane 4200*a* increases to 0.2 μm.

Next, a photo-resist pattern (not shown) is applied to $SiO_2$ membrane 4200*a* except for those areas immediately above p-type layer 4400 (electrode 2100). Then, the exposed areas of the $SiO_2$ membrane 4200*a* are etched by a fluoric acid etching agent (see FIG. 27D). Thus, the lower substrate 300 shown in FIG. 23 is obtained.

According to the ink jet head of the thirteenth embodiment of the present invention, the size of the gap length G between the diaphragm 500 and the electrode 2100 is determined to 0.5 μm on the basis of an ink emitting characteristic of the ink jet head. Because the thickness of the $SiO_2$ membrane 4100*b* of the middle substrate 200 is 0.3 μm as mentioned above, the process is carried out so that the thickness of the $SiO_2$ membrane 4200*a* in the step of FIG. 27C becomes 0.2 μm.

The middle and lower substrates formed according to the steps above are joined by a Si—Si direct connecting method to complete the head construction as shown enlarged in FIG. 24. The joining steps will be described in more detail hereinbelow.

First, the silicon substrate 200 is washed with a mixture of sulfuric acid and hydrogen peroxide of 100° C., then positions of the corresponding patterns of both the substrates 200 and 300 are matched, and finally they are applied to each other. After that, both the substrates 200 and 300 are thermally treated at a temperature of 1100° C. for one hour, thereby obtaining a firm lamination structure.

The observed sizes of the gap length G of one hundred ink jet heads manufactured scatter along a range of ±0.05 μm. The observed thickness of the diaphragms are distributed in a range of 30.0 μm±0.8 μm. When the ink jet heads are driven with 100V and 5 Khz, ink drop emitting speeds are scattered in a range of 8±0.5 μm/seconds and ink drop volumes are distributed in a range of $(0.1\pm0.01)\times10^{-6}$ cc. In a practical printing test of the one hundred ink jet heads, good results of printing are obtained.

According to the thirteenth embodiment of the present invention, a gaseous process using $BBr_3$ forms a p-type layer and the electrode 2100. However, the p-type layer forming method could alternatively include other processes well known in the art, such as an ion injection method, a spin-coating method in which a coating agent $B_2O_3$ is scattered in inorganic solvent and spun, and other known methods which use a distribution source of BN (Boron nitrogen) plate. Also, it is possible to use other elements in group III, such as Al, Ga in order to form suitable p-type layers.

It is also possible to make the electrode 2100 a n-type layer if the silicon substrate 3 is a p-type substrate. In this case, various known doping methods are used. That is, V group elements such as P, As, Sb and the like are doped to make the electrode 2100.

According to the thirteenth embodiment, the $SiO_2$ membranes 4100 and 4200 form the gap portions. However, because it is possible if any one of the $SiO_2$ membranes is not used to connect both the substrates (owing to the principle of Si—Si direct connecting process), it should become obvious to those ordinarily skilled in the art that one of the membranes 4100 and 4200 may have the necessary length of the gap and another membrane may be removed by fluoric acid etching agent in a Si—Si direct connecting process to obtain a desired gap portion composed of a unitary material.

In the thirteenth embodiment, the $SiO_2$ gap spacer can also be used as an etching mask during alkali anisotrophy etching process. During the etching, the size of the membrane decreases, and the material can be thinned enough where the connecting face itself will begin to deteriorate. When the face deteriorates to a certain degree and once all the $SiO_2$ membrane is removed by a fluoric acid etching agent, a thermal oxidization process is used to form $SiO_2$ membrane of a necessary thickness to obtain an appropriate gap spacer.

In addition, according to the thirteenth embodiment, considering the specification of the ink jet head, the gap length is determined temporarily to 0.5 μm. However, because Si thermal oxidized membranes can be manufactured precisely and easily until their maximum thickness approaches 1.5 μm, controlling only the thickness of the Si thermal oxidized membranes of the gap spacers to produce a gap length between 0.05 to 2.0 μm enables one to obtain an ink jet head provided with the gap portion having a precise measurement similar to that of the thirteenth embodiment.

Embodiment 14

FIG. 28 shows a partly-broken perspective view of the middle substrate used to the ink jet head according to the fourteenth embodiment of the present invention. The lower substrate and the upper substrates on which electrodes may be formed are identical with that of the previously described embodiment (embodiment thirteen), so they need not be discussed further here.

According to the fourteenth embodiment of the ink jet head, a second electrode 4600 consisting of a p-type or n-type impurity layer is formed on the gap opposed face 4500 of the diaphragm 500 as shown in FIG. 28 in order to improve frequency characteristic of the oscillation circuit or crosstalk when the ink jet head is driven. The gap length G of the fourteenth embodiment is the separation between the second electrode 4600 and the electrode 2100 on the lower substrate (see, e.g., FIG. 23). The distance holding means is constructed by the $SiO_2$ membrane 4100 formed on the bottom face of the middle substrate 200 in a manner described below and on the lower substrate in reference to the thirteenth embodiment. In this case too however, it is possible to obtain an optimal gap length G by only one of the $SiO_2$ membranes.

The manufacturing steps of the middle substrate of the fourteenth embodiment of the present invention is shown in FIGS. 29A to 29G.

Figure 29A:
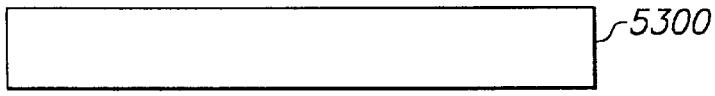
FIGS. 29A to 29G show a manufacturing step diagram of the middle substrate of the fourteenth embodiment of the present invention.
Figure 29B:
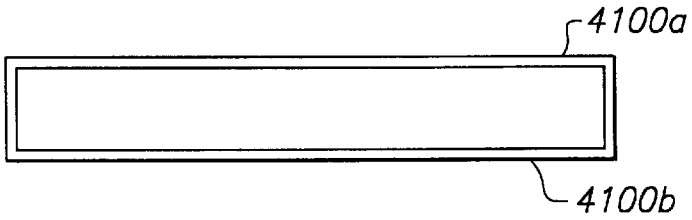
Figure 29C:
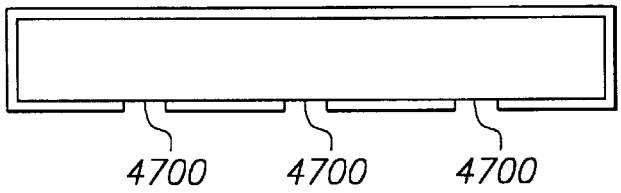
Figure 29D:
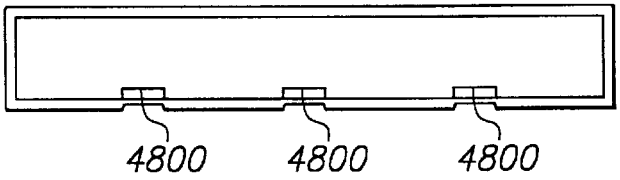
Figure 29E:
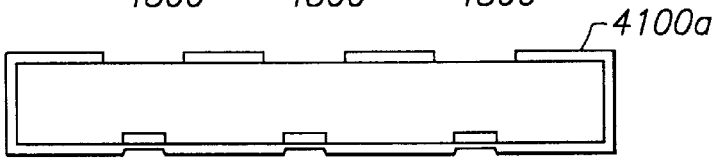
Figure 29F:
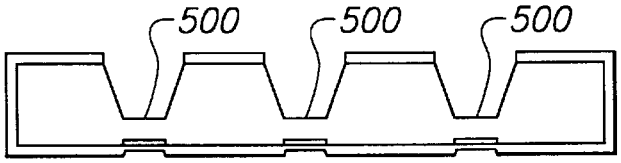
Figure 29G:
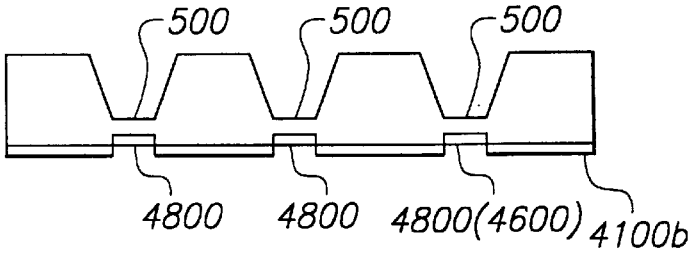

First, both the sides of a silicon wafer of n-type of (100) face direction are mirror-polished to manufacture a silicon substrate 5300 of a thickness 200 μm (see FIG. 29A). Then, the silicon substrate 5300 is thermally oxidization-treated in an oxygen-steam atmosphere at 1100° C. for 4 hours in order to form $SiO_2$ membranes 4100*a* and 4100*b* of thickness 1 μm on both the faces of the silicon substrate 5300 (see FIG. 29B).

Next, on the lower $SiO_2$ membrane 4100*b*, a photo-resist pattern (not shown) is applied except for those areas which will contain electrode 4600 as shown in FIG. 28 and a lead (not shown) is formed. Thereafter, the exposed portion of the $SiO_2$ membrane 4100*b* is etched and removed by fluoric acid etching agent in order to remove the photo-resist pattern (see FIG. 29C).

At the next stage, the exposed Si portion 4700 of the silicon substrate 5300 is doped according to the treatment process identical with that of the thirteenth embodiment of the present invention in order to form a p-type layers 4800. The p-type layer 4800 functions as the second electrodes 4600 (see FIG. 29D).

A photo-resist pattern is (not shown) corresponding to the outlines of the shapes of the nozzle holes 400, emitting chambers 600 and the like are formed on the upper $SiO_2$ membrane 4100*a*. Thereafter, exposed portion of the $SiO_2$ membrane 4100*a* is etched away to remove the photo-resist pattern (see FIG. 29E).

The following steps of the manufacturing process are identical with that of the thirteenth embodiment. The $SiO_2$ membrane 4100*b* is pattern treated so as to form the diaphragm 500, nozzles 400, emitting chambers 600, orifices 700, and ink cavity 800, and the gap portion between the diaphragm and the lower substrate (see FIGS. 29E to 29G).

Similar to that of the thirteenth embodiment, various methods can be used to form the electrode 4600 and various kinds of dopants can be used to the doping process.

According to the fourteenth embodiment, respective diaphragms 500 have respective driving electrodes 4600 formed thereon, so it is possible to obtain a high speed driving of the oscillation circuit, or a high printing speed of the ink jet head of the present invention.

According to the thirteenth embodiment, the highest driving frequency for forming independent ink drops was 5 Khz, However, in the fourteenth embodiment, the highest driving frequency is 7 Khz. Also, the lead wires for connecting respective electrodes 4600 and the oscillation circuit are integrally and simultaneously formed with the electrodes 4600 to attain a compact and high speed ink jet head. However, this configuration does important additional manufacturing cost over that presented in the eleventh or thirteenth embodiments.

Embodiment 15

Figure 30:
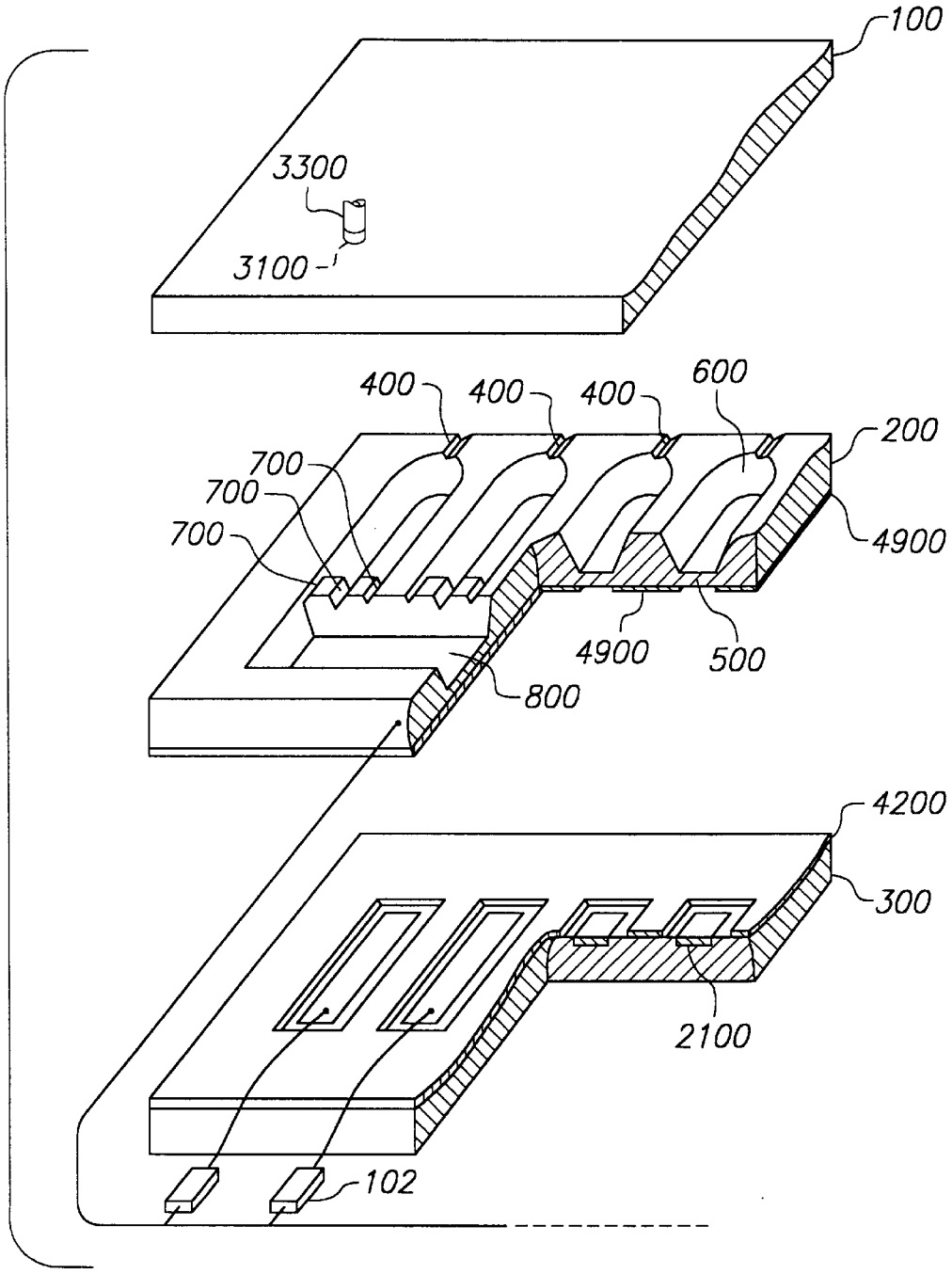
FIG. 30 an exploded perspective view of the ink-jet head according to the fifteenth embodiment of the present invention.

FIG. 30 shows a partly-broken exploded perspective view of the ink jet head of the fifteenth embodiment of the present invention. The ink jet head of the fifteenth embodiment has a structure basically identical with that of the thirteenth embodiment shown in FIG. 23 and has a characteristic thin membrane or film for restricting the distance of the gap formed between the diaphragm 500 and the electrode 2100 when the middle substrate 200 and the lower substrate 300 are combined. The thin film is preferably made of boro-silicated glass (thin membrane 4900) and formed on the bottom face of the middle substrate 200.

FIGS. 31A to 31G shows the manufacturing steps of the middle substrate according to the fifteenth embodiment of the present invention.

Figure 31A:
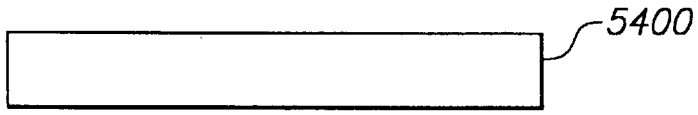
FIGS. 31A to 31G show a manufacturing step diagram of the middle substrate according to the fifteenth embodiment of the present invention.
Figure 31B:
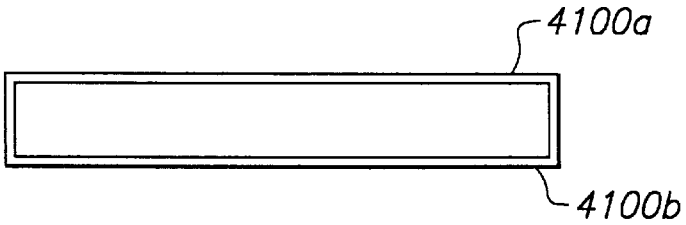

First, both the faces of silicon wafer of (100) face direction is micro-polished to manufacture a silicon substrate 5400 of a thickness 200 $\mu$m (see FIG. 31A), and the silicon substrate 5400 is thermal oxidization-treated in an oxygen and steam atmosphere at 1110° C. for 4 hours in order to form $SiO_2$ membranes 4100*a* and 4100*b* of 1 $\mu$m thickness each (see FIG. 31B).

Figure 31C:
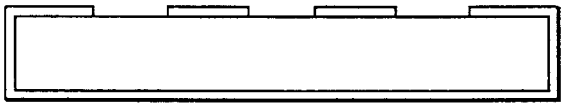
Figure 31D:
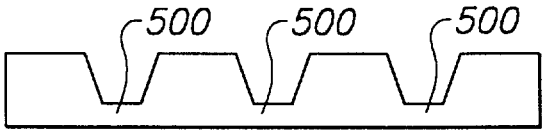

Next, a photo-resist pattern (not shown) corresponding to outlines of the shapes of nozzle holes 400, emitting chambers 600, etc. is formed on the upper $SiO_2$ membrane 4100*a*, and the exposed portion of the $SiO_2$ membrane 4100*a* is etched by a fluoric acid etching agent in order to remove the photo-resist pattern (see FIG. 31C).

An anisotrophy etching is carried out on the silicon by using an alkali agent. According to the anisotrophy etching process described in regard to the thirteenth embodiment, the nozzle holes 400 and the emitting chamber 600, etc. are formed. Then, the $SiO_2$ membranes 4100*a* and 4200*b* of anti-etching material are removed by a fluoric acid etching agent (see FIG. 31D).

Next, boro-silicated glass thin membrane 4900 functioning as a gap spacer precisely restricting the distance between the diaphragm 500 and the electrode 2100 is formed on the lower face of the silicon substrate 5400 through anode bonding as described below.

Figure 31E:
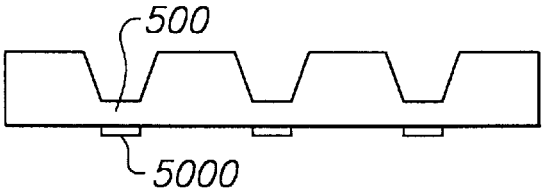
Figure 31F:
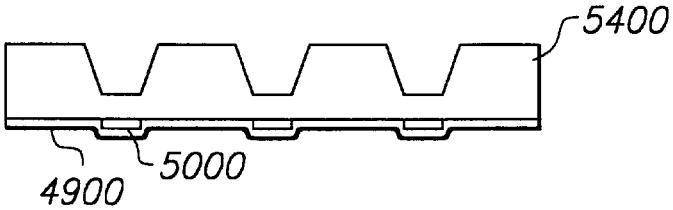
Figure 31G:
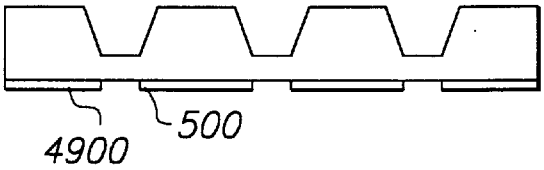

First, a photo-resist pattern 5000 corresponding to a shape of the diaphragm 500 is formed on the bottom face of the silicon substrate 5400 (see FIG. 31E). Next, a spattering apparatus forms a boro-silicated glass thin membrane 4900 on the bottom face of the silicon substrate 5400 (see FIG. 31F). The silicon substrate 5400, sintered in an organic solvent, is then deposited with ultra-sound vibration a known manner in order to remove the photo-resist pattern 5000. Consequently, a boro-silicated glass thin membrane 4900 gap spacer is formed on substrate 5400 in a manner surrounding the lower surfaces of the diaphragms as shown in FIG. 31G.

The spattering conditions of the boro-silicated glass this membrane 4900 are described below.

Preferably, in this embodiment, Corning Corporation-made #7740 glass is used as a spattering target, a spattering atmosphere is 80% Ar–20% $O_2$ at a pressure of 5 m Torr, and microwaved at an RF power og 6 W/cm$^2$. Thus, 0.5 $\mu$m thickness glass thin membrane 4900 is obtained.

The lower substrate 300 and the upper substrate 100 shown in FIG. 30 used to assemble the ink jet head of the present invention are manufactured by the method of the thirteenth embodiment. The middle substrate 200 and upper substrate 100 are anode-bonded or attached integrally by the method of the thirteenth embodiment. The diaphragm 500 formed on the substrate 200 and the electrode 2100 formed on the substrate 300 are matched in their positions and juxtaposed vertically. Combined substrates 200 and 300 are heated to 300° C. on a hot plate, and a DC voltage 50V is applied between them for ten minutes with the middle substrate being positively charged and the lower substrate being negatively charged.

The ink jet head manufactured according to the fifteenth embodiment of the present invention has been tested in real-printing operations and a good result of printing similar to that of the thirteenth embodiment was observed.

According to the fifteenth embodiment, in order to form the gap portion between the diaphragm 500 and the electrode 2100, a boro-silicated glass thin membrane 4900 is formed on the bottom face of the middle substrate 200. Alternatively, one can form the boro-silicated glass thin membrane 4900 on the upper face of the lower substrate 300 instead but still obtain the same effect.

Also, the boro-silicated glass thin membrane 4900 may be formed by the method of the fifteenth embodiment on the lower substrate 300. In an anode bonding of the middle and lower substrates, a DC voltage 50V is applied between them with the middle substrate being positively charged and the lower substrate being negatively charged while heated to a temperature of 300° C. This eventually produces an ink jet head of a quality and a performance identical with that of the fifteenth embodiment.

According to the fifteenth embodiment, it is possible to bond the middle substrate and the lower substrates at 300° C., obtaining the effects mentioned below.

Also, it is possible to use not only p-type or n-type impurities of the thirteenth embodiment, but also, for example, a metal membrane or film of Au or Al, etc. provided that its melting point ranges from at least 100° C. to several hundred degrees centigrade for the electrode 2100. When such metal film is used, it is possible to decrease electric resistance value of the electrode, thereby improving driving frequency of the ink jet head over semiconductor electrode type devices.

Embodiment 16

FIG. 32 shows a partly-broken perspective view of the middle substrate 200 used to the ink jet head according to the sixteenth embodiment of the present invention. The lower and upper substrates having electrodes formed thereon have the structures identical to that of the thirteenth embodiment.

The middle substrate 200 of the sixteenth embodiment is made of the silicon substrate 5700 which includes a p-type silicon substrate 5500 and an n-type Si layer 5600 epitaxially grown on the bottom face of the p-type silicon substrate 5500. In detail, a part of the p-type silicon substrate 5500 is selectively "etched through" by an electro-chemical alkali anisotrophy etching process (to be explained later) in order to remove the substrate 5500 and obtain a diaphragm 500 of precise thickness.

The manufacturing steps of the middle substrate of the sixteenth embodiment is shown in FIGS. 33A to 33E.

First, both the faces of a silicon wafer of p-type (100) face direction are mirror-polished in order to manufacture a silicon substrate 5500 of a thickness 170 $\mu$m Then, an n-type Si layer 5600 of a thickness 30 μm is epitaxially grown on a bottom face of the silicon substrate 5500 obtaining a silicon substrate 5700 (see FIG. 33A). Preferably, boron is doped into the silicon substrate 5500 of a density approaching $4\times10^{15}/cm^3$. Al is doped into the n-type Si layer 5600 of a density approaching $5\times10^{15}/cm^3$. The epitaxial growth process above can form a Si layer 5600 having a uniform thickness. It is possible to control the thickness with allowance ±0.2 μm of a preferred target of 30 μm.

Next, the silicon substrate 5700 is brought under heat-oxidization-treatment in an oxygen-steam atmosphere at 1100° C., for 4 hours. This forms $SiO_2$ membranes 4100*a* and 4100*b* of thickness 1 μm are formed both the faces of the silicon substrate 5700 (see FIG. 33B).

A photo-resist pattern (not shown) corresponding to the outlines of the shapes of nozzle holes 400, emitting chambers 600, etc., is formed on the upper $SiO_2$ membrane 4100*a*, and a photo-resist pattern (not shown) corresponding to an electrical lead opening portion 5800 is formed on the lower $SiO_2$ membrane 4100*b*. Then, the exposed portions of the $SiO_2$ membranes 4100*a* and 4100*b* are etched by a fluoric acid etching agent in order to remove the photo-resist pattern (see FIG. 33C).

Figure 34:
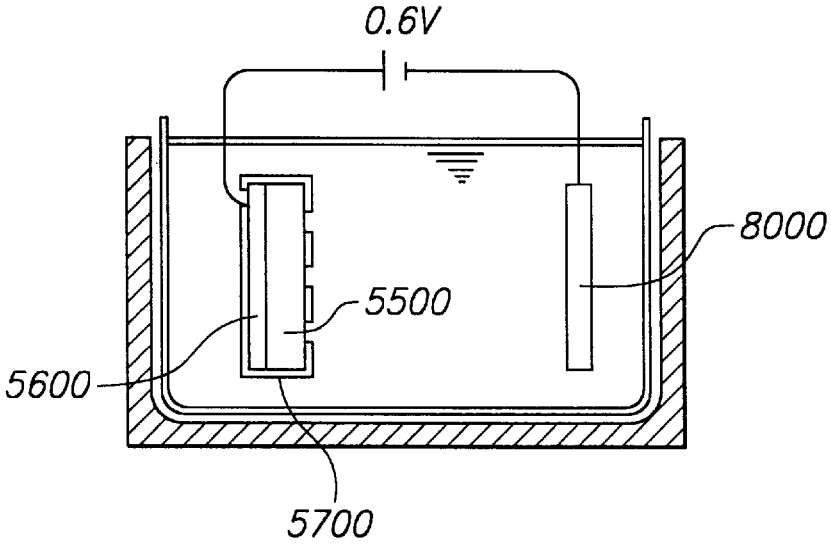
FIG. 34 is a view showing an electrochemical anisotropic etching process used in the sixteenth embodiment of the present invention.

Using the apparatus shown in FIG. 34, the electrochemical anisotrophy etching steps are carried out. As shown in FIG. 34, a DC voltage of 0.6V is applied when n-type Si layer 5600 is positively charged and platinum plate 8000 is negatively charged. The silicon substrate 5700 is then sunk in KOH solution (70° C.) containing isopropyl alcohol to induce an etching step. When the exposed portions of the p-type silicon substrate 5500 (the portions a $SiO_2$ membrane 4100*a* fails to cover) are completely etched and removed, n-type Si layer 5600 is neutralized by a plus DC voltage to prevent the etching process from proceeding further. At this time, the etching is finished and the silicon substrate of a condition shown in FIG. 33D is obtained.

Turning back to FIG. 33, in the next stage, a photo-resist (not shown) of a shape corresponding to the diaphragm 500 is formed on the lower $SiO_2$ membrane 4100*b*, the exposed portion of the $SiO_2$ membrane 4100*b* is etched by fluoric acid, and the photo-resist is removed. Simultaneously, all material of the $SiO_2$ membrane 4100*a* remaining on the surface of p-type silicon substrate 5500 is removed, and the middle substrate 200 shown in FIG. 32 is obtained (see FIG. 33E).

Steps other than those described above are identical to that of the thirteenth embodiment. The observed thickness of the diaphragms 500 of one hundred (100) ink jet heads manufactured by the steps of the sixteenth embodiment are distributed in a range of 30.0±0.2 μm. When the ink jet head of the sixth embodiment is driven with 100V, at 5 Khz, the emitting speeds of ink drops are distributed in a range of 8±0.2 μm/sec, and ink drop volumes are in a range of $(0.1\times0.005)\times10^{-6}$ cc. This results in a good printing in conformance with the objects of the invention.

Embodiment 17

Figure 35:
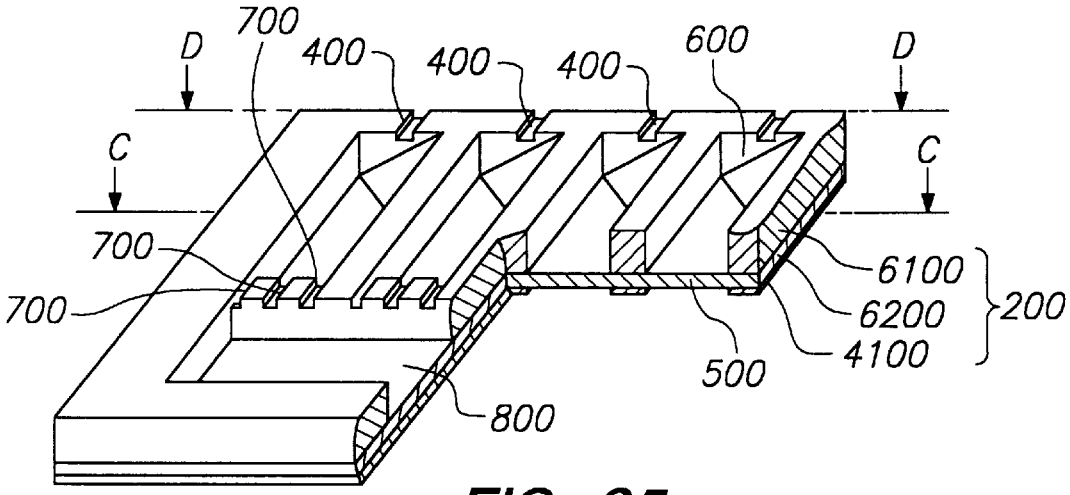
FIG. 35 is a perspective view of the middle substrate of the ink-jet head according to the seventeenth embodiment of the present invention.

FIG. 35 shows a partly-broken perspective view of the middle substrate used in the ink jet head according to the seventeenth embodiment of the present invention. The lower and upper substrates and the manufacturing method for these substrates are identical with that of the thirteenth embodiment. Thus, further explanations therof are omitted from the specification.

The middle substrate 200 of the seventeenth embodiment is obtained by etch treating a silicon substrate 6300 (FIG. 36) formed by an epitaxially growing of n-type Si layer 6200 on the bottom face of the p-type silicon substrate 6100. The crystal face direction of p-type silicon substrate 6100 is (110). As is well known, in a (110) arrangement, the (111) face perpendicularly crosses to the substrate (110) face in direction (211) and an alkali anisotrophy etching process will enable one to form a wall structure oblique to the substrate face.

The seventeenth embodiment uses this property to narrow each chamber and pitch distances to realize a high density arrangement of the nozzles.

The manufacturing steps of the middle substrate of the seventeenth embodiment are shown in FIGS. 36A to 36G.

The steps shown in FIGS. 36A to 36D correspond to that of the C—C line sections of FIG. 35 and steps of FIGS. 36E to 36G correspond to the D—D line sections of FIG. 35.

First, both the faces of the silicon wafer of p-type (110) face direction are mirror-polished to form a silicon substrate 6100 of a thickness 170 mm. An n-type Si layer 6200 of 3 μm is formed on the bottom face of the silicon substrate 6100 by an epitaxial growth step to form the silicon substrate 6300 (see FIG. 36A). Preferably, the silicon substrate 6100 is doped with B (boron) of density $4\times10^{15}/cm^3$, and the n-type Si layer 62 is doped with Al of density $5\times10^{14}/cm^3$. In the epitaxial growth step, it is possible to control the target thickness of 3 μm within a ±0.05 μm tolerance.

Next, the silicon substrate 6300 is thermally oxidized-treated at 1100° C. in an oxygen and steam atmosphere in order to form $SiO_2$ membranes 4100*a* and 4100*b* of the thickness 1 μm on both the faces of the silicon substrate 6300 (see FIG. 36B).

A photo-resist pattern (not shown) corresponding to the shapes of cavities and ink cavity, etc. is formed on the upper $SiO_2$ membrane 4100*a*. Also, a photo-resist pattern (not shown) corresponding to an electrical lead opening portion 6400 is formed on the lower $SiO_2$ membrane 4100*b*, and the exposed portions of the $SiO_2$ membranes 4100*a* and 4100*b* are etched by fluoric acid to remove the photo-resist pattern (see FIG. 36C).

As the size of the photo-resist patterns correspond to the shape of the emitting chamber 600, its width is 50 μm. Also, the distance from the neighboring pattern is 20.7 μm to give a 70.7 μm pitch distance. In turn, the ink drop density per inch is 360 dpi (dots per inch).

Next, the electro-chemical anisotrophy etching process, previously mentioned in conjunction with the sixteenth embodiment, is applied to the silicon substrate 6300. Etching is done until the exposed portions of p-type silicon substrate 6100 are completely etched away (see FIG. 36D). The dents formed in the step shown in FIG. 36D consist of perpendicular walls relative to the surfaces of the silicon substrate 6300.

The electro-chemical anisotrophy etching process forms a photo-resist pattern (not shown) corresponding to the nozzles 400 and the orifices 700 on the $SiO_2$ membrane 4100*a* which, by now, has itself etched partially away. A photo-resist membrane (not shown) covers all the lower $SiO_2$ membrane 4100*b*. Application of a fluoric acid etching agent etches the exposed portion of the $SiO_2$ membrane 4100*a*, and the photo-resist pattern is removed (see FIG. 36E).

Next, similarly with the steps shown in FIG. 36D, an electro-chemical etching process etches the substrate until the nozzles 400 and the orifices 700 of thickness 30 μm are formed (see FIG. 36F).

Last, the whole silicon substrate is dipped in fluoric acid to remove $SiO_2$ membranes 4100*a* and 4100*b* in order to obtain the middle substrate 200 (see FIG. 36G). The width of the emitting chamber formed on the resulting middle substrate becomes 55 μm, which is a little enlarged by undercutting during the etching step. The pitch distance is 70.7 μm, so it is said the middle substrate obtained has ideal measurements for maximizing nozzle density. The most suitable value of the width of the cavity is determined due to desired ink emitting characteristics. Considering the undercutting, the size of the photo-resist pattern is calculated to obtain the ideally shaped cavity.

Embodiment 18

FIG. 37 is a partly-broken perspective view of the middle substrate of the ink jet head according to the eighteenth embodiment of the present invention. Here, diaphragm 500 is a boron doped layer 6600 having a thickness identical to that necessary for the diaphragm 500 to optimally function. It is known to those ordinarily skilled that the etching rate of alkali used in the diaphragm Si etching step becomes very small when the dopant is a high density (about $5\times10^{19}/cm^3$ or greater) boron.

According to the eighteenth embodiment, the forming range assumes a high density boron doped layer. When an alkali anisotrophy etching forms the emitting chamber 600 and the ink cavity 800, a so-called "etching stop" technique is observed in which the etching rate greatly lessens at the time the boron doped layer 6600 is exposed. This forms the diaphragm 500 and emitting chambers 600 of necessary shape.

The manufacturing steps of the middle substrate according to the eighteenth embodiment of the present invention are shown in FIGS. 38A to 38E.

First, the faces of a silicon wafer of n-type (110) face direction are mirror-polished in order to form a silicon substrate 6500 of a thickness 200 μm. Then, the silicon substrate 6500 is brought under a thermal-oxidization treatment of 1100° C. for 4 hours in an oxygen and steam atmosphere so as to form $SiO_2$ membranes 4100*a* and 4100*b* of thickness 1 μm on both the faces of the silicon substrate 6500 (see FIG. 38A).

Next, a photo-resist pattern (not shown) corresponding to the shapes of the diaphragm (boron doped layer) 6600, ink cavity 800, and electrode leads (not shown) is deposited on the lower $SiO_2$ membrane 4100*b*. The exposed portion (parts corresponding to the diaphragm, ink cavity, leads) of the $SiO_2$ membrane 4100*b* is thereafter etched by fluoric acid etching agent and the photo-resist pattern is removed (see FIG. 38B). With regard to n-type silicon substrates such as substrate 6500, the etching process proceeds at an etching rate of about 1.5 μm/minutes However, in the boron high density range, e.g., diaphragm 6600, the etching rate lowers to about 0.01 μm/minutes.

Because the thickness (designed value) of the diaphragm 500 (6600) is 10 μm, it is sufficient to etch and remove only 190 μm of the total thickness 200 μm of the silicon substrate 6500 in order to form the emitting chambers 600 and the ink cavity 800. In practice, it is conventionally difficult to make the thickness of the diaphragms 500 uniform, since the thickness of the base silicon substrates 6500 can vary (±1 to 2 μm).

According to the eighteenth embodiment, the process described herein below can form the thickness to the diaphragms correctly.

It is necessary to etch the silicon substrate for about 126 minutes, 40 seconds in order to etch and remove 190 μm of a thickness of the silicon substrate. In order to etch a thickness 10 μm, an etching step applied for about 6 minutes, 40 seconds is necessary. And, in order to etch and remove 200 μm thickness, a total time of 133 minutes 20 seconds is needed.

On the silicon substrate 6500 of the condition shown in FIG. 38D, an etching step of total time of about 133 minutes 20 seconds using the etching agent is done. After the etching process is started, and about 126 minutes 40 seconds has elapsed, about 190 μm of etching is done on the emitting chamber and the face undergoing etching (not shown) reaches to the boundary of the boron doped layer 6600. Meanwhile, the etching end detection pattern 7100, similarly about 190 μm has been etched. Thereafter, an etching of about 6 minutes 40 seconds is carried out. If the etchant does not reach the boron doped layer 6600, it proceeds at an etching rate of similarly 1.5 μm/minutes This is the case with the etching end detection pattern 7100. However, when the etchant reaches the boron doped layer 6600, the etching rate suddenly drops to about 0.01 μm/minutes Consequently, during the entire 6 minute time period, the boron doped layer 6600 is not noticeably etched, leaving a diaphragm 500 having a boron doped layer of thickness 10 μm.

On the contrary, on the etching end detection pattern 7100, the etching step advances at an etching rate of about 1.5 μm/minutes At last, after the etching for a total time of about 133 minutes 20 sec, a through hole 72 is formed, signaling stoppage of etching.

As described above, the etching time necessary to make this through hole is distributed owing to various thicknesses of the silicon substrate 6500, So, it is necessary to detect when the through hole 7200 is completed at the time of about 133 minutes being elapsed after the etching starts through various means (for example, observation by the operator or applying a laser beam on the etching end detection pattern from one side of the pattern and receiving the laser beam by a light receiving element placed on the opposite side of the pattern when the through hole is completed, see FIG. 38E).

Next, similar to that of the thirteenth embodiment, a pattern machining for restricting the distances between electrodes formed on the lower substrates is carried out so as to obtain the middle substrate 200.

Notwithstanding that the silicon substrate 6500 has various thickness portions, the diaphragm 500 formed by the process about has a precision of 10±0.1 μm. Such error or allowance of ±0.1 μm appears to depend on distribution of the boron doping and doping depth, and does not depend on application of a particular alkali enchant. Thus, according to the eighteenth embodiment, the precision of the thickness of boron doped layer determines the thickness precision of the diaphragm. In order to obtain the correct thickness precision in the range of about 10 μm thickness, it is the most preferable method to use $BBr_3$ as the diffusion source. However, other suitable methods known to those ordinarily skilled in the art can be used to attain the doped thickness precision corresponding to that obtained by $BBr_3$ diffusion.

According to the eighteenth embodiment, simultaneously with the boron doping step for the diaphragm, the doping is performed to those leads positioned on the diaphragm. Because of that, the driving electrodes having the structure identical with the diaphragm of the fourteenth embodiment, so it is possible also to attain an improvement in driving frequency (and ultimately print speed).

In addition, according to the eighteenth embodiment, an n-type substrate is used for the silicon substrate base material. However, if p-type substrate is instead used, it will become recognizable to an ordinary skill that it is still possible to form the boron doped diaphragms, using suitable n-type dopants.

The substrate anode-junction methods according to the present invention will be explained with reference to the following embodiments 19 to 22.

Embodiment 19

Figure 40:
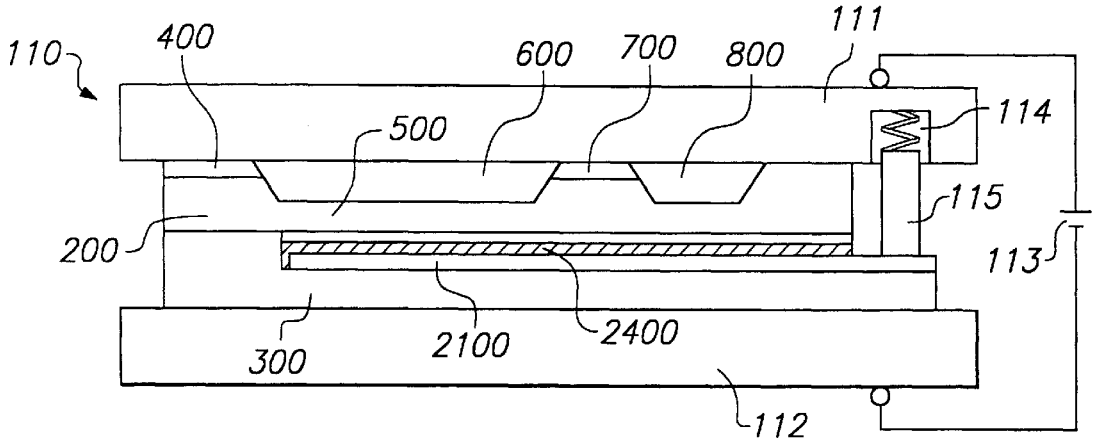
FIG. 40 is a sectional view of the nineteenth embodiment depicting an anode connecting apparatus used in the anode connecting process of the present invention.
Figure 41:
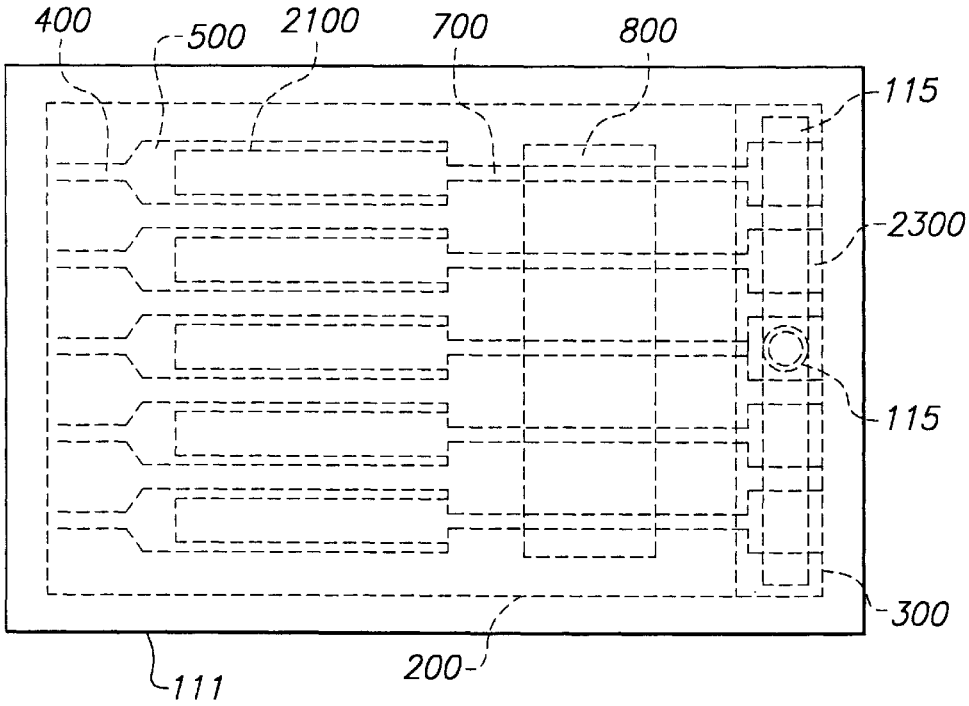
FIG. 41 is a plan view of the anode connecting apparatus shown in FIG. 40.

FIG. 40 shows an outline of the nineteenth embodiment of the present invention illustrating an anode bonding method. More particularly, it illustrates a section of a bonding apparatus used for the method and of the substrates undergoing bonding. FIG. 41 is a plan view of this bonding apparatus.

The nineteenth embodiment shown relates to an anode bonding method for bonding of a middle silicon substrate 200 and a lower boro-silicated glass substrate 300. The bonding apparatus consists of an anode bonding electrode plate 111 to be connected to a positive terminal of a power source 113, a cathode bonding electrode plate 112, and a terminal plate 115 protruding from the anode bonding electrode plate 111 through a spring 114. Gold plating is applied on the surfaces of the anode bonding electrode plate 111 and the cathode bonding electrode plate 112 in order to decrease contact resistance of the surfaces. The terminal plate 115 is constructed by a single contact plate in order to equalize in potential a plurality of electrodes 2100 on the boro-silicated glass substrate 300 and the silicon substrate 200. The terminal plate 115 is connected to the anode bonding electrode plate 111 by means of the spring 114 and the spring keeps the terminal plate 115 in suitable contact pressure with the electrode 2100. The terminal plate 115 comes to contact with the terminal portion 2300 of the electrode 2100.

The middle silicon substrate 200 and the lower boro-silicated glass substrate 300 are aligned as described hereinabove. In detail, each of the diaphragm 500 and the electrode 2100, respectively formed thereon are aligned by an aligner device (not shown) after they are washed. Then, they are set as shown in FIG. 40 and FIG. 41. During anodic bonding, the electrode 2100, and the electrode plates 111 and 112 are placed in nitrogen gas atmosphere in order to prevent the surfaces of them from being oxidized.

During this anode bonding method, first both the lower and middle substrates are heated. In order to prevent the boro-silicated glass substrate S from breaking due to a sudden rise of temperature, it is necessary to heat it gradually to 300° C. for about 20 minutes Next, the power source 113 applies a 500V voltage for about 20 minutes so as to bond together both substrates. During the anode bonding method, Na ions in the boro-silicated glass substrate 300 move and current flows through the substrate. It is possible to judge the joined condition of them when they are connected because a value of current decreases. In order to prevent strain-crack due to thermal conductivities of both the substrates after they are connected, it is necessary to cool them gradually for about 20 minutes It is possible to prevent discharging and electric field dispersion between the terminal plate 115 and the spring 114 by decreasing the potential difference between the electrode 2100 and diaphragm 500. This effectively minimizes the electric field. As a result, a large current does not flow between the electrode 2100 and the diaphragm 500 preventing the electrode 2100 from melting. Also, because that static electricity attractive force due to electric field will not appreciably occur in the diaphragm 500, no additional stress is generated in the diaphragm 500 after it is secured through its circumference.

Without equalizing the electrode/diaphragm potentials, the dielectric membrane 2400 is charged with electrons transferred from the diaphragm 500 and produces an undesirable electric field. In the presence of such a field, the dielectric membrane 2400 endures static electricity attractive force along the direction of the diaphragm 500 and eventually causes the dielectric to peel off. However, when the electrode 2100 and the diaphragm 500 are made equal in their potential, it is possible to prevent the dielectric membrane 2400 from being peeled off, as no electric field is produced.

Embodiment 20

Figure 42:
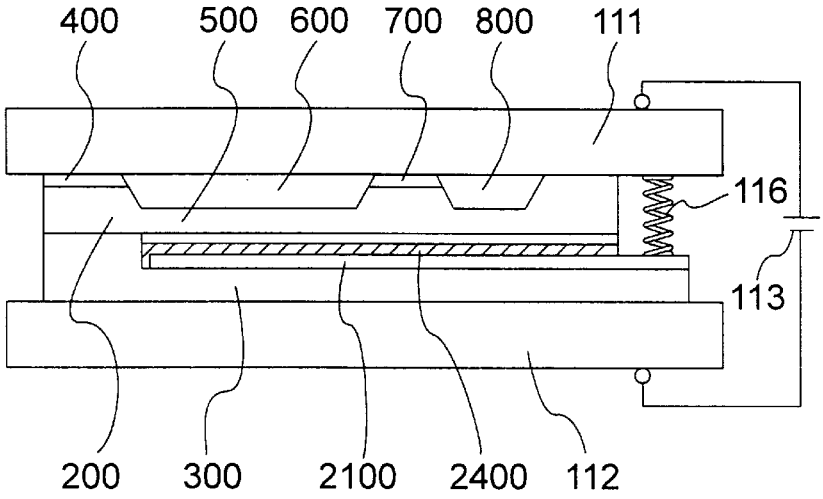
FIG. 42 is a sectional view of the twentieth embodiment depicting an alternative anode connecting apparatus used in the anode connecting process according to the present invention.
Figure 43:
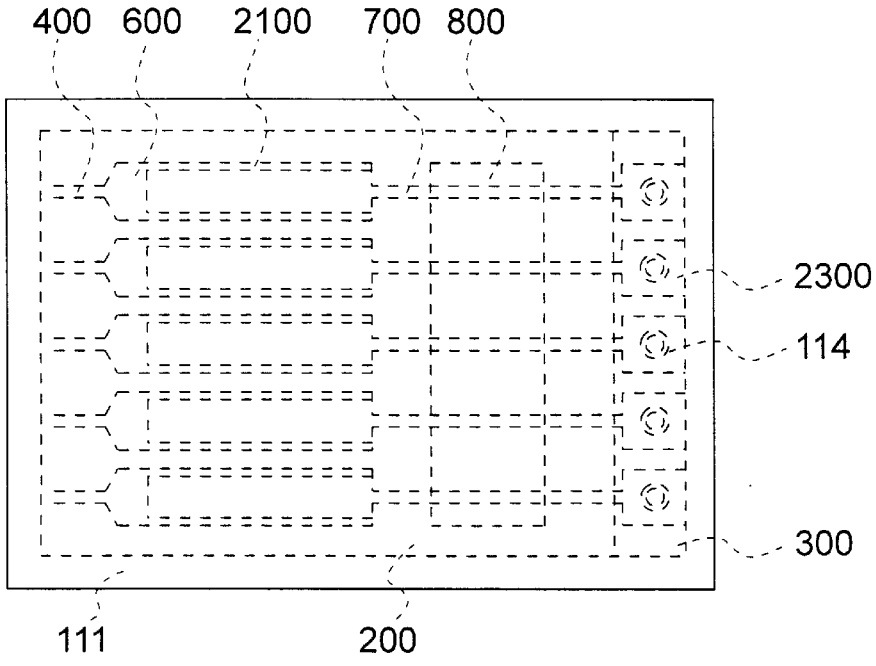
FIG. 43 is a plan view of the anode connecting apparatus shown in FIG. 42.

FIG. 42 is an outline view of another embodiment of the anode bonding method according to the present invention. FIG. 43 is a plan view of this bonding apparatus.

According to the twentieth embodiment, terminal 116s, consisting of coil springs, are used and the terminal plates contact with respective electrodes 2100. Otherwise, the structure of the embodiment is identical with that shown and described with reference to FIG. 24.

The terminals 116 are made of SUS, know for its durability at high temperatures. Ordinarily, SUS is not preferable to be used as terminal material because it has resistance on its surface produced by oxidized films. However, in the anode bonding, where the purpose is to apply high voltage and equalize potential differences, it is possible to obtain good results if the current is low. When respective terminals 116 are independent coil springs, it is possible to prevent the substrates from curving due to being heated as a consequence of the anode bonding process and are resistant to wear from repeated use.

Embodiment 21

Figure 45:
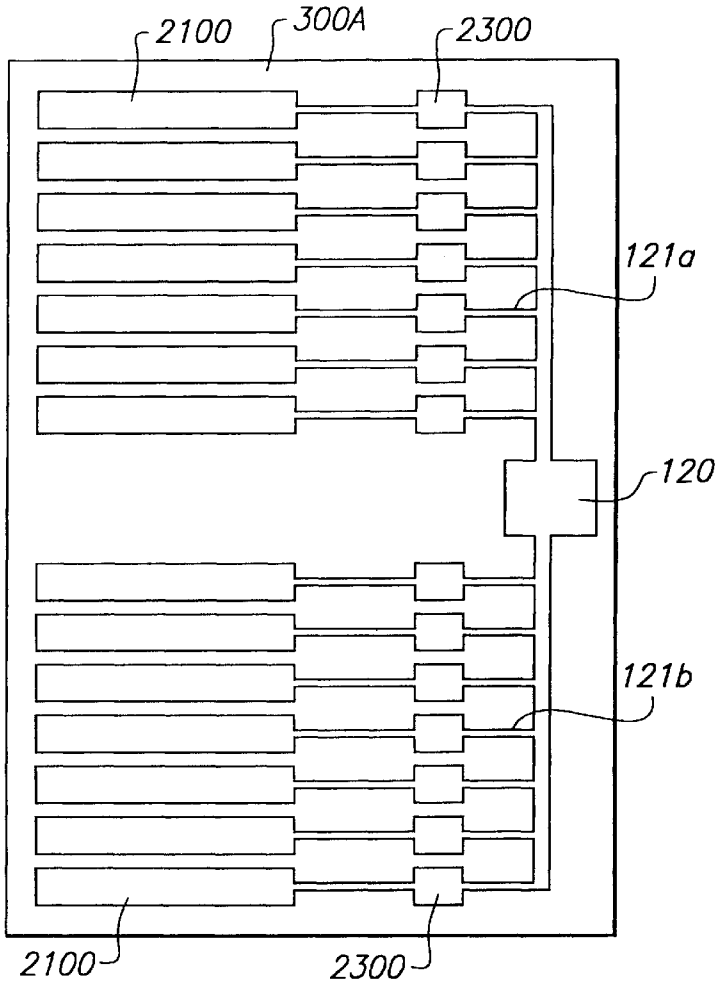
FIG. 45 is a plan view of the lower substrate shown in FIG. 44.
Figure 44:
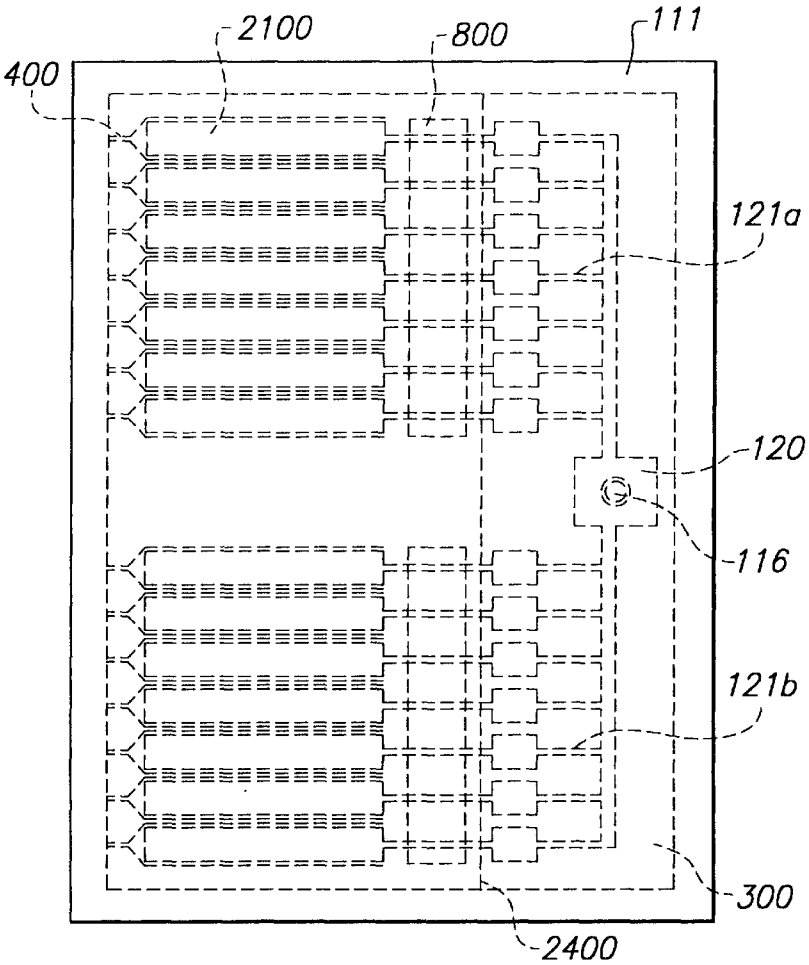
FIG. 44 is a plan view of the twenty-first embodiment depicting yet another anode connecting apparatus.

FIG. 44 shows a plan view of the anode bonding apparatus according to another embodiment of the present invention. FIG. 45 is a plan view showing the arrangement relation of the electrodes on the lower substrate to the common electrode. In FIG. 45, the dielectric membrane 2400 is omitted.

According to the twenty-first embodiment, a photolithography method which involves a batch treatment system is used in order to form simultaneously a plurality of electrodes 2100 for plural sets (in the embodiment, two) of ink jet heads and their respective electrode 2100 on a single boro-silicated glass substrate 300A. The common electrode 120 has lead portions 121*a* and 121*b* to be connected to the terminal portion 2300 of all the electrodes 2100. In addition, a single "middle" silicon substrate (not shown) to be connected to the boro-silicated glass substrate 300A has a plurality of sets of elements (nozzle, emitting chamber, diaphragm, orifice and ink cavity) having the structures shown in FIG. 40 and FIG. 42. Then, in the joining step, a single terminal 116 consisting of a coil spring shown in FIG. 26 comes to contact with the common electrode 120 in order to lead it to the anode-side joining electrode plate 111.

Consequently, it is possible to make all electrodes 2100 and all diaphragms of respective sets equal to each other in potential obtaining the same effect, as that described in the previous embodiments.

After they are connected, each set is cut by dicing a known method. The common electrodes 120 are cut off from the electrodes 2100 of respective sets by separating lead portions 121*a* and 121*b*.

Embodiment 22

Figure 46:
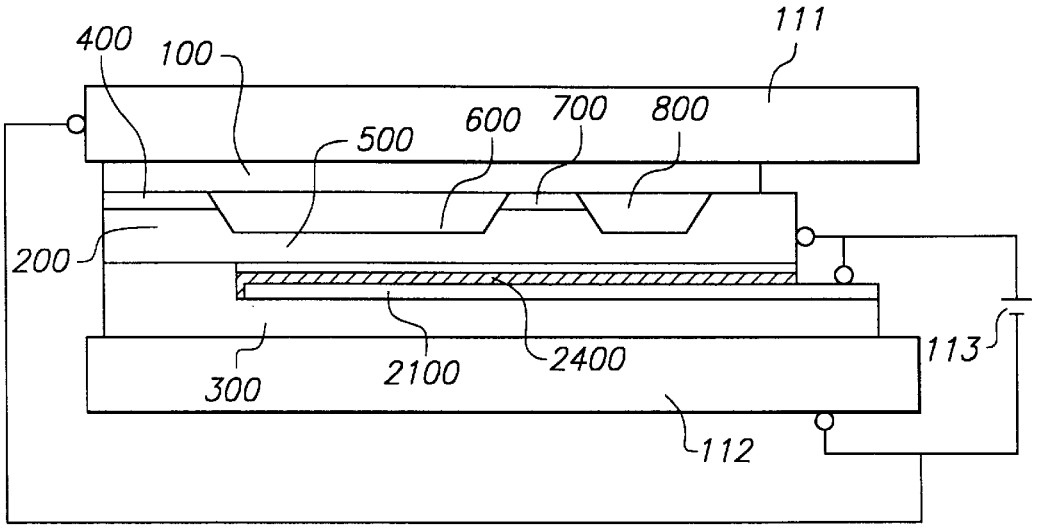
FIG. 46 is a sectional view of the twenty-second embodiment depicting still another anode connecting apparatus.

FIG. 46 is a section of an anode bonding apparatus according to still another embodiment of the present invention.

According to the twenty-second embodiment, three substrates 100, 200 and 300 are simultaneously anode-bonded to each other. The middle substrate 200 is of silicon, and the second and upper substrates, 200 and 300, are boro-silicated. The upper substrate 100 functions merely as a lid for nozzle holes 400, emitting chamber 600, orifice 700 and ink cavity 800. The bond between the upper 100 and middle 200 substrates is consequently less critical, so soda glass may be substituted for boro-silicated with respect to upper substrate 100. However, when the upper substrate is made of boro-silicated glass, it is possible to improve its reliability.

In accordance with the twenty-second embodiment, upper and lower joining electrode plates 111 and 112 to be contacted with the lower and upper boro-silicated glass substrates 300 and 100 are connected to a negative terminal of the power source 113, the middle silicon substrate 200 and the electrode 2100 on the boro-silicated glass substrate 300 are connected to the positive terminal of the power source 113. Then, they are simultaneously anode bonded. As a result, according to the simultaneous anode bonding process, it is possible to reduce the time used to heat and gradually cool the substrates 100, 200 and 300, thus effectively reducing the overall anode bonding processing time. Additionally, as described in regard to the nineteenth embodiment and the twenty-first embodiments above, it is possible to protect the surface on the silicon substrate 200 from being polluted by direct contact with the upper bonding electrode plate 111.

In the twenty-third and twenty-fourth embodiments below, structures preventing dust from invading into the gap portion during anodic bonding are formed. Here, a static electricity actuator is exemplified.

Embodiment 23

Figure 47:
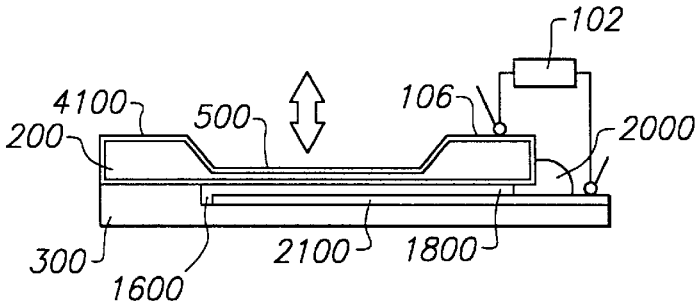
FIG. 47 is a sectional view of the twenty-third embodiment of the present invention which incorporates dust prohibition.
Figure 48:
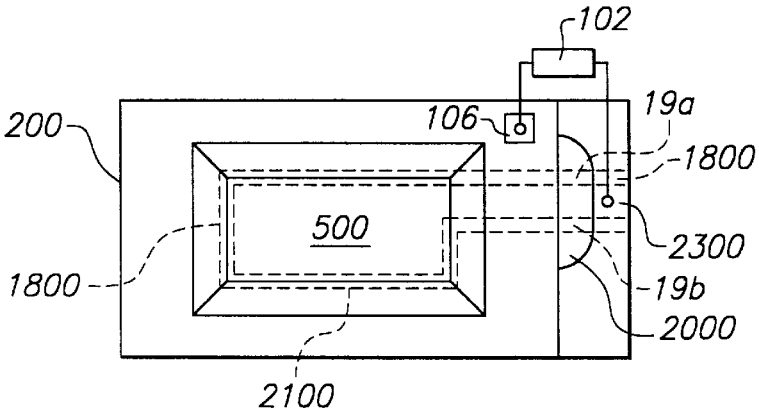
FIG. 48 is a plan view of the embodiment shown in FIG. 47.

FIG. 47 is a section of a static electricity actuator similar to that of the thirteenth embodiment of the present invention. FIG. 48 is its sectional view.

As is apparent from the previous embodiments, the middle substrate 200 and the lower substrate 300 are direct Si bonded or anode bonded with respect to a predetermined gap length. Because a temperature when the anode bonding or bonding process is done is high, air in the gap portion 1600 expands. When air temperature lowers to the room temperature after bonding, the pressure in the gap portion 1600 lowers to less than that of the ambient atmosphere, so the diaphragm 500 bends toward the electrode 2100, eventually coming into contact with the electrode 2100 and being short-circuited. Also, unnecessary stress may be imparted on the diaphragm 500. Further, when the gap portion 1600 is open to the atmosphere in order to prevent such disadvantageous effects and kept at such open conditions, static electricity in the gap portion and the surrounding mechanism sucks in dust. As a result, such dust attaches to the electrode 2100, thereby changing the vibration characteristic of the vibrating chamber.

In order to solve these problem, an epoxy sealant is applied to the cooling vents of each vibrating chamber formed when substrates 200 and 300 are joined by anodic bonding. Preferably, the sealant will allow air to pass between the outside air and the vibrating chamber when the substrates 200 and 300 are still relatively hot (due to anodic bonding). However, the sealant will begin to seal off the chamber starting at a particular chamber and eventually plug off the vent as the structure cools to room temperature.

More particularly, in reference to FIGS. 47 and 48, these figures depict the ink jet head of the thirteenth embodiment after application of a suitable sealing epoxy. Gap portion 1600 is open to the atmosphere through the passage 1800. Immediately after anodic bonding and while the ink jet head is still hot, outlet ports 19*a* and 19*b* of the passage 1800 are sealed by sealer agent 20 of epoxy or like material which has a high viscosity when the substrates 200 and 300 are cooled to the room temperature after anode-bonding.

Reference numerals 2300 indicate a terminal portion of the electrode 2100. 4100 relates to an $SiO_2$ membrane or a dielectric membrane formed on the middle substrate 200, 102 relates to an oscillation circuit, and 106 is a metal membrane formed to connect one terminal of the oscillation circuit 102 to the middle substrate. Passage 1800 extends to surround the electrode 2100.

Because the silicon substrate constituting the middle substrate 200 has a high thermal conductivity, the sealer 2000 is preferably made of thermal plastic resin. Because sealing member 20 has a high viscosity, it fails to flow-in to the passage 1800.

Consequently, according to the twenty-third embodiment of the present invention, the gap portion 1600 is open or led to the atmosphere through the passage 1800 while undergoing anode bonding, so that any heating caused by the anode-bonding operation fails to raise the pressure in the gap portion 1600. After anode-bonding is finished and the temperature lowers to the room temperature, the sealing member 20 flows and seals the outlet of the passage 1800, preventing dust from invading the gap portion 1600. The aforesaid effect is also available if a gaseous body such as nitrogen, argon, etc. is enclosed in said gap portion 1600 when it is sealed.

Embodiment 24

Figure 49:
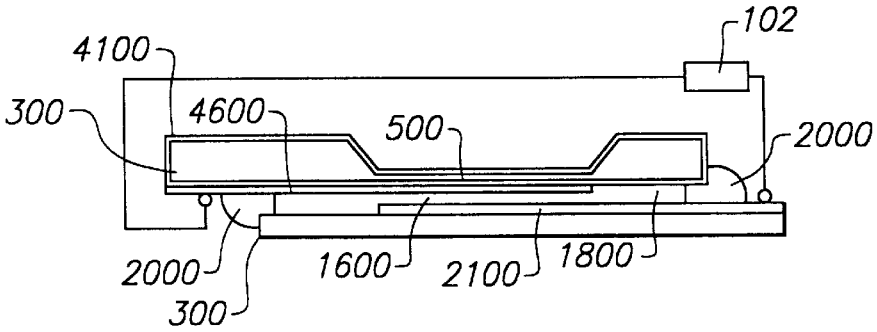
FIG. 49 is a sectional view of the twenty-fourth embodiment which includes dust prohibition according to the invention.

FIG. 49 depicts a section of the static electricity actuator according to another embodiment of the present invention.

According to the twenty-fourth embodiment, the static electricity actuator has a second electrode 4600 placed under the diaphragm 500 so as to oppose to the electrode 2100. The second electrode 4600 is preferably made of Cr or Au, arranged as a thin membrane.

The static electricity actuator functions as a capacitor. When "V" volts are applied across the opposed electrodes 2100 and 4600, Vc, the voltage between the opposed electrodes 2100 and 4600 behaves according to the following equations:

$$Vc=V(1-\exp(-t/T)) \text{ charging time}$$

$$Vc=V\exp(-t/T) \text{ discharging time}$$

Wherein T: time constant.

It is apparent from the equations above that they involve exponential functions. When the time constant T is large, rising speed of Vc is made slow. The time constant T is given by an equation RC (wherein the resistance is R and static electricity capacitance is C). Because a resistance of silicon is higher than metals, the electrode 46 of Cr or Au thin membrane having low resistance is used as a diaphragm 500 so as to drive the ink jet head at a high speed. When the time constant is made low, responsibility of the actuator improves.

Embodiment 25

Figure 50:
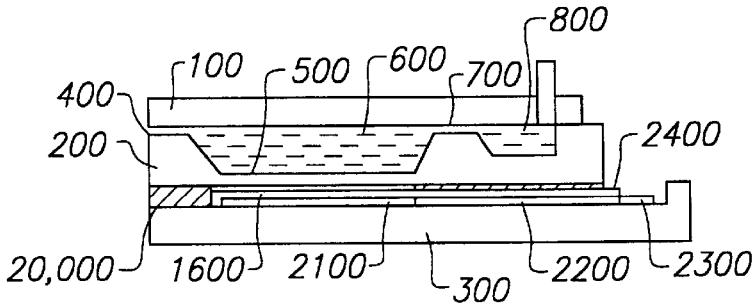
FIG. 50 is a sectional view of embodiment twenty-five according to the present invention.

FIG. 50 shows a section of the ink jet head according to still another embodiment of the present invention.

In the twenty-fifth embodiment, the gap G to be formed under the diaphragm 500 is kept by a thickness of photosensitive resin layer or adhesive agent layer 20,000. That is, patterns of the photosensitive resin layer or adhesive agent layer 20,000 are printed around the electrode 2100 of the lower substrate 300 and both the lower substrate 300 and the middle substrate 200 are adhered to each other making a lamination. In practice, soda glass is used as the lower substrate 300 and it is constructed as described in the twelfth embodiment.

A photo-sensitive polymid is used as a photo-sensitive resin and is printed around the electrode 2100 of the lower substrate 300 forming the pattern 20,000 of photo-sensitive resin layer. While similar to that of the twelfth embodiment, the bottom face of the middle silicon substrate 200 is plainly polished and the middle substrate 200 and lower substrate 300 are laminated. As a result, when the photo-sensitive resin is used, the gap length G between the diaphragm 500 and the electrode 2100 is 1.4 μm. When an adhesive agent of epoxy bond is used, its thickness G is 1.5 μm, and the substrates 200 and 300 are laminated at a temperature of 100° C. In this case, the gap length G is a little less than 1.9 μm. When an adhesive agent is used, it is necessary to press together the substrate 200 and other substrate 300, so the gap length G decreases from that of the photo-sensitive resin.

It is possible to use such a gap holding means of photo-sensitive resin and adhesive agent to keep the predetermined length or thickness of the gap. It is noted that the ink jet head of the present invention using such gap holding means can be driven by a low voltage identical with that of the twelfth embodiment attaining a good printing result. Of course, this type of ink-jet head is simple to produce.

Not only polymid but also other materials of photo-sensitive resin such as acrylic, epoxy and the like can be used. Temperature of thermal treatment is controlled according to the kind of various resins. With regard to adhesive agents, acrylic, cyano, urethane, silicon or other like various materials can be substituted with equal effect.

Embodiment 26

Figure 52:
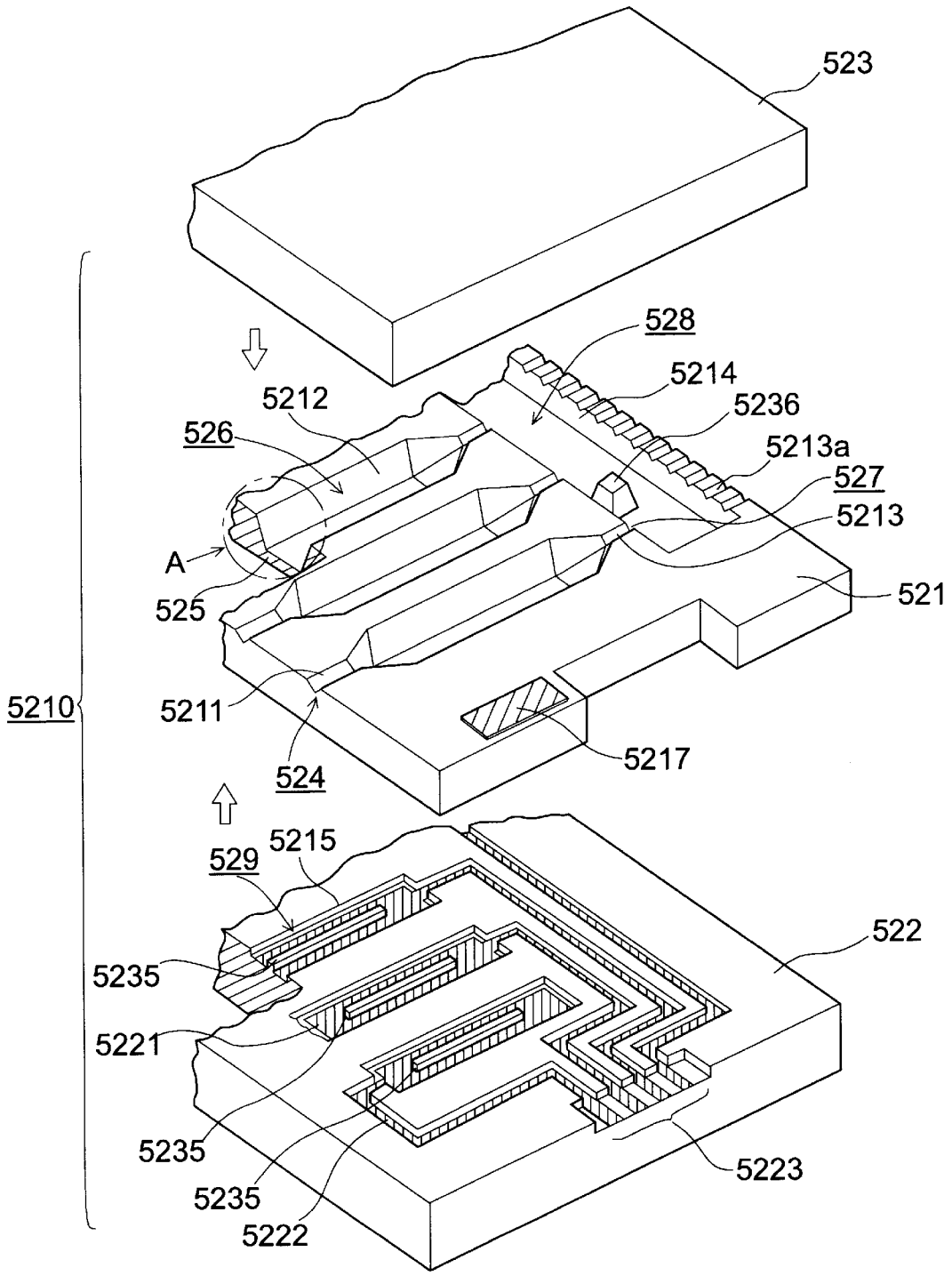
FIG. 52 is a partially exploded perspective view of an inkjet head according to the preferred embodiment of the present invention.

FIG. 52 is a partially exploded perspective view of an inkjet head according to the present invention. As shown therein, the inkjet head is an edge ejection type inkjet head whereby ink droplets are ejected from nozzles provided at the edge of the substrate. As will be appreciated by one of ordinary skill in art, the inkjet head may be implemented by a face ejection type inkjet head, whereby the ink is ejected from nozzles provided on the top surface of the substrate.

Referring specifically to FIG. 52, the inkjet head 5210 in this embodiment comprises a laminated construction having three substrates 521, 522, 523 structured as described in detail below. The first substrate 521, arranged between substrates 522 and 523, is a silicon wafer comprising plural parallel nozzle channels 5211 formed on the surface of and at equal intervals from one edge of substrate 521 to form plural nozzles 524; recesses 5212 continuous to the respective nozzle channel 5211 and forming ejection chambers 526, of which the bottom is diaphragm 525; narrow channels 5213 functioning as the ink inlets and provided at the back of recesses 5212; and recess 5214 forming common ink cavity 528 for supplying ink to each ejection chamber 526. Ink inlets 5213*a* are also disposed at the back of recess 5214. Each cross-sectional area of ink inlet 5213*a* is smaller than that of a nozzle 524, and functions as a filter for preventing the introduction of foreign matter to the ink in the inkjet head. As will be understood, narrow channels 5213 form orifices 527 when the first and third substrates are bonded together.

The relationship between the work functions of the semiconductor and metallic material used for the electrodes is an important factor affecting the formation of common electrode 5217 to first substrate 521. In the present embodiment the common electrode is made from platinum over a titanium base, or gold over a chrome base, but the invention shall not be so limited and other combinations may be used according to the characteristics of the semiconductor and electrode materials. Note that diaphragm 525 is formed by doping first substrate 521 with boron to stop etching and to form the diaphragms having a thin, uniform thickness.

Figure 53:
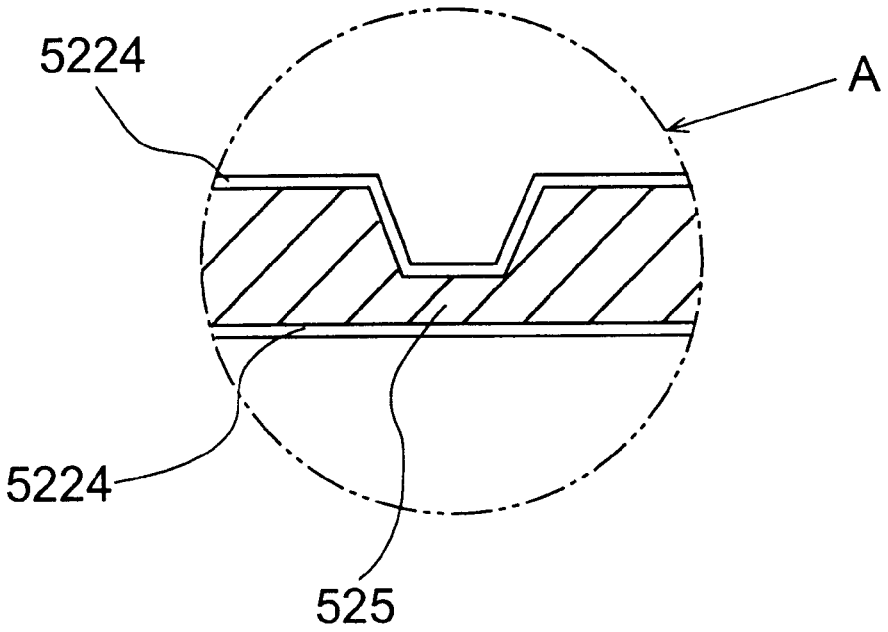
FIG. 53 is an enlarged cross-sectional view of A in FIG. 52.

FIG. 53 is an enlarged cross-sectional view. As shown therein, an oxide thin film 5224 approximately 1 μm thick is formed on the entire surface of first substrate 521 other than the common electrode 5217. Oxide thin film 5224 acts as an insulation layer for preventing dielectric breakdown and shorting during the driving of the inkjet head.

Substrate 522 comprises borosilicate glass bonded to the bottom surface of first substrate 521. Vibration chambers 529 are formed in the top of second substrate 522, and recesses 5215 comprising long, thin support member 5235 are disposed in the middle of second substrate 522. Alternatively, support member 5235 may not be provided if sufficient rigidity for ink ejecting is obtained by forming diaphragm 525 with sufficient thickness. It is preferable to provide support members 5235 when the diaphragm is very thin. It is difficult to form diaphragms having about 5–10 μm thickness due to following reason. The diaphragm having 1–4 μm thickness can be obtained by forming an etch stop layer doped with high density boron and that a support member having a thickness greater than 10 μm can be obtained by keeping an etching time. So, it is difficult to obtain 5–10 μm thickness diaphragms precisely by applying conventional etching methods. The diaphragm produced by using an etch stop layer does not have sufficient rigidity for ink ejection. Therefore, the support member, that is shortened a span of a beam, is formed in the vibration chamber. On other hand, the diaphragm having above 10 μm thickness preferably does not require the support member.

In the preferred embodiment, a gap holding means is formed by vibration chamber recesses 5215 formed in the top surface of second substrate 522 such that the gap between diaphragm 525 and the individual electrode disposed opposite thereto, i.e., length G (see FIG. 54; hereinafter the "gap length") of gap member 5216, is the difference between the depth of recess 5215 and the thickness of the electrode 5221. It is to be noted that recesses 5215 may be formed in the bottom of first substrate 521 as an alternative embodiment of the invention. In the present embodiment, recess 5215 is etched to a depth of 0.3 μm. The pitch of nozzle channels 5211 is 0.2 mm, and the width is 80 μm.

In the preferred embodiment, this bonding of second substrate 522 forms vibration chamber 529. Moreover, individual electrodes 5221 are formed by sputtering gold on second substrate 522 at positions corresponding to diaphragm 5 to a 0.1 μm thickness in a pattern surrounding support members 5235 and essentially matching the shape of diaphragms 525. Individual electrodes 5221 comprise a lead member 5222 and a terminal member 5223. Terminal member 5223 is provided for connecting to external driving circuits. It will be appreciated by those skilled in the art that while electrodes 5221, 5222 and 5223 preferably consist of gold, other suitable materials, such as ITO or another conductive oxide film, may be substituted therefor.

The third and top substrate 523 comprises borosilicate glass and is bonded to the top surface of first substrate 521. Nozzles 524, ejection chamber 526, orifices 527, and ink cavity 528 are formed by this bonding of third substrate 523 to first substrate 521. Support member 5236 providing reinforcement is also provided in ink cavity 528 to prevent collapsing recess 5214 when first substrate 521 and third substrate 523 are bonded together.

Figure 54:
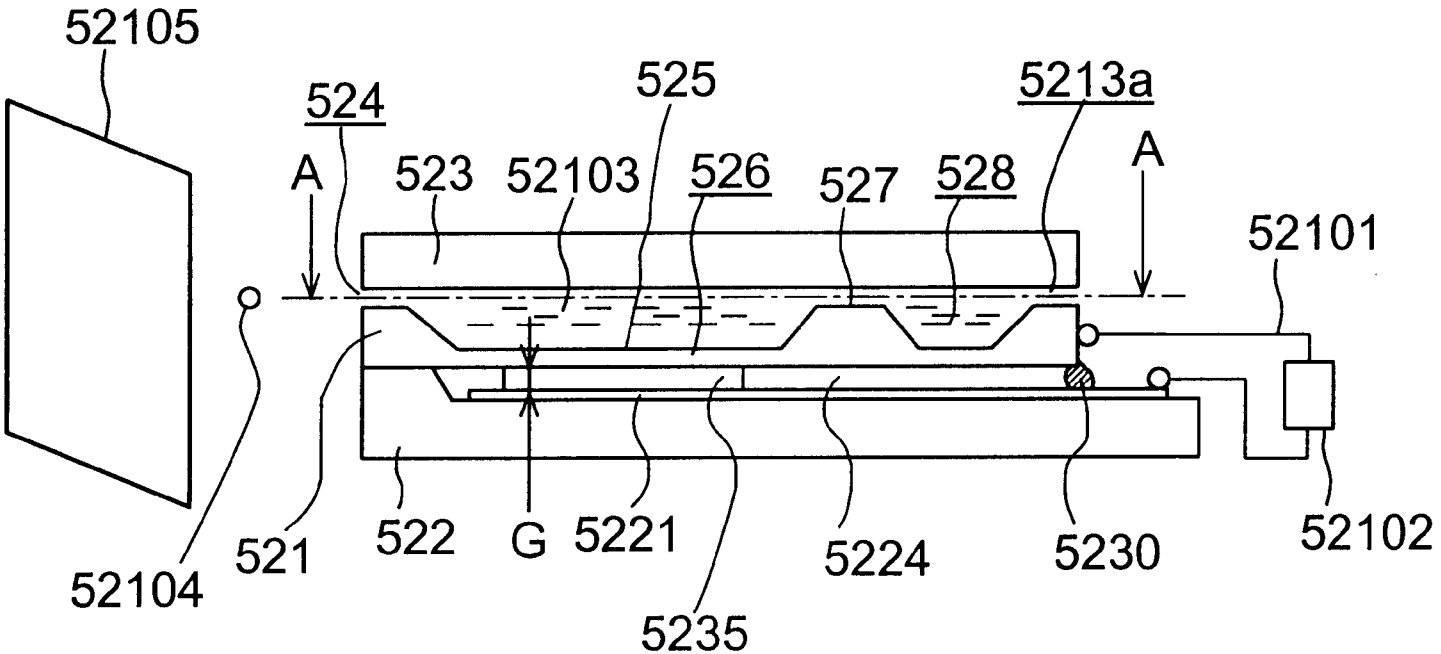
FIG. 54 is a side cross-sectional view of a complete assembled inkjet head according to the preferred embodiment of the present invention.

First substrate 521 and second substrate 522 are anodically bonded at 270–400° C. by applying a 500~800-V charge. Thus, first substrate 521 and third substrate 523 are then bonded under the same conditions to assemble the inkjet head as shown in FIG. 54. After anodic bonding, the gap length G formed between diaphragm 525 and individual electrode 5221 on second substrate 522 is the difference between the depth of recess 5215 and the thickness of individual electrode 5221, preferably 0.2 μm.

Figure 55:
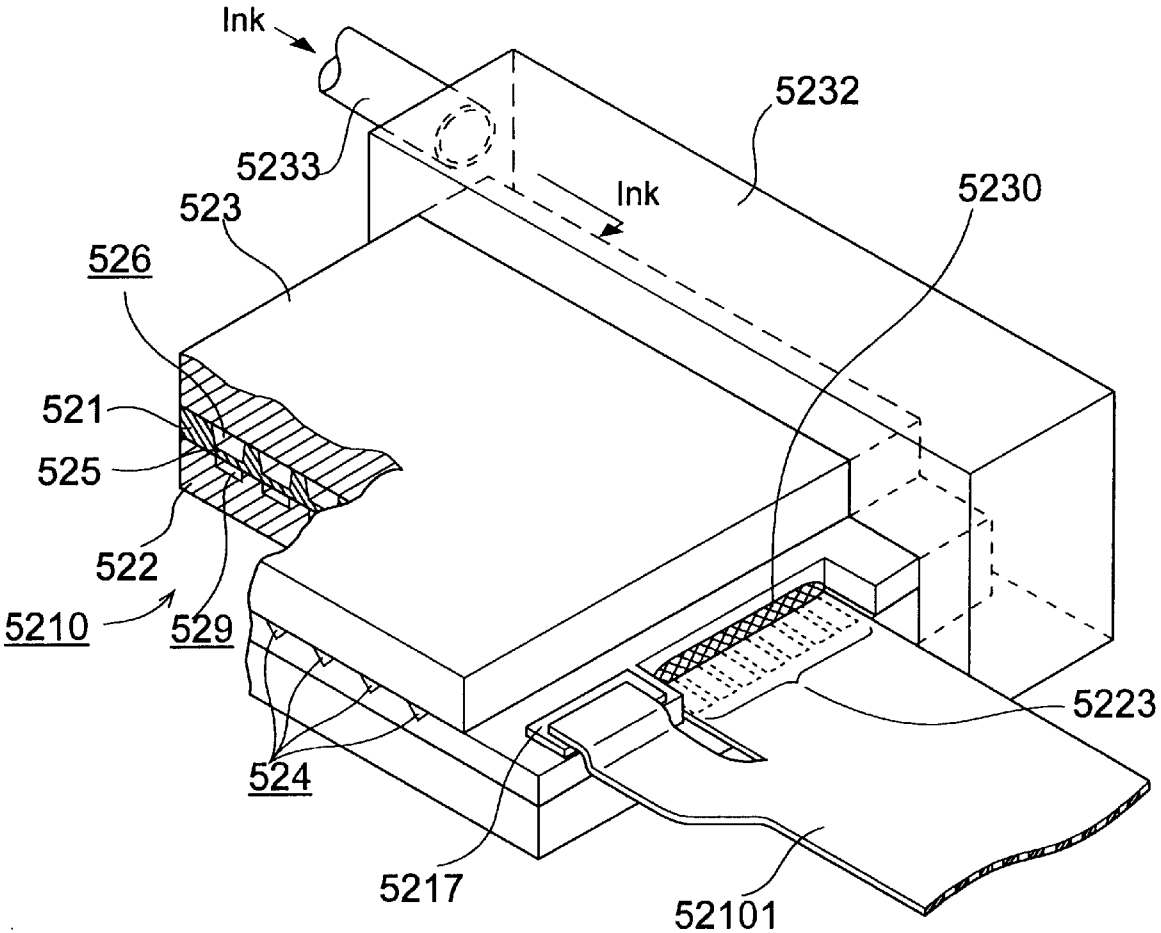
FIG. 55 is a perspective view of the assembled inkjet head.

After thus assembling the inkjet head, drive circuit 52102 is connected by connecting flexible printed circuit (FPC) 52101 between common electrode 5217 and terminal members 5223 of individual electrodes 5221 as shown in FIGS. 54 and 55, thus forming an inkjet printer. An anisotropic conductive film is preferably used in this embodiment for bonding leads 52101 with electrodes 5217 and 5223.

Nitrogen gas is also injected to vibration chambers 529, which are sealed airtight using an insulated sealing agent 5230. Vibration chambers 529 are sealed near terminal members 5223 in this embodiment, thus enclosing vibration chamber 529 and the volume of lead member 5222 within the volume of the actuator (this is described in greater detail hereinbelow).

Ink 52103 is supplied from the ink tank (not shown in the figures) through ink supply tube 5233 and ink supply vessel 5232 is secured externally to the back of the inkjet head into first substrate 521 to fill ink cavity 528 and ejection chambers 526. The ink in ejection chamber 526 becomes ink droplet 52104 ejected from nozzles 524 and printed to recording paper 52105 when inkjet head 5210 is driven, as shown in FIG. 54.

The present invention is characterized by thus sealing vibration chambers 529 within the actuator, and controlling the volume V of the actuator such that the maximum and minimum values of the ratio between the actuator volume V and the volume ΔV eliminated by a distortion of diaphragm 525 are within the range $2 \leqq V/\Delta V \leqq 8$. The derivation of this ratio V/ΔV is described in detail below.

Figure 57:
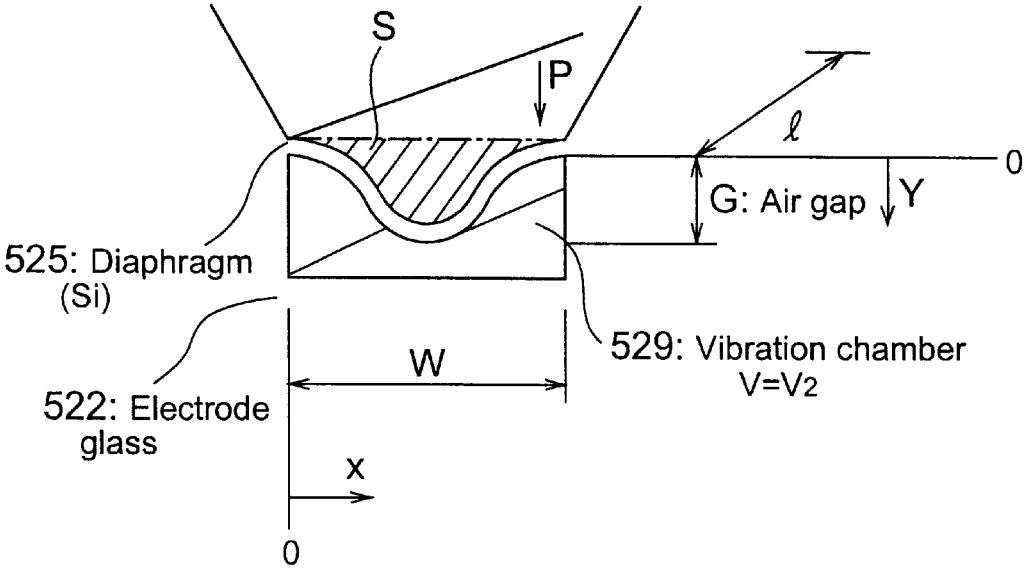
FIG. 57 depicts the operation of the diaphragm in the charged state and the derivation of the minimum limit value of the V/ΔV ratio.

FIG. 57 is used to describe the operation of diaphragm 5 and the derivation of the minimum limit value of the V/ΔV ratio.

Figure 58:
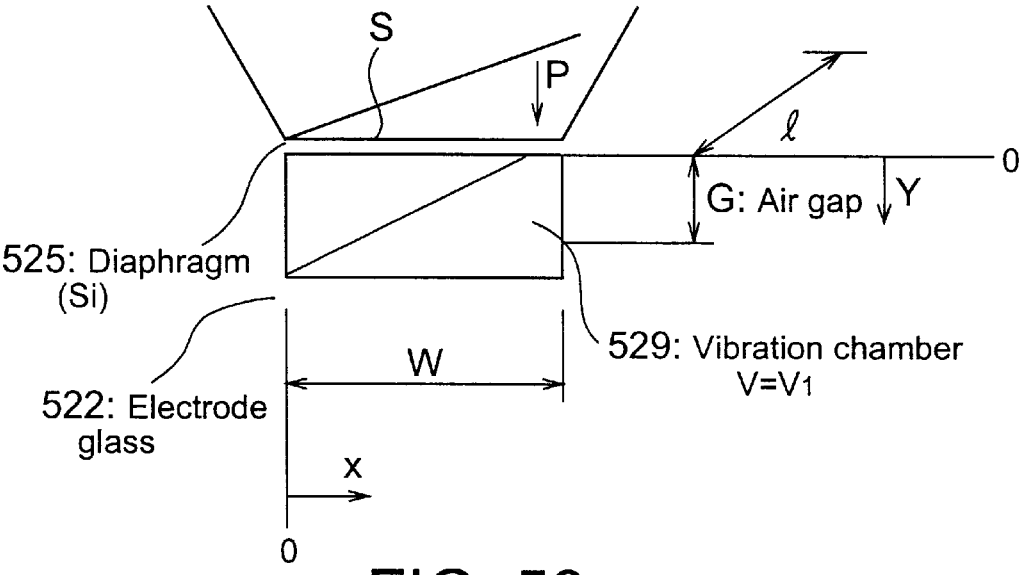
FIG. 58 depicts the operation of the diaphragm in the uncharged state.

Prior to the application of any voltage the volume of the vibration chamber is defined as $V_1$ (as shown in FIG. 58). When a drive voltage is applied to the actuator, the capacitor comprised by electrode 5221 and diaphragm 525 is charged, and the diaphragm 525 is attracted to electrode 5221 by electrostatic attraction force as shown in FIG. 57. This deflection causes increasing the volume of ejection chamber 526, while reducing the volume of vibration chamber 529 defined as $V_2$ by the displacement volume $\Delta V(=V_1-V_2)$. The reduced volume of the vibration chamber causes the pressure $P_0$ in the vibration chamber to increase by a pressure increment ΔP to an increased pressure $P_i$. When the drive voltage is removed and the capacitor is discharged, the diaphragm 525 returns to its initial state (where the diaphragm 525 and electrode 5221 are substantially parallel) in a short time. As a result, a portion of the displacement volume ΔV is utilized for ink ejection.

While the distortion of the diaphragm in response to the drive voltage is a function of time, unless otherwise specified, ΔV and ΔP as used in this specification refer to the respective maximum values, i.e. those immediately prior to removal of the drive voltage.

The deflection of the diaphragm is consistent with a formula of the deflection of a beam supported at both ends, and the displacement volume ΔV of vibration chamber 529 increased by deformation of diaphragm 525 is obtained by the following equations:

$$y(x) = \frac{P \cdot l \cdot x^2}{24EI}(w-x)^2 \quad \left[\begin{array}{c}\text{deflection of a beam}\\ \text{supported at both ends}\end{array}\right]$$

$$S = \int_0^w y(x)dx = \frac{P \cdot l \cdot w^5}{720EI}$$

$$\Delta V = S \cdot l = \frac{l^2 \cdot w^5}{720EI}P$$

where P is pressure; l, the length of diaphragm 525; G, the gap length; w, width of diaphragm 525; y(x) displacement of diaphragm 525; E module of elasticity; I moment of inertia; and S, surface area of the shaded area in the figure. Namely, pressure Pm caused by the resilience of the diaphragm, which represents a function of the displacement volume ΔV is obtained by the following equation.

$$Pm = \frac{720EI}{l^2 \cdot w^5}\Delta V = k\Delta V \qquad [1]$$

where k is a elastic coefficient of the diaphragm. The elastic coefficient k is greater than $8\times10^{11}$ (Pa/m$^3$) for the sufficient ink ejection in this embodiment.

The force of electrostatic attraction $P_e$ of the actuator, which represents a function of the diaphragm displacement y is obtained by the following equation:

$$P_e = \frac{\varepsilon_r \varepsilon_0}{2}\left(\frac{V_h}{G-y}\right)^2 \qquad [2]$$

where $\epsilon_0$ is the dielectric constant ($8.85\times10^{-12}$ (F/m) in a vacuum); $V_h$ is the applied voltage (=drive voltage); and $\epsilon_r$ is the relative dielectric constant. In this embodiment, $V_h$=35 V; $\epsilon_r$=approximately 1; and G=0.2 μm.

For a range of the diaphragm displacement y or the volume displacement ΔV, the minimum value of the difference between the electrostatic attraction Pe and the pressure Pm caused by the resilience of the diaphragm is obtained by the following:

$$(P_e-P_m)_{min.}=10.1\times104(P_a)=P_0 \text{ (atmospheric pressure).} \qquad [3]$$

Note that supposing $(P_e-P_m)_{min.}<0$, the sufficient electrostatic attraction could not be obtained even if the vibration chamber were exposed to the open air.

The increased pressure $P_i$ inside the vibration chamber with the displacement volume ΔV is obtained by the following equation:

$$P_0 V = P_i(V-\Delta V) \quad \text{[Boyle-Mariotte's law]} \qquad [4]$$

$$\therefore P_i = \frac{V}{V-\Delta V}P_0$$

where $P_0$ is the atmospheric pressure; and V is the actuator volume.

The pressure increment $P_i-P_0$ in the vibration chamber will be referred ΔP hereinafter.

To enable sufficient electrostatic attraction for the sufficient ink ejection, the minimum pressure difference $(P_e-P_m)$ min. must be always equal to or greater than the pressure increment ΔP associated with the displacement volume ΔV in the vibration chamber, i.e., the following equation must be satisfied.

$$(P_e-P_m)_{min.} \geqq \Delta P = P_i - P_0$$

with $(P_e-P_m)_{min.} \approx P_0$ it follows $$\therefore P_i - P_0 \leqq P_0, \text{ and } P_i \leqq 2P_0 \qquad [5]$$

When equation [2] is substituted for $P_i$ in equation [5] the ratio V/ΔV enabling inkjet head drive is expressed as:

$$\frac{V}{V-\Delta V}P_0 \le 2P_0 \quad [6]$$

$$\therefore \frac{V}{V-\Delta V} \le 2$$

$$V/\Delta V \ge 2.$$

As mentioned before, the lower limit for the ratio V/ΔV ensures that the pressure increment ΔP in the vibration chamber is sufficiently low, The derivation of the upper limit of V/ΔV is described below. The values shown in Table 1 are the design values for inkjet heads of various printing resolutions.

TABLE 1

V/ΔV ratio of inkjet head
Head gap G = 0.2 μm

| Head type | Head specifications: Resolution [dpi] | Nozzles [No.] | Ink vol. [μg/dot] | Size [mm] | Area [mm²] | Yield: 3" water [No.] | Vibrator size: Width [mm] | Length [mm] | ΔV [mm³] | V [mm³] | V/ΔV | $P_i$ [kgf/cm²] |
|---|---|---|---|---|---|---|---|---|---|---|---|---|
| 1. Edge ejection type 1 | 49.9 | 12 | 0.15 | 9 × 11 | 99 | 31 | 0.366 | 9 | 0.00035 | 0.00081 | 2.31 | 1.77 |
| 2. Edge ejection type 2 | 49.9 | 12 | 0.15 | 9 × 11 | 99 | 31 | 0.366 | 9 | 0.00035 | 0.00165 | 4.69 | 1.27 |
| 3. Face ejection type 1 | 90 | 12 | 0.15 | 9 × 9 | 81 | 37 | 0.262 | 6.7 | 0.00019 | 0.00135 | 7.20 | 1.16 |
| 4. Face ejection type 2 | 180 | 24 | 0.04 | 9 × 9.5 | 85.5 | 37 | 0.121 | 7.3 | 0.00009 | 0.00071 | 7.60 | 1.15 |
| 5. Face ejection type 3 | 360 | 48 | 0.04 | 9 × 18.5 | 163.5 | 17 | 0.051 | 17.4 | 0.00009 | 0.00069 | 7.40 | 1.16 |

•Edge ejection type 2 is designed so that the entire head area is used as the actuator wiring member (dummy V).
•Head chip slicing margin is 0.9 mm.
•Terminal positions of the individual electrodes and common electrodes in the head chip are assumed to be the same in all cases.
•Letter height is assumed to be the same in all cases (3.4 mm).

Figure 56:
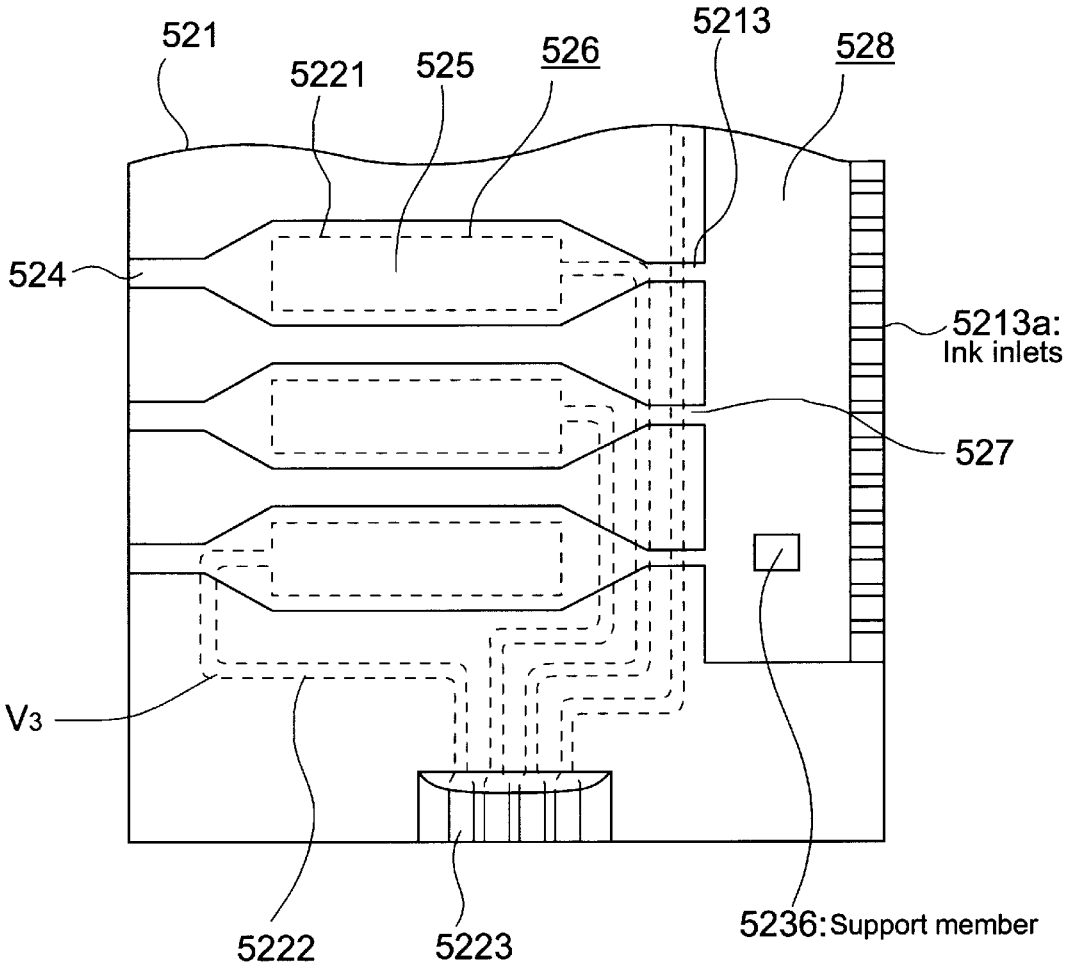
FIG. 56 is a plan view taken along line A—A in FIG. 54.

In Table 1, head types (1) and (2) are inkjet heads comprising silicon substrate having a (100) etching face for first substrate 521. In head type (1), the actuator volume includes the volume of vibration chamber 529 only and does not include any volumes related to the wiring (lead members and terminal members) connected to the electrode. In type (2), the actuator is sealed near the electrode terminals (see FIGS. 54 and 56), and the actuator volume includes the volume of the lead members ($V_3$) grooves (which functions as "dummy volume" for increasing the actuator volume) in addition to the volume of vibration chamber 529, thereby reducing the pressure increment ΔP in vibration chamber associated with the displacement volume ΔV. Head types (3), (4), and (5) are inkjet heads using a (110) face silicon substrate for first substrate 521 with the actuator volume similarly maximized by using the dummy volume inside the limited head size. Each of types (1)–(5) functions sufficiently as an inkjet head, and is designed or based on consideration to maximize the yield from each wafer.

In the case of head type (1), for example, the V/ΔV ratio is 2.31, and the increased pressure $P_i$ is 1.77 kgf/cm² ($17.3\times10^4$ $P_a$). If dummy volume is provided in this type of head without changing the head size, the V/ΔV ratio increases to 4.69 and the increased pressure $P_i$ drops approximately 30% to 1.27 kgf/cm² ($12.4\times10^4$ $P_a$) as shown in the type (2) head.

It is not possible to further reduce the increased pressure $P_i$ in the vibration chamber without increasing the head size. As such, the increased head size decreases the yield per wafer and results increased unit cost.

On the other hand, as resolution is increased the ΔV value also decreases because the ink ejection volume required for printing decreases compared with a low resolution head. Furthermore, in case of a multiple nozzle head, the dummy volume can be increased, and the V/ΔV ratio therefore increased, because the area of the electrode leads (lead member 5222, not including the electrode 5221) relative to the total head area increases.

For example, the area occupied by diaphragms is approximately 40% of the total area of head chip in the case of head types (1) and (2), but is approximately 25% in head types (3), (4), and (5). When the greatest possible dummy volume is disposed in these high resolution inkjet heads without sacrificing yield per wafer or inkjet head functionality, the V/ΔV ratio is ≦8.

It is not possible to obtain a V/ΔV ratio greater than 8 without increasing head size, and therefore decreasing the yield per wafer and increasing unit cost. Furthermore, a sufficient reduction in the pressure increment ΔP in the vibration chamber can be obtained with the V/ΔV ratio in the range ≦8, and a further increase in the V/ΔV ratio does not provide a significant increase in pressure reduction: for example, the increased pressure $P_i$ declines from 1.15 kgf/cm² ($11.3\times10^4$ $P_a$) to only about 1 kgf/cm² ($9.8\times10^4$ $P_a$). Therefore, the rational range for the V/ΔV ratio considering inkjet heads of various resolutions is 2≦V/ΔV≦8.

As will be apparent, while the present embodiment described above is sealed with nitrogen gas inside, the sealed gas of the invention shall not be so limited, and may alternatively be any (a) inert gas (e.g., He, Ne), (b) nitrogen gas, or (c) dry air that is chemically stable, and will not chemically react when the inkjet head is driven (during electrical discharge), causing the gas properties to change and corroding or damaging diaphragm 525 or individual electrode 5221. The preferred order of selection for these sealed gases is (a), (b), and (c) considering the performance requirements, but is (c), (b), (a) considering cost. It therefore follows that (b), nitrogen gas, is the preferred selection overall with respect to both performance and cost considerations. These sealed gases also prevent sparking or electrostatic discharge inside vibration chamber 529. This results in stable operation.

As will be understood from FIG. 52, while the volume of the vibration chambers can easily be made equal among all actuators, the individual lead members 5222 have different lengths. Moreover, when dummy volume is included within the total actuator volume, for example, it is possible to provide a suitable air chamber along or aside the lead member grooves related to lead member 5222 as a means of equalizing the total actuator volume. Namely, these grooves should preferably be dimensioned such that despite their different lengths each provides the same dummy volume, thereby all actuators of a multi-nozzle inkjet head have the same characteristic it is preferable that the respective actuator volumes are equalized.

By means of the invention thus described, the actuator is sealed or made airtight, and the actuator volume V is determined so that the ratio between actuator volume V and the volume ΔV eliminated by diaphragm 525 during inkjet head drive is within the range $2 \leqq V/\Delta V \leqq 8$. As a result, the intake of airborne particulate and penetration of particulate inside the head can be prevented during diaphragm operation, the increase in the internal actuator pressure can be minimized and sufficient electrostatic attraction can be assured because the actuator volume is sufficiently greater than the volume lost or reduced by diaphragm operation, and physical enlargement of the inkjet head can be prevented because a rational upper limit is imposed on the actuator volume V. As a result, an inkjet head providing excellent print quality and reliability can be provided because the affects of air resistance are minimal, and electrostatic attraction sufficient to reliably drive the diaphragm for ejecting ink can be assured.

It is furthermore possible by means of the invention thus described to avoid enlargement of the actuator because the volume of the lead member is contained within the volume of the actuator. Sparking or electrostatic discharges during inkjet head drive can also be avoided, and stable operation obtained, by sealing a gas inside the actuator.

Presently Preferred Embodiments

Figure 59:
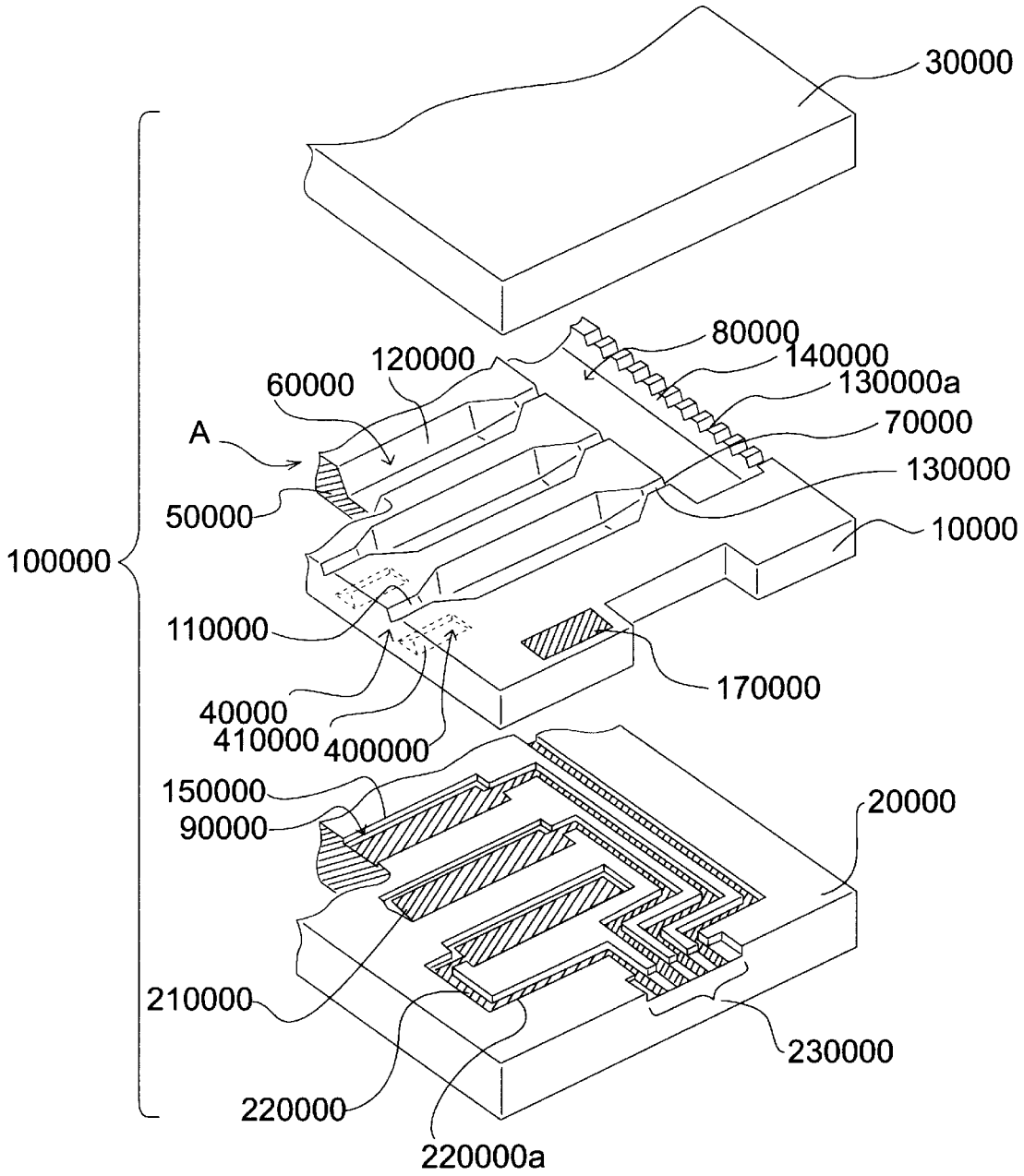
FIG. 59 is a partly exploded perspective view partly in section of an ink jet head according to a presently preferred embodiment of the present invention.
Figure 60:
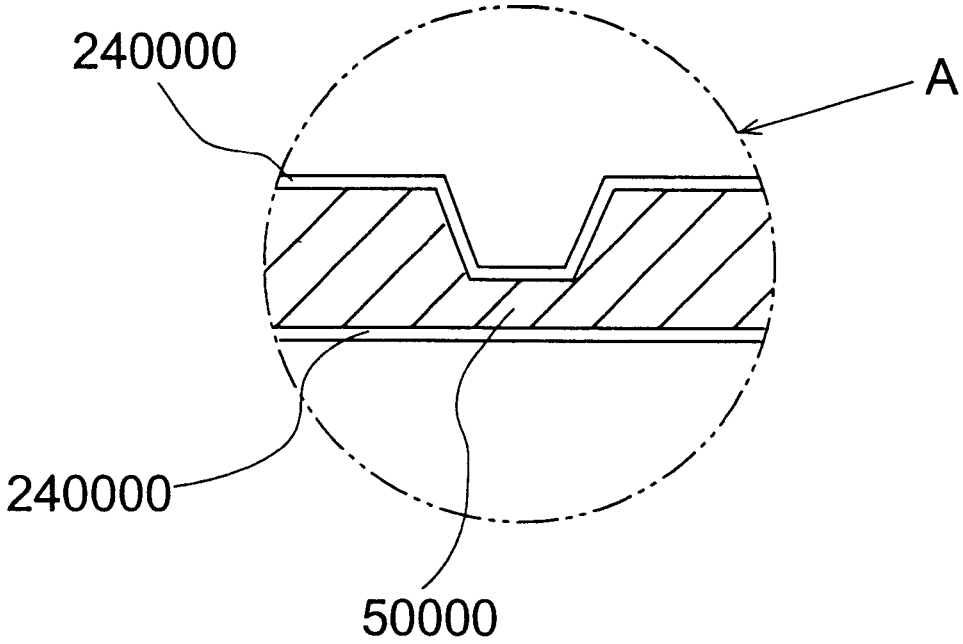
FIG. 60 is an enlarged view of part A in FIG. 59.
Figure 61:
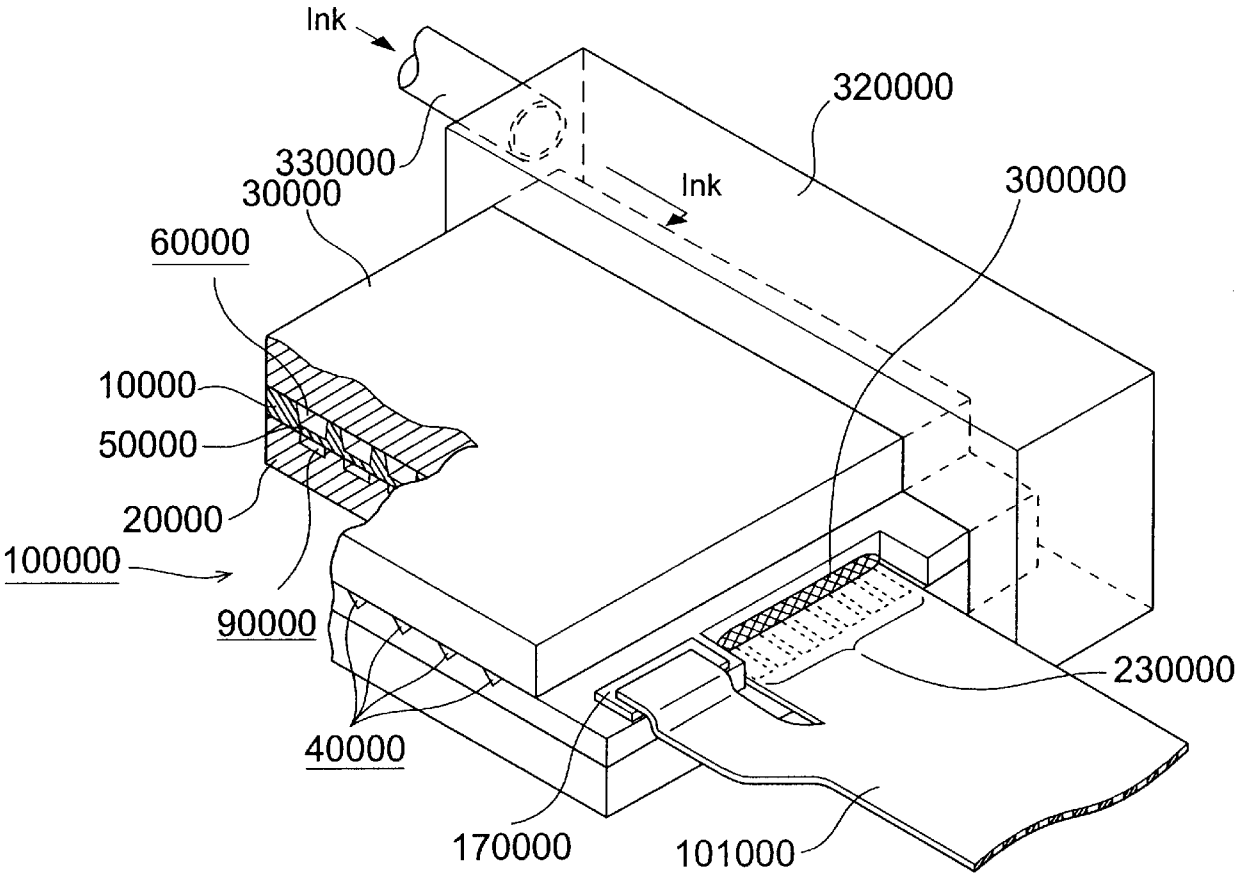
FIG. 61 is a perspective view of the ink jet head shown in FIG. 59 after assembly.
Figure 62:
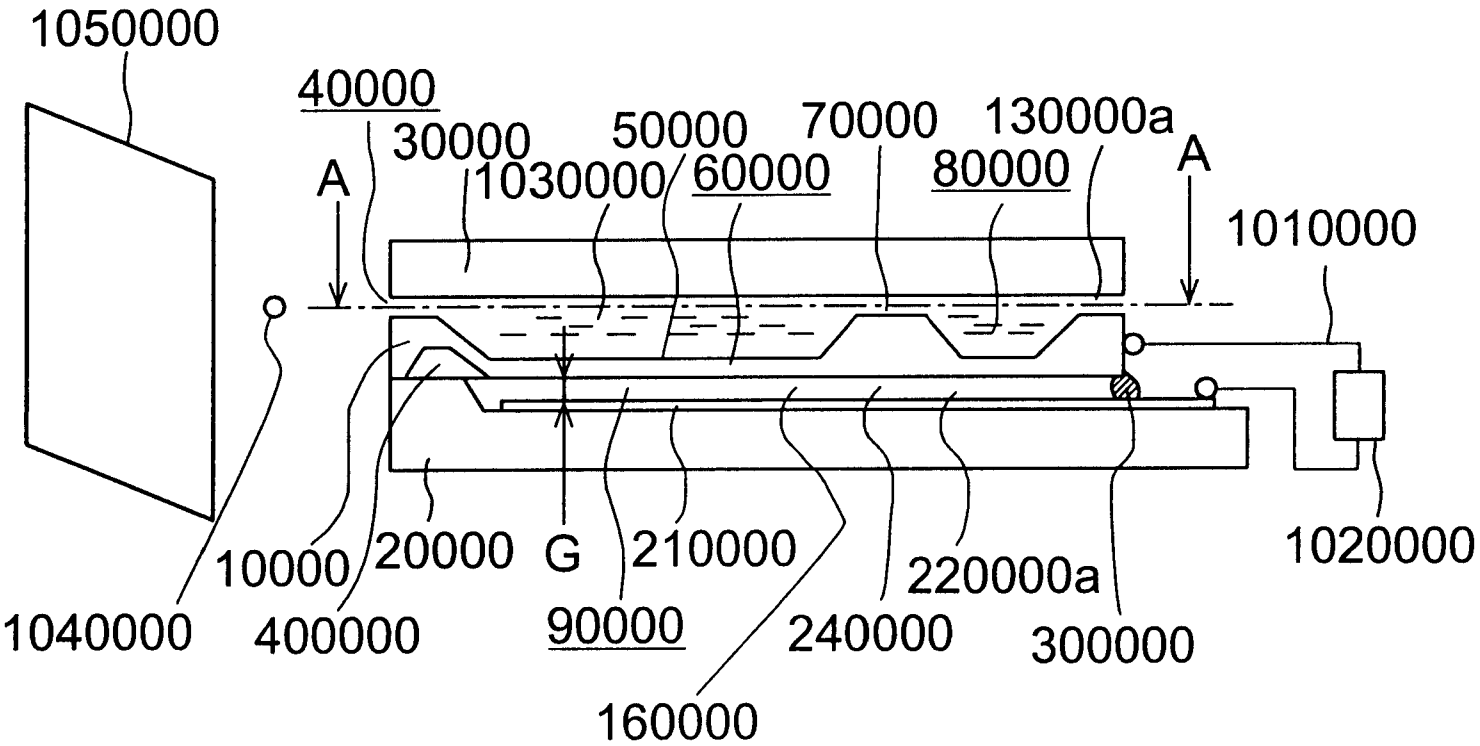
FIG. 62 is a side view in section of the ink jet head shown in FIG. 59.
Figure 63:
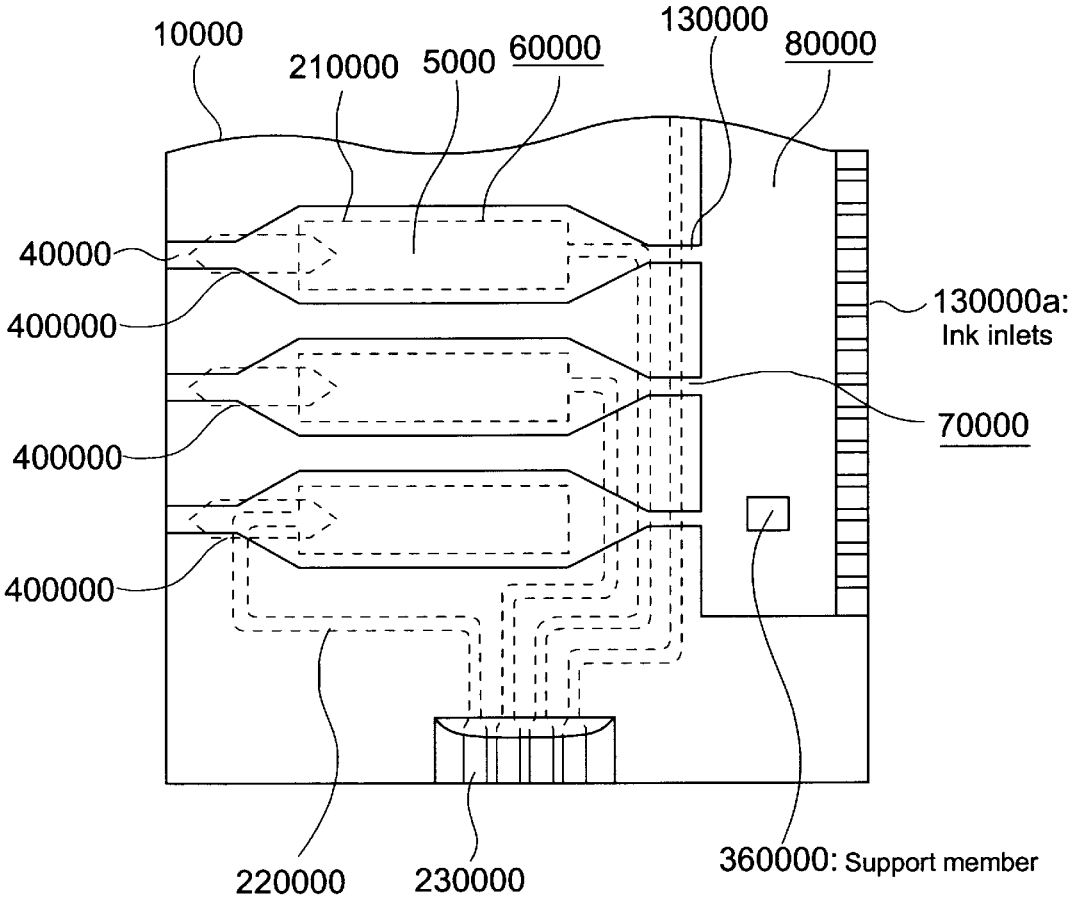
FIG. 63 is a section view along line A—A in FIG. 62.

FIG. 59 is a partly exploded perspective view partly in section of an ink jet head according to a presently preferred embodiment of the present invention. FIG. 60 is an enlarged view of part A in FIG. 59. FIG. 61 is a perspective view of the ink jet head shown in FIG. 59 after assembly. FIG. 62 is a side view in section of the ink jet head shown in FIG. 59. FIG. 63 is a section view along line A—A in FIG. 62. It should be here noted that while the presently preferred embodiment is described below with reference to an edge eject type ink jet head in which ink droplets are ejected from nozzle holes disposed along a substrate edge, the invention shall obviously not be limited thereto and can also be applied to a face eject type ink jet head in which ink droplets are ejected from nozzle holes disposed on a top face of a substrate. As will be known from FIG. 59, an ink jet head 100000 according to the present embodiment has a lamination structure in which three substrates 10000, 20000, and 30000 are stuck together as will be described hereunder.

An intermediate or middle substrate 10000 such as a silicon substrate has: a plurality of nozzle grooves 110000 arranged at equal intervals on a surface of the substrate and extending from an end thereof in parallel to each other to form nozzle openings 40000; concave portions 120000 respectively communicated with the nozzle grooves 110000 to form ejection chambers 60000 respectively having bottom walls serving as diaphragms 50000; fine grooves 130000 respectively provided in the rear of the concave portions 120000 and serving as ink inlets to form orifices 70000; and a concave portion 140000 to form a common ink cavity 80000 for supplying in to the respective ejection chambers 60000. A plurality of ink inlet openings 130000*a* is further provided at the back of concave portion 140000. Each ink inlet opening 130000*a* is sized smaller than nozzle opening 40000, and functions as a filter preventing foreign matter in the ink from entering the ink jet head.

Note that fine grooves 130000 form orifices 70000 when middle substrate 10000 and upper substrate 30000 are bonded together.

Further, concave portions 410000 are respectively provided below each nozzle groove 110000 on the bottom of middle substrate 10000. When a lower substrate 20000 is bonded to the bottom of the middle substrate 10000, each concave portion 410000 forms a second cavity 400000 communicating respectively with a vibration chamber 90000 or a first cavity 220000*a* as will be described later.

The relationship between the work functions of the semiconductor and metallic material used for the electrodes is an important factor affecting the formation of common electrode 170000 to middle substrate 10000. In the present embodiment the common electrode is made from platinum over a titanium base, or gold over a chrome base, but the invention shall not be so limited and other combinations may be used according to the characteristics of the semiconductor and electrode materials. It should be noted that diaphragm 50000 is formed by doping middle substrate 10000 with boron to stop etching at a predetermined point and assure a thin diaphragm of uniform thickness.

As shown in FIG. 60, an oxide thin film 240000 approximately 1 μm thick is formed on the entire surface of middle substrate 10000 except for the common electrode 170000. Oxide thin film 240000 acts as an insulation layer for preventing dielectric breakdown and shorting as a result of contact between diaphragm 50000 and individual electrode 210000, described later, when the ink jet head is driven.

The lower substrate 20000, attached to the bottom face of the middle substrate 10000, is made of borosilicate glass. Concave portions 150000 for forming vibration chambers 90000 are formed in a top surface of the lower substrate 20000. In this preferred embodiment, a distance holding means is constituted by concave portions 150000 formed in the top of lower substrate 20000 so that the distance between diaphragm 50000 and the individual electrode 210000 disposed opposite thereto, that is, the length G of gap part 160000 ("gap length G" below; see FIG. 62) is equal to the difference of the depth of concave portion 150000 and the thickness of individual electrode 210000.

It should be here noted that these concave portions 150000 can be alternatively formed in the bottom of middle substrate 10000. Note, further, that the depth of concave portions 150000 is controlled by etching to 0.3 μm in this preferred embodiment. In addition, the pitch of nozzle grooves 110000 is 0.14 mm, and the width is 30 μm.

Vibration chambers 90000 and second cavities 400000, which communicate with vibration chambers 90000 or first cavities 220000*a*, are formed by bonding lower substrate 20000 and middle substrate 10000 together. At respective positions of the lower substrate 20000, corresponding to respective diaphragms 50000, gold of a pattern similar to the shape of the diaphragm is sputtered to a thickness of 0.1 μm to form individual electrodes 210000. Each individual electrode 210000 has a lead 220000 and a terminal 230000.

Lead 220000 is formed at the bottom of a groove of the same depth as the concave portion 150000 in which individual electrode 210000 is formed, and a first cavity 220000*a* is formed by this groove when the middle substrate 10000 and lower substrate 20000 are bonded together.

It should be noted that ITO or other oxide conductor film can be used in place of gold for the electrodes 210000, 220000, and 230000.

The upper substrate 30000 bonded to the top surface of middle substrate 10000 is made from the same borosilicate glass as the lower substrate 20000. Bonding upper substrate 30000 to middle substrate 10000 forms nozzle openings 40000, ejection chambers 60000, orifices 70000, and common ink cavity 80000.

The ink-jet head of the preferred embodiment is constructed as follows. First, the middle substrate 10000 and the lower substrate 20000 are anode bonded by applying a 500–800V source at 270–400° C. between them. Then, the middle substrate 10000 and the upper substrate 30000 are bonded under the same conditions, resulting in the assembled ink-jet head shown in FIG. 61. After anode bonding, a capacitor is formed by diaphragm 5000 and individual electrode 210000. The gap length G formed between diaphragm 50000 and individual electrode 210000 on lower substrate 20000 (i.e., the gap length of the capacitor) is, as described above, the difference of the depth of concave portion 150000 and the thickness of individual electrode 210000, and in this preferred embodiment is 0.2 $\mu$m.

After thus assembling the ink jet head, drive circuit 1020000 is connected by connecting flexible printed circuit (FPC) 1010000 between common electrode 170000 and terminal members 230000 of individual electrodes 210000 as shown in FIGS. 61 and 62. An anistropic conductive film is preferably used in this embodiment for bonding leads 1010000 with electrodes 170000 and 230000.

Nitrogen gas is also injected to vibration chambers 90000, which are sealed airtight using an insulated sealing agent 300000. Vibration chambers 90000 are sealed near terminal members 230000, that is, near the end of first cavity 220000*a*, in this embodiment, thus enclosing vibration chamber 90000 and a volume of second cavity 400000 and first cavity 220000*a* in the volume of the actuator.

Ink 1030000 is supplied from the ink tank (not shown in the figures) through ink supply tube 330000 and ink supply vessel 320000, which is secured externally to the back of the ink jet head to fill ink cavity 80000 and ejection chambers 60000 in middle substrate 10000. The ink in ejection chamber 60000 becomes ink droplet 1040000 ejected from nozzles 40000 and printed to recording paper 1050000 when ink jet head 100000 is driven, as shown in FIG. 62.

The actuator of an ink jet head according to this preferred embodiment is thus sealed airtight. Therefore, for the reasons described below, the ratio ΔV/V where ΔV is the volume displaced by diaphragm 50000, and V is the volume of the actuator. These reasons are described next.

Figure 64:
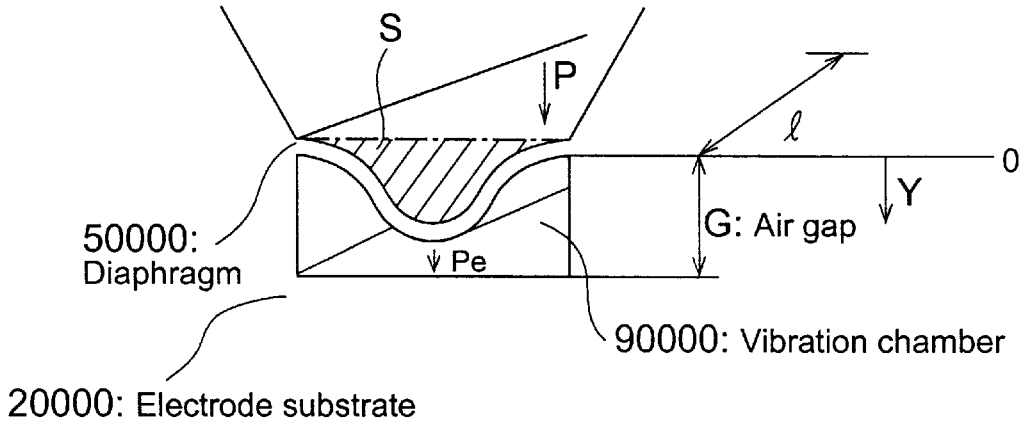
FIG. 64 is used to describe diaphragm operation in the ink jet head shown in FIG. 59.

FIG. 64 is used to describe diaphragm 50000 operation. In this preferred embodiment, applying a voltage between common electrode 170000 and individual electrode 210000 produces an electrostatic force between individual electrode 210000 and diaphragm 50000, which is conductive with common electrode 170000. This electrostatic force deforms diaphragm 50000, and thereby products an ejection force for ejecting ink from the nozzle. The electrostatic attraction force P, can be determined from the following equation:

$$P_e = \frac{\varepsilon_r \varepsilon_o}{2}\left(\frac{V_h}{G-y}\right)^2$$

where $\epsilon_0$ the dielectric constant ($8.85\times10^{-12}$ (F/m) in a vacuum); $V_h$ is the applied voltage (=drive voltage); and $\epsilon_E$ is the relative dielectric constant in the actuator. In this embodiment, $V_h$=35 V; $\epsilon_r$=approximately 1; and G=0.2 $\mu$m.

The above equation shows that the electrostatic attraction force P, increases as the diaphragm 50000 approaches individual electrode 210000, and that as diaphragm 50000 separates from individual electrode 210000, pressure cannot be generated efficiently relative to the applied voltage.

When the actuator is an airtight sealed structure, the internal pressure of the actuator is also increased by the displacement volume ΔV of diaphragm 50000 deformation. This displacement volume ΔV can be determined from the following equation:

$$Pi - P_0 = \Delta P = \left(\frac{V}{V-\Delta V} - 1\right)P_0 = \left(\frac{\Delta V}{V-\Delta V}\right)P_o$$

where: $P_0$ is the atmospheric pressure; $P_i$ is the internal volume of the actuator; and V is the actuator volume.

The above equation shows that as ΔV/V increases (or V/ΔV decreases), the increase in ΔP in the internal actuator pressure also increases. This increase in ΔP inhibits diaphragm 50000 from approaching individual electrode 210000.

Figure 65:
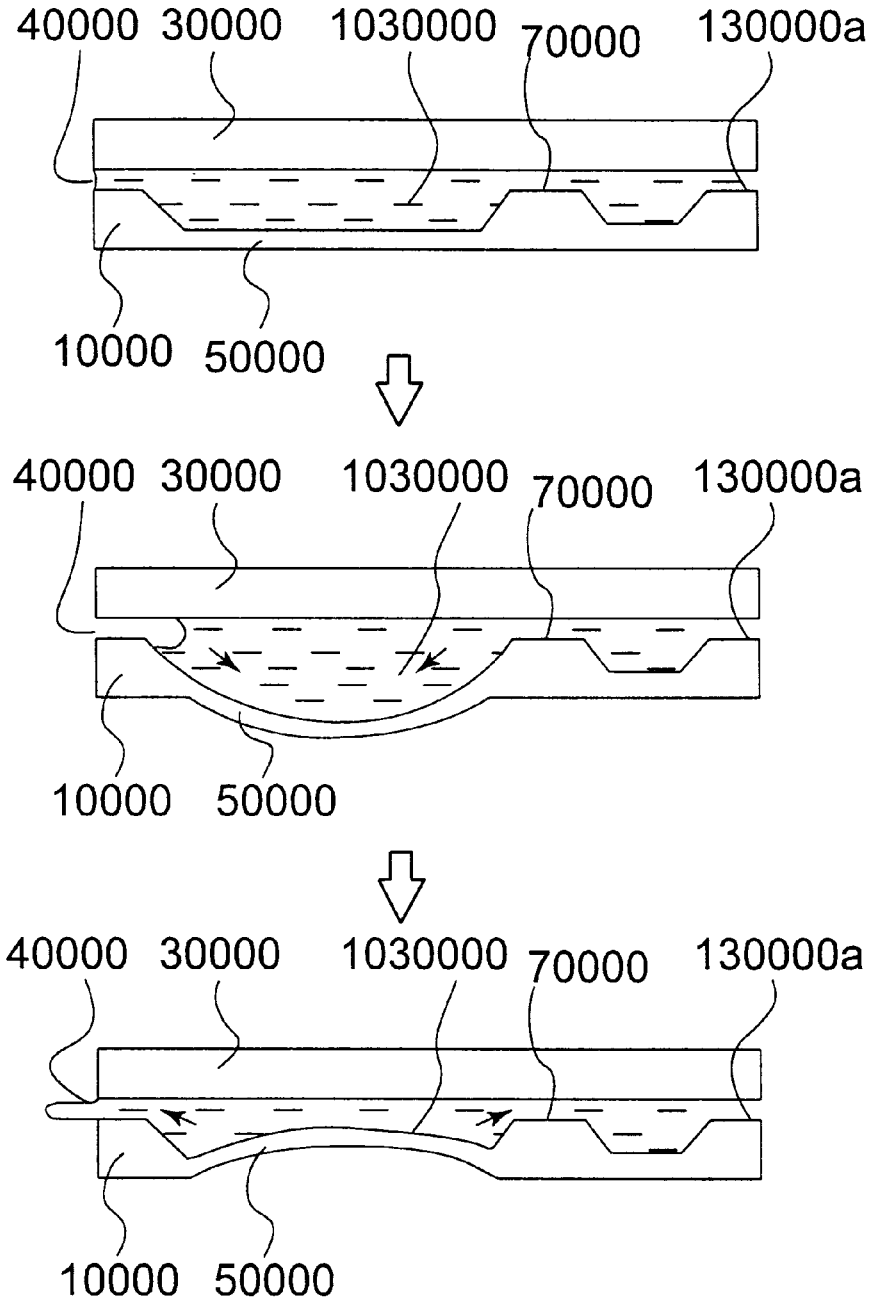
FIG. 65 is used to describe the ink ejection process of the ink jet head shown in FIG. 59.

FIG. 65 is used to describe the ink ejection operation of an ink jet head according to the present embodiment. As will be known from FIG. 65, attraction of diaphragm 50000 by individual electrode 210000 causes diaphragm 50000 to deform in a direction increasing the internal volume of ejection chamber 60000. Ink thus flows into the nozzle. When the attraction force is then released, pressure created by resilience returning the diaphragm in the opposite direction ejects ink from the nozzle.

Movement of the ink meniscus after the electrostatic attraction force pulling the diaphragm 50000 is released is proportional to the displacement of the free vibrating diaphragm. The ink ejection volume is therefore determined by the volume displacement of the ink meniscus when ink is pulled into the ejection chamber during the diaphragm attraction process.

In the ink ejection process, the displacement volume ΔV resulting from the deformation of the diaphragm is filled by the inward flow of ink from the meniscus of nozzle 40000 and the inward flow of ink from the common ink cavity 80000 through the orifice 70000 to the ejection chamber 60000. The relationship between the volumes of inward flowing ink is determined by the diaphragm attraction time (i.e., the time it takes for the diaphragm to move from an undisplaced state to a fully displaced state) for the reasons described below.

When the ink meniscus is pulled into the nozzle, the surface tension of the meniscus works to inhibit the inward movement of ink. Because of this action, the volume of the ink meniscus movement increases, and ejection efficiency can be increased, as the time required for diaphragm displacement decreases when the diaphragm is displaced only by the same displacement volume ΔV.

The most effective method of shortening the time required to displace a diaphragm having a specific rigidity a specific displacement volume ΔV without increasing the applied voltage is to reduce increase ΔP, which as described above works in the direction inhibiting electrostatic attraction force $P_e$. It is therefore preferable when designing an ink jet head to achieve the lowest possible ΔV/V ratio.

To reduce this ΔV/V ratio, a second cavity 400000 is disposed separately to vibration chamber 90000 and first cavity 220000*a* in an ink jet head according to the present embodiment to increase the volume V of the airtight actuator. By providing a second cavity 400000 with a volume ten times the combined volume of vibration chamber 90000 and first cavity 220000*a* in this preferred embodiment, the applied voltage required to assure a 30 ng ink ejection volume at 10° C. was reduced from 38 V to 35 V.

Furthermore, in this preferred embodiment, the second cavity 400000 is disposed on the bottom of the middle substrate 10000 so as to communicate with vibration chamber 90000 of the lower substrate 20000 when the lower substrate 20000 is bonded thereto. When a cavity for increasing the actuator volume V is provided on the same lower substrate 20000 as the vibration chamber 90000, it becomes necessary to increase the ink jet head size in order to assure sufficient volume, and the yield from a wafer of a constant size is necessarily reduced. However, if the cavity is provided on the bottom of the middle substrate 10000, the formed cavities can be made deeper compared with when they are provided on the lower substrate 20000, and a sufficiently large, effective actuator volume V can be easily achieved without increasing the ink jet head size.

Furthermore, in this preferred embodiment, the second cavity 400000 is formed on the bottom of the middle substrate 10000 by means of anisotropic etching of silicon. It is also possible to form the cavities and grooves constituting the nozzle openings 40000, ejection chambers 60000, orifices 70000, common ink cavity 80000, and ink inlet opening 130000*a* on the top surface of the same substrate in a single etching processing using the same anisotropic etching of silicon. As a result, it is possible to suppress an increase in the number of manufacturing steps and production cost required for producing the second cavities 400000.

In the anisotropic etching of silicon for these second cavities 400000 in this preferred embodiment, the (111) face of the silicon crystal is used for the etching face. The etching rate of the (111) face is extremely slow compared with other etching faces. Using this (111) face enables extremely high precision processing of the cavities, as well as a high density etching pattern.

Figure 66:
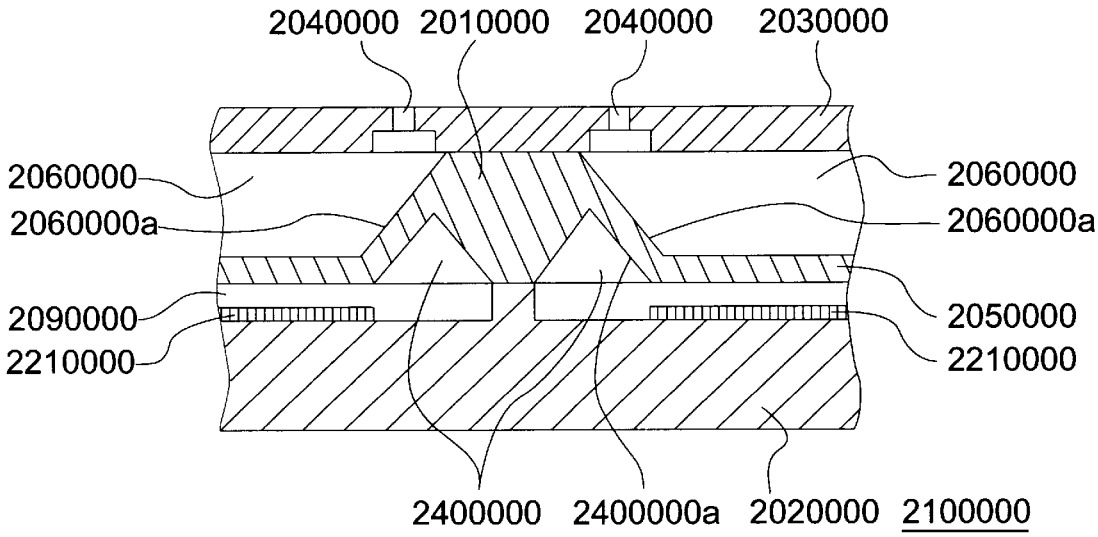
FIG. 66 is a section view of an ink jet head according to another presently preferred embodiment of the present invention.

FIG. 66 is a section view of an ink jet head according to another preferred embodiment of the present invention. As shown in FIG. 66, this ink jet head 2100000 is a face ejection type ink jet head wherein nozzles 2040000 are arranged at equal intervals in two rows of 640000 nozzles per row on nozzle plate 2030000. As with the ink jet head 100000 according to the above preferred embodiment, this ink jet head 2100000 is a laminated structure of three elements: ink path substrate 2010000, electrode substrate 2020000, and nozzle plate 2030000.

Nozzle plate 2030000 is a silicon wafer with the (100) face on the surface. The nozzles 2040000 are formed by an etching process. The ink path substrate 2010000 is a silicon substrate with a (110) crystal face direction, and is doped with a high concentration of boron on the diaphragm 2050000 surface. As in the ink jet head 100000 described above, ejection chambers 2060000 and diaphragms 2050000 are formed by anisotropic etching.

The electrode substrate 2020000 is a borosilicate glass substrate in which vibration chambers 2090000 are formed with individual electrodes 2210000 on the bottom thereof. It should be noted that substrates 2010000 and 2020000 are fastened together by anodic bonding, and substrates 2010000 and 2030000 are bonded with adhesive.

While the (110) face is exposed at the bottom (diaphragm 2050000) of the ejection chamber 2060000 of the ink path substrate 2010000, the slow etching rate (111) face is exposed at side wall 2060000*a*. As a result of this etching rate difference, the side walls 2060000*a* of the ejection chamber 2060000 become oblique to the surface, and the bottom part of the nozzles 2040000 formed in two rows on the ink path substrate 2010000 is large and relatively thick. Cavities 2400000 are disposed in this large, relatively thick part in this preferred embodiment. Cavities 2400000 are formed by anistropic etching from the back side of ink path substrate 2010000 (the side opposite the ejection chambers). Because the side walls 2400000*a* of the recesses that form cavities 2400000 are all formed by the (111) face, air chambers can be formed with good precision. That is, variation in the actuator volume V determined by the sum of the volume of, for example, vibration chambers 2090000 and cavities 2400000 can be suppressed.

In addition, it is conventionally difficult to provide cavities for effectively and evenly increasing the actuator volume in electrode substrate 2020000 in an ink jet head having an extremely small nozzle pitch and high density electrode pattern. In an ink jet head according to the present embodiment, however, such cavities for effectively and evenly increasing the actuator volume can be provided without increasing the ink jet head size by providing the cavities on the back of the ink path substrate 2010000.

Furthermore, it should be noted that while the second cavities are formed so as to communicate with the vibration chambers in the above preferred embodiments of the present invention, the invention shall not be so limited as it will be obvious to one with ordinary skill in the related art that these second cavities can be provided so as to communicate with the first cavities in which a lead to an electrode is provided in the bottom.

Effects of the presently preferred embodiments of the invention

As described above, the problem of airborne particulate penetrating to the ink jet head when a diaphragm is driven is eliminated by means of the airtight actuator structure of the invention.

In addition, by providing a cavity communicating with a vibration chamber, actuator volume can be increased sufficiently with respect to the volume displaced by the diaphragm during diaphragm drive. There is therefore little increase in pressure inside the actuator during ink jet head drive, the ejection force required for ink ejection can be sufficiently assured, and an ink jet head achieving outstanding print quality and reliability can be provided.

Furthermore, a large volume cavity can be formed in a small area in an ink jet head according to the present invention because the cavity is formed in the same substrate as are the ink path and diaphragm. A sufficiently large cavity can therefore be assured without increasing the ink jet head size.

Yet further, because the cavities are formed by anistropic silicon etching in the same substrate as are the ink paths and diaphragms in an ink jet head according to the present invention, the cavities, ink path, and diaphragm can be formed in a single etching process. As a result, the number of manufacturing steps and the manufacturing cost can be suppressed.

As also described above, extremely high precision cavity processing is made possible by using the extremely low etching rate (111) silicon face for anistropic silicon etching, thereby enabling especially high density pattern formation.

In the presently preferred embodiments of the invention (FIGS. 59–66), an additional cavity is provided (i.e., second cavity 400000, 2400000). With this additional cavity, the upper limit of 8 for $V/\Delta V$ (described in connection with the embodiments of FIGS. 1–58) is not meaningful. In the presently preferred embodiments, there is no upper limit for $V/\Delta V$.

While the invention has been described in conjunction with specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

What is claimed is:

1. An ink jet recording apparatus for printing to a recording medium by ejecting ink droplets from a nozzle, comprising:

a diaphragm for applying pressure to the nozzle for injecting an ink droplet;

a capacitor formed by the diaphragm and an electrode opposing the diaphragm with a specific gap therebetween;

a drive circuit for charging and discharging the capacitor to deform the diaphragm by means of an electrostatic force and thereby eject an ink droplet from the nozzle;

a vibration chamber defined in part by a first wall surface formed by the diaphragm and a second wall surface on which the electrode is disposed, the vibration chamber being sealed airtight; and a cavity communicating with the vibration chamber, which increase a volume of an airtight sealed part including said vibration chamber.

2. The ink jet recording apparatus as set forth in claim 1, further comprising:

a lead for connecting the drive circuit and the electrode; and wherein the cavity comprises a first cavity communicating with the vibration chamber and defined in part by a third wall surface on which the lead is disposed, and a second cavity communicating with one or both of the vibration chamber and the first cavity.

3. An ink jet recording apparatus for printing to a recording medium by ejecting ink droplets from a nozzle, comprising:

a first substrate in which a diaphragm is formed;

a second substrate in which an electrode is formed, and to which is bonded the first substrate;

a capacitor formed by the diaphragm and the electrode opposing the diaphragm with a specific gap therebetween when the second substrate is bonded to the first substrate;

a drive circuit for charging and discharging the capacitor to deform the diaphragm by means of an electrostatic force and thereby eject an ink droplet from the nozzle;

a vibration chamber defined in part by a first wall surface formed by the diaphragm and a second wall surface on which the electrode is disposed, the vibration chamber being sealed airtight; and a cavity formed in one or both of the first substrate and the second substrate, the cavity communicating with the vibration chamber when the second substrate is bonded to the first substrate.

4. The ink jet recording apparatus as set forth in claim 3, wherein the first substrate is silicon, and wherein the cavity is formed in the silicon substrate.

5. The ink jet recording apparatus as set forth in claim 3, further comprising:

a lead formed in the second substrate for connecting the drive circuit to the electrode; and wherein the cavity comprises a first cavity communicating with the vibration chamber and defined in part by a third wall surface on which the lead is disposed, and a second cavity which communicates with one or both of the vibration chamber and the first cavity.

6. The ink jet recording apparatus as set forth in claim 5, wherein the first substrate is silicon, and wherein the second cavity is formed in the silicon substrate.

7. The ink jet recording apparatus as set forth in claim 5, wherein the second cavity is disposed substantially below the nozzle.

8. An ink jet recording head for printing to a recording medium by ejecting ink droplets from a nozzle, comprising:

a first substrate in which a diaphragm is formed;

a second substrate in which an electrode is formed, and to which is bonded the first substrate;

a capacitor formed by the diaphragm and the electrode opposing the diaphragm with a specific gap therebetween when the second substrate is bonded to the first substrate;

a vibration chamber defined in part by a first wall surface formed by the diaphragm and a second wall surface on which the electrode is disposed, the vibration chamber being sealed airtight; and a cavity formed in one or both of the first substrate and the second substrate, the cavity communicating with the vibration chamber when the second substrate is bonded to the first substrate.

9. The ink jet recording head as set forth in claim 8, wherein the first substrate is silicon, and wherein the cavity is formed in the silicon substrate.

10. The ink jet recording head as set forth in claim 8, further comprising:

a lead formed in the second substrate for connecting the electrode to a drive circuit for driving the capacitor; and wherein the cavity comprises a first cavity communicating with the vibration chamber and defined in part by a third wall surface on which the lead is disposed, and a second cavity which communicates with one or both of the vibration chamber and the first cavity.

11. The ink jet recording head as set forth in claim 10, wherein the first substrate is silicon, and wherein the second cavity is formed in the silicon substrate.

12. The ink jet recording head as set forth in claim 10, wherein the second cavity is disposed substantially below the nozzle.

* * * * *

UNITED STATES PATENT AND TRADEMARK OFFICE

CERTIFICATE OF CORRECTION

PATENT NO. : 6,168,263 B1
DATED : January 2, 2001
INVENTOR(S) : Shigeo Nojima et al.

It is certified that error appears in the above-identified patent and that said Letters Patent is hereby corrected as shown below:

Column 41,
Line 6, change "injecting" to -- ejecting --.

Signed and Sealed this

Nineteenth Day of February, 2002

*Attest:*

*Attesting Officer*

JAMES E. ROGAN
*Director of the United States Patent and Trademark Office*